US005977943A

United States Patent [19]

Mano et al.

[11] Patent Number: 5,977,943

[45] Date of Patent: Nov. 2, 1999

[54] METHOD OF DRIVING STN LIQUID CRYSTAL PANEL AND APPARATUS THEREFOR

[75] Inventors: Hiroyuki Mano, Chigasaki; Toshio Tanaka, Yokohama; Shigeyuki Nishitani, Ebina; Masaaki Kitajima, Hitachiota, all of Japan

[73] Assignee: Hitachi, Ltd., Tokyo, Japan

[21] Appl. No.: 08/869,779

[22] Filed: Jun. 5, 1997

Related U.S. Application Data

[62] Division of application No. 08/340,485, Nov. 14, 1994, Pat. No. 5,638,088, which is a continuation of application No. 08/077,774, Jun. 18, 1993, abandoned.

[30] Foreign Application Priority Data

Jun. 18, 1992 [JP] Japan ..... 4-159139
Sep. 9, 1992 [JP] Japan ..... 4-240329

[51] Int. Cl.[6] ..... G09G 3/36

[52] U.S. Cl. ..... 345/98; 345/87; 345/100; 345/103

[58] Field of Search ..... 345/87, 88, 89, 345/92, 93, 95, 98, 100, 103

[56] References Cited

U.S. PATENT DOCUMENTS

| | | | |
|---|---|---|---|
| 4,504,829 | 3/1985 | Usui | 340/756 |
| 4,985,698 | 1/1991 | Mano et al. | 340/784 |
| 5,053,764 | 10/1991 | Barbier et al. | 340/793 |
| 5,220,314 | 6/1993 | Mano et al. | 340/784 |
| 5,485,173 | 1/1996 | Scheffer et al. . | |
| 5,583,530 | 12/1996 | Mano et al. . | |

FOREIGN PATENT DOCUMENTS

| | | | |
|---|---|---|---|
| 0507061 | 10/1992 | European Pat. Off. | 345/98 |
| 5-46127 | 2/1993 | Japan . | |
| 645473 | 9/1984 | Switzerland . | |

OTHER PUBLICATIONS

J. Nehring et al., "Ultimate Limits for Matrix Addressing of RMS–Responding Liquid–Crystal Displays", *IEEE Transactions on Electron Devices*, vol. ED–26, No. 5, May 1979, pp. 795–802.

T. Ruckmongathan et al., "New Addressing Techniques for Multiplexed Liquid Crystal Displays", *Proceedings of the SID*, vol. 24/3, 1983, pp. 259–262.

T. Ruckmongathan, "A Generalized Addressing Techniques for RMS Responding Matrix LCDs", *1988 International Display Research Conference*, IEEE, 1988, pp. 80–85.

T. Scheffer et al., "Active Addressing Method for High–Contrast Video–Rate STN Displays", *SID 92 Digest*, 1992, pp. 228–231.

S. Ihara et al., "A Color STN–LCD with Improved Contrast, Uniformity, and Response Times", *SID 92 Digest*, 1992, pp. 232–235.

T. Ruckmongathan et al., "A New Addressing Technique for Fast Responding STN LCDs", *Japan Display '92*, 1992, pp. 65–68.

B. Clifton et al., "Hardware Architectures for Video–Rate, Active Addressed STN Displays", *Japan Display '92*, 1992, pp. 503–506.

U.S. patent application Serial No. 08/003,448 filed on Jan. 12, 1993.

*Primary Examiner*—Vijay Shankar
*Attorney, Agent, or Firm*—Antonelli, Terry, Stout & Kraus, LLP

[57] ABSTRACT

A liquid crystal (LC) display apparatus using an active matrix driving method includes an LC panel having electrodes of N rows by M columns (where N≧2, M ≧2). Intersections of row electrodes and column electrodes form display dots. A column data generation circuit generates, for each row, column data to be supplied to the LC panel, on the basis of display data representing whether each dot should be turned on or not and values of an orthogonal function having values of −1 or 1. A column electrode driver drives column electrodes of the LC panel on the basis of generated column data. A row data generation circuit generates row data for each column on the basis of a part of values of the orthogonal function. A row electrode driver drives row electrodes of the LC panel on the basis of row data.

19 Claims, 35 Drawing Sheets

| | | | |
|---|---|---|---|
| D(1,1) | D(1,2) | D(1,3) | D(1,4) |
| D(2,1) | D(2,2) | D(2,3) | D(2,4) |
| D(3,1) | D(3,2) | D(3,3) | D(3,4) |
| D(4,1) | D(4,2) | D(4,3) | D(4,4) |

FIG. 9
| | t = 1 | t = 2 | t = 3 | t = 4 |
|---|---|---|---|---|
| h(1) | 1 (1) | 0 (−1) | 0 (−1) | 1 (1) |
| h(2) | 0 (−1) | 1 (1) | 0 (−1) | 1 (1) |
FIG. 10A
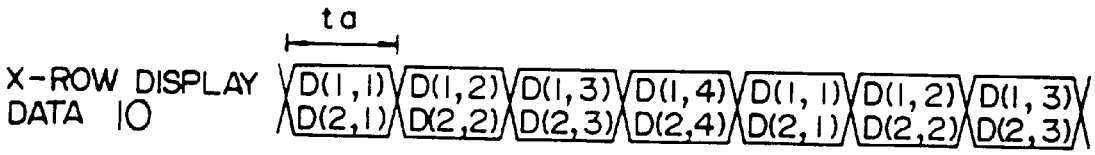
FIG. 10B
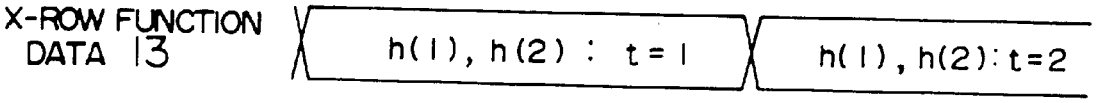
FIG. 11
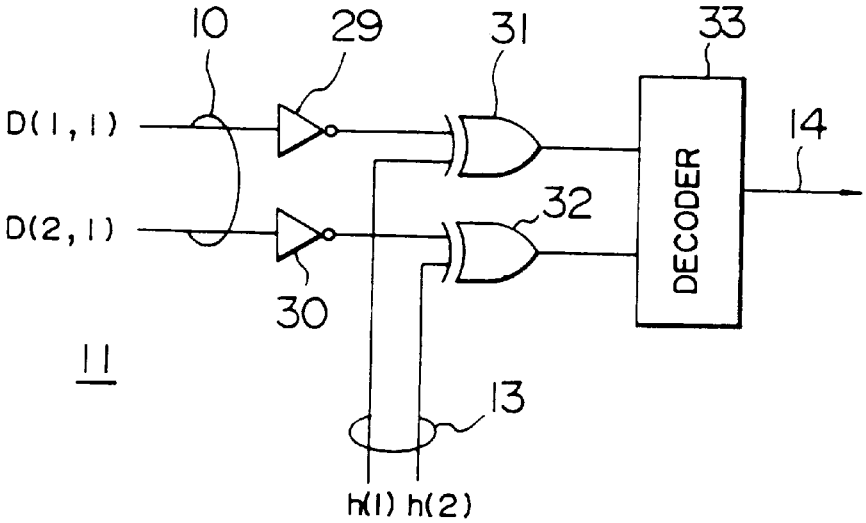

FIG. 12

| INPUT | | OUTPUT | REMARKS |
|---|---|---|---|
| 0 | 0 | −2 | (2 × 0) − 2 = −2 |
| 0 | 1 | 0 | (2 × 1) − 2 = 0 |
| 1 | 0 | 0 | (2 × 1) − 2 = 0 |
| 1 | 1 | 2 | (2 × 2) − 2 = 2 |

FIG. 13

| | t = 1 | t = 2 | t = 3 | t = 4 | t = 5 | t = 6 | t = 7 | t = 8 |
|---|---|---|---|---|---|---|---|---|
| f(1) | 1 | −1 | −1 | 1 | 0 | 0 | 0 | 0 |
| f(2) | −1 | 1 | −1 | 1 | 0 | 0 | 0 | 0 |
| f(3) | 0 | 0 | 0 | 0 | 1 | −1 | −1 | 1 |
| f(4) | 0 | 0 | 0 | 0 | −1 | 1 | −1 | 1 |

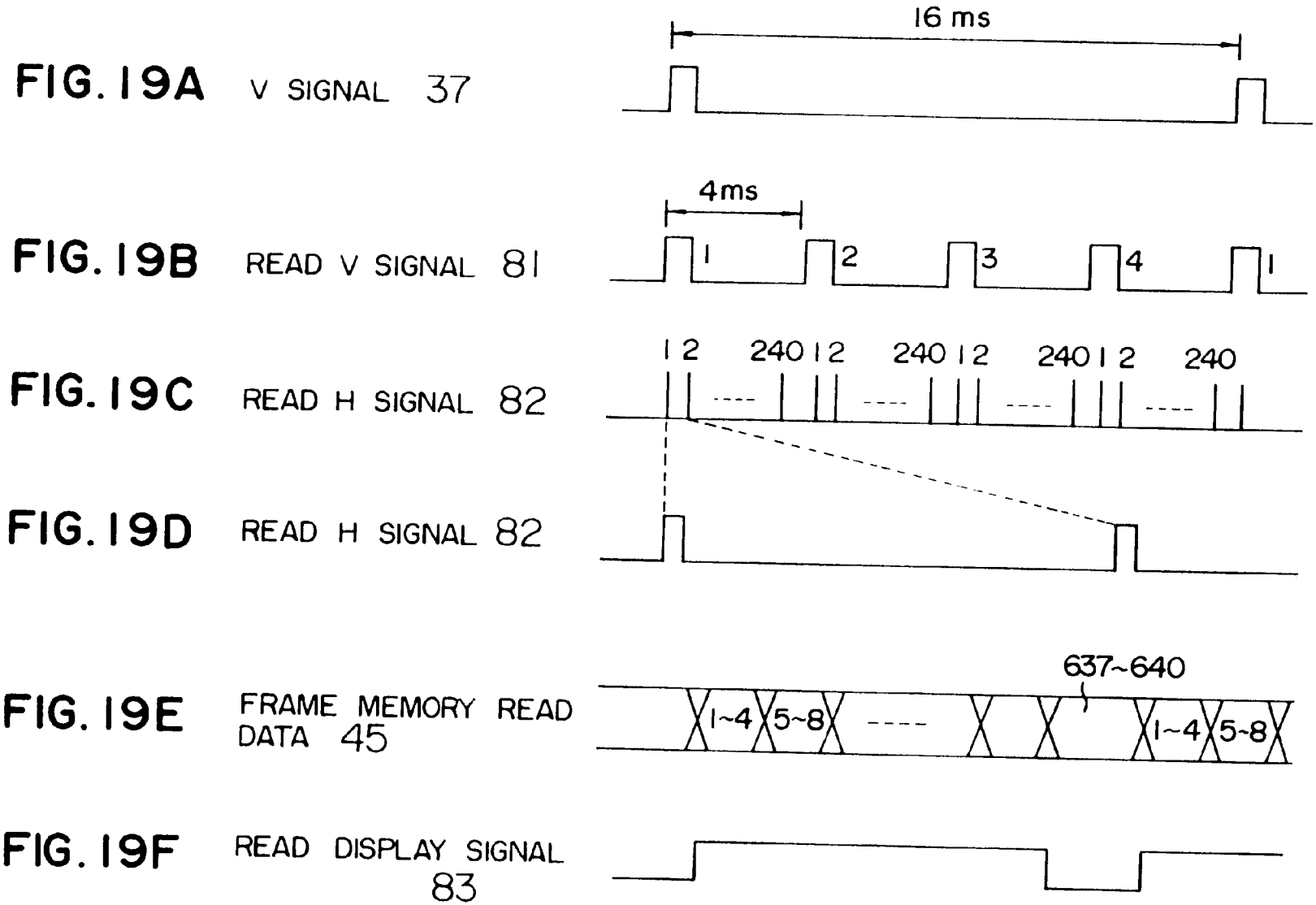
FIG. 19A V SIGNAL 37
FIG. 19B READ V SIGNAL 81
FIG. 19C READ H SIGNAL 82
FIG. 19D READ H SIGNAL 82
FIG. 19E FRAME MEMORY READ DATA 45
FIG. 19F READ DISPLAY SIGNAL 83

FIG. 21A V SIGNAL 37

FIG. 21B FRAME R/W SIGNAL 72

FIG. 21D READ V SIGNAL 81

FIG. 23A READ V SIGNAL 81

FIG. 23B READ H SIGNAL 82

FIG. 23C LINE ADDRESS 88 — 1 2 ---- 7 8 1 ----- 7 8 1

FIG. 23D AW SIGNAL 91

FIG. 24
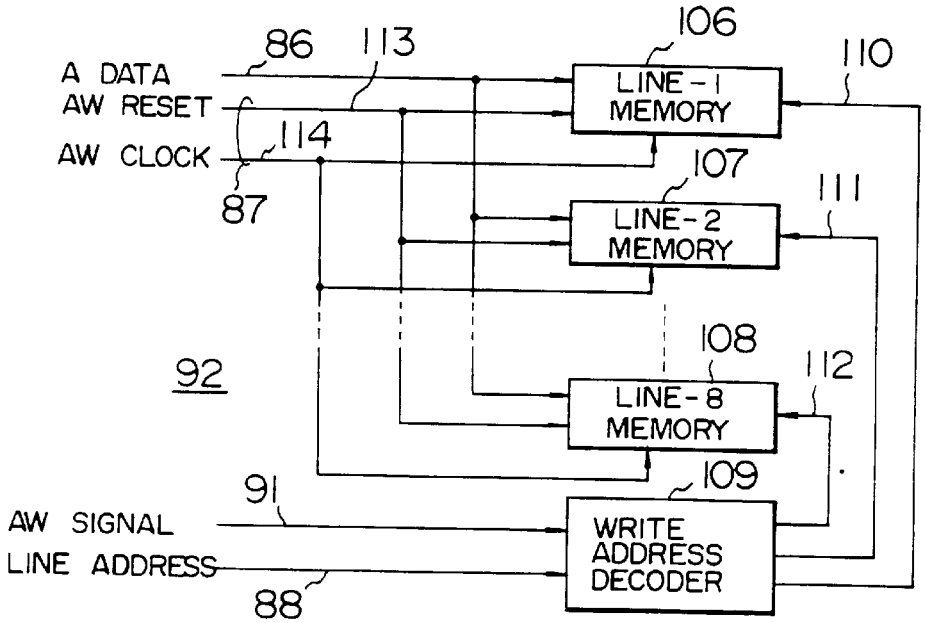
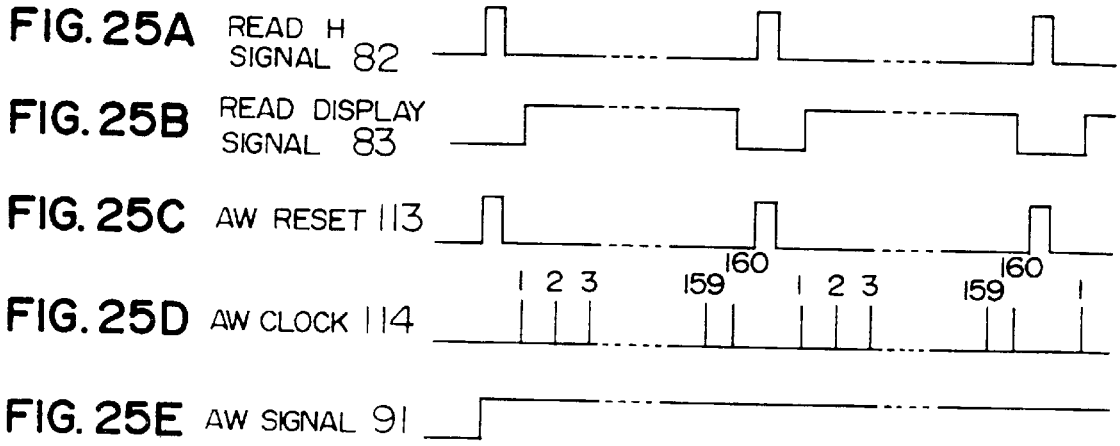

FIG. 27A AW SIGNAL 91
FIG. 27B READ H SIGNAL 82
FIG. 27C A DATA 86
17 18 19 20 21
FIG. 27D B DATA 90
9 10 11 12 13 14 15 16
FIG. 27E AR RESET 116
FIG. 27F READ COUNT 100
1 2 3 4 1 2
FIG. 27G AR RESET 116
FIG. 27H LINE MEMORY A1 TO A8 DATA 113---115
640
1 2 ---- 1 2
FIG. 27I AR CLOCK 117

| FIELD NO. | READ COUNT SIGNAL | DIVISION TIME K |
|---|---|---|
| 1 | 1 | K1 |
| | 2 | K2 |
| | 3 | K3 |
| | 4 | K4 |
| 2 | 1 | K5 |
| | 2 | K6 |
| | 3 | K7 |
| | 4 | K8 |
| 3 | 1 | K9 |
| | 2 | K10 |
| | 3 | K11 |
| | 4 | K12 |
| 4 | 1 | K13 |
| | 2 | K14 |
| | 3 | K15 |
| | 4 | K16 |

FIG. 34A V SIGNAL 37

FIG. 34B READ V SIGNAL 81

FIG. 34C READ H SIGNAL 82

FIG. 34D READ H SIGNAL 82

FIG. 34E FRAME READ DATA 45

FIG. 34F READ DISPLAY SIGNAL 83

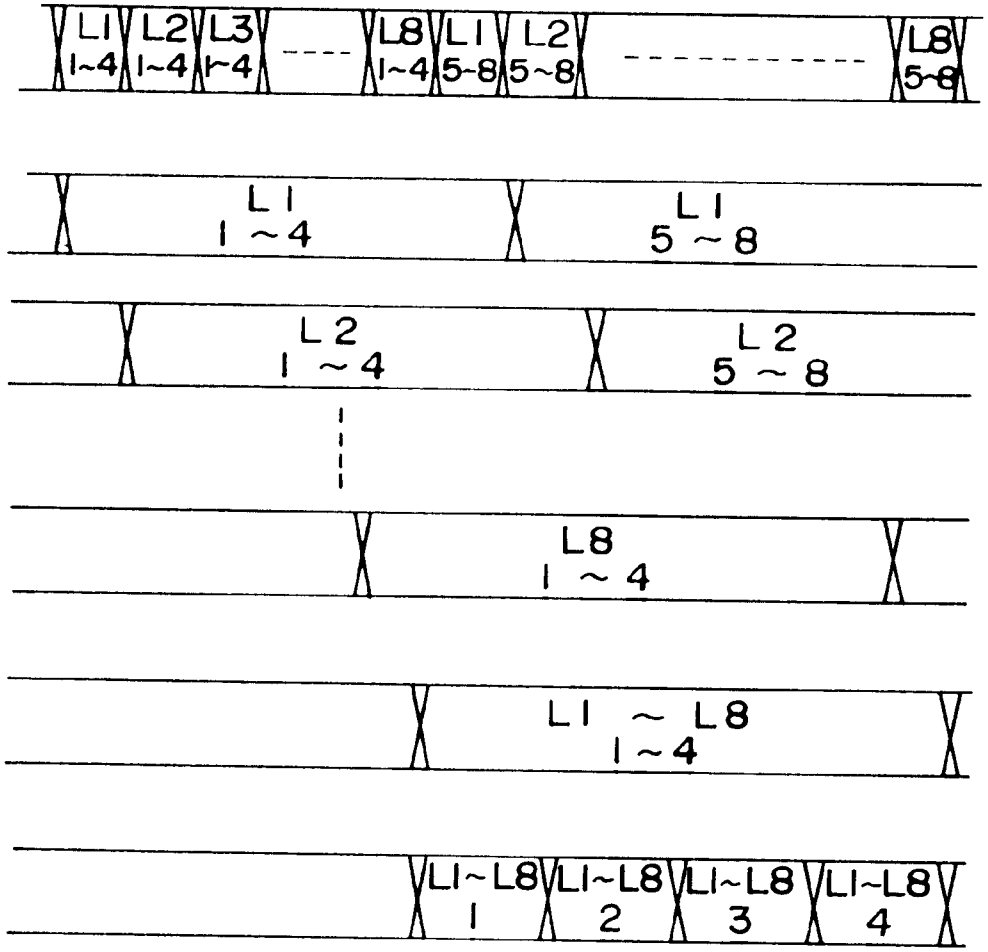
FIG. 36A FRAM MEMORY READ DATA 45
FIG. 36B LATCH DATA OF FIRST LINE
FIG. 36C LATCH DATA OF SECOND LINE
FIG. 36D LATCH DATA OF EIGHTH LINE
FIG. 36E LATCH DATA
FIG. 36F 8-LINE DATA 99

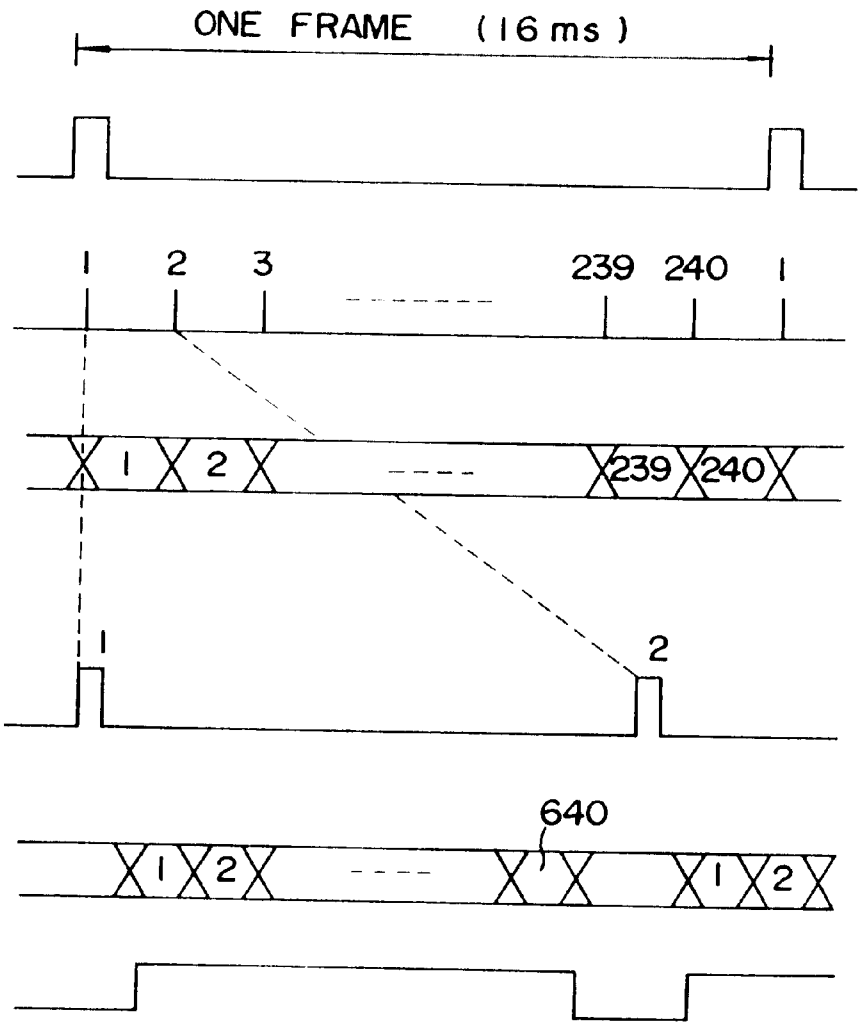
FIG. 38A V SIGNAL 37
FIG. 38B H SIGNAL 36
FIG. 38C DISPLAY DATA 35
FIG. 38D H SIGNAL 36
FIG. 38E DISPLAY DATA 35
FIG. 38F DISPLAY SIGNAL 39

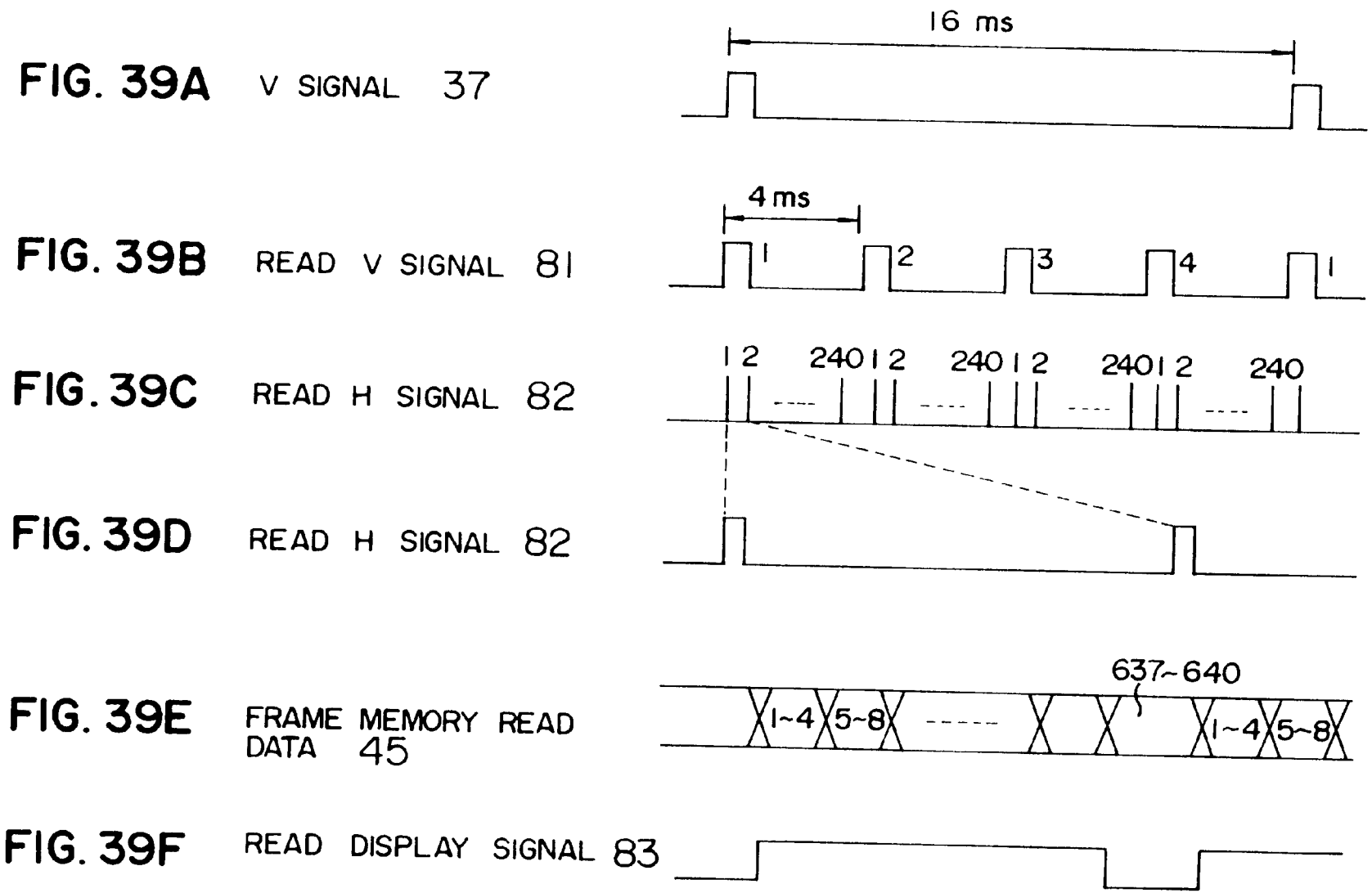
16 ms
4 ms
1
2
3
4
1
1 2
240 1 2
240 1 2
240 1 2
240
637~640
1~4
5~8
1~4
5~8
FIG. 39A V SIGNAL 37
FIG. 39B READ V SIGNAL 81
FIG. 39C READ H SIGNAL 82
FIG. 39D READ H SIGNAL 82
FIG. 39E FRAME MEMORY READ DATA 45
FIG. 39F READ DISPLAY SIGNAL 83

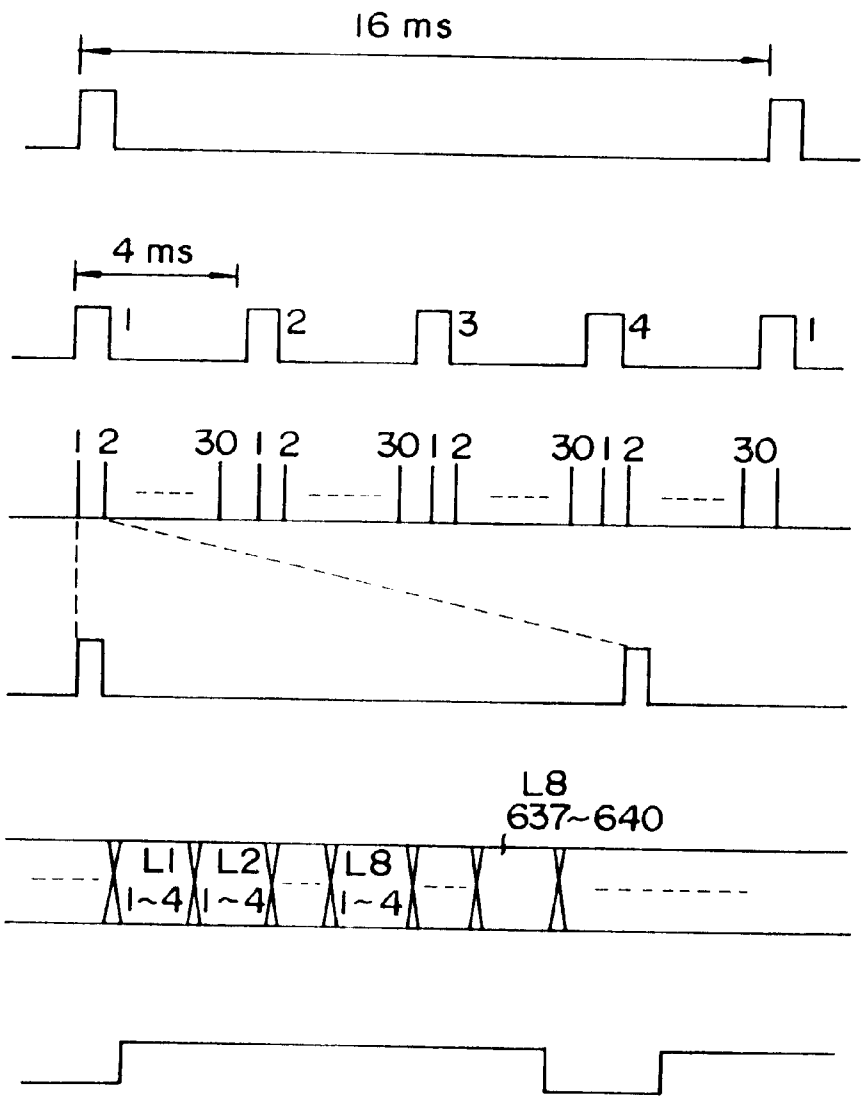
FIG. 40A V SIGNAL 37
FIG. 40B READ V SIGNAL 81
FIG. 40C READ H SIGNAL 82
FIG. 40D READ H SIGNAL 82
FIG. 40E FRAME MEMORY READ DATA 45
FIG. 40F READ DISPLAY SIGNAL 83

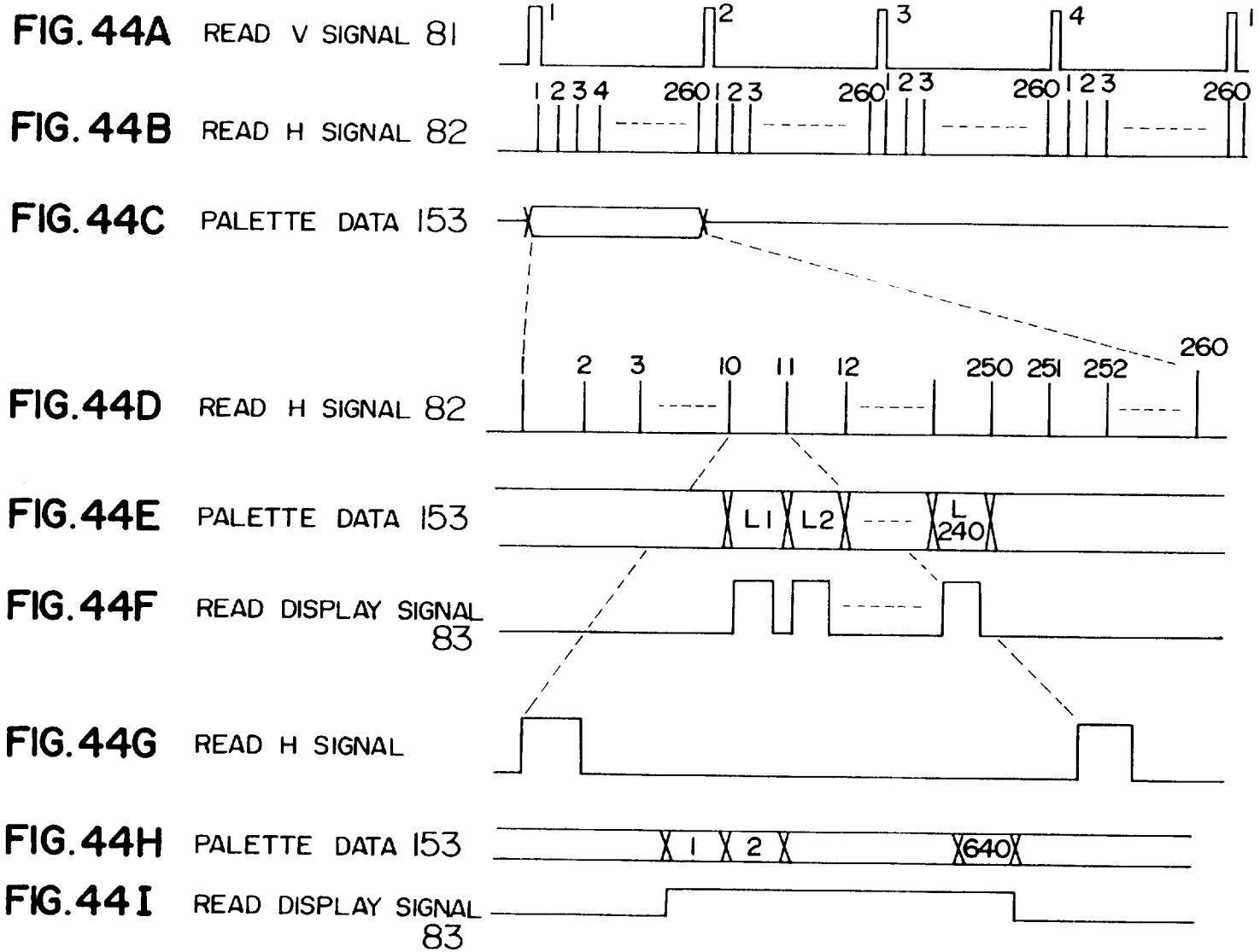
FIG. 44A READ V SIGNAL 81
FIG. 44B READ H SIGNAL 82
FIG. 44C PALETTE DATA 153
FIG. 44D READ H SIGNAL 82
FIG. 44E PALETTE DATA 153
FIG. 44F READ DISPLAY SIGNAL 83
FIG. 44G READ H SIGNAL
FIG. 44H PALETTE DATA 153
FIG. 44I READ DISPLAY SIGNAL 83
1
2
3
4
260
L1
L2
L 240
640

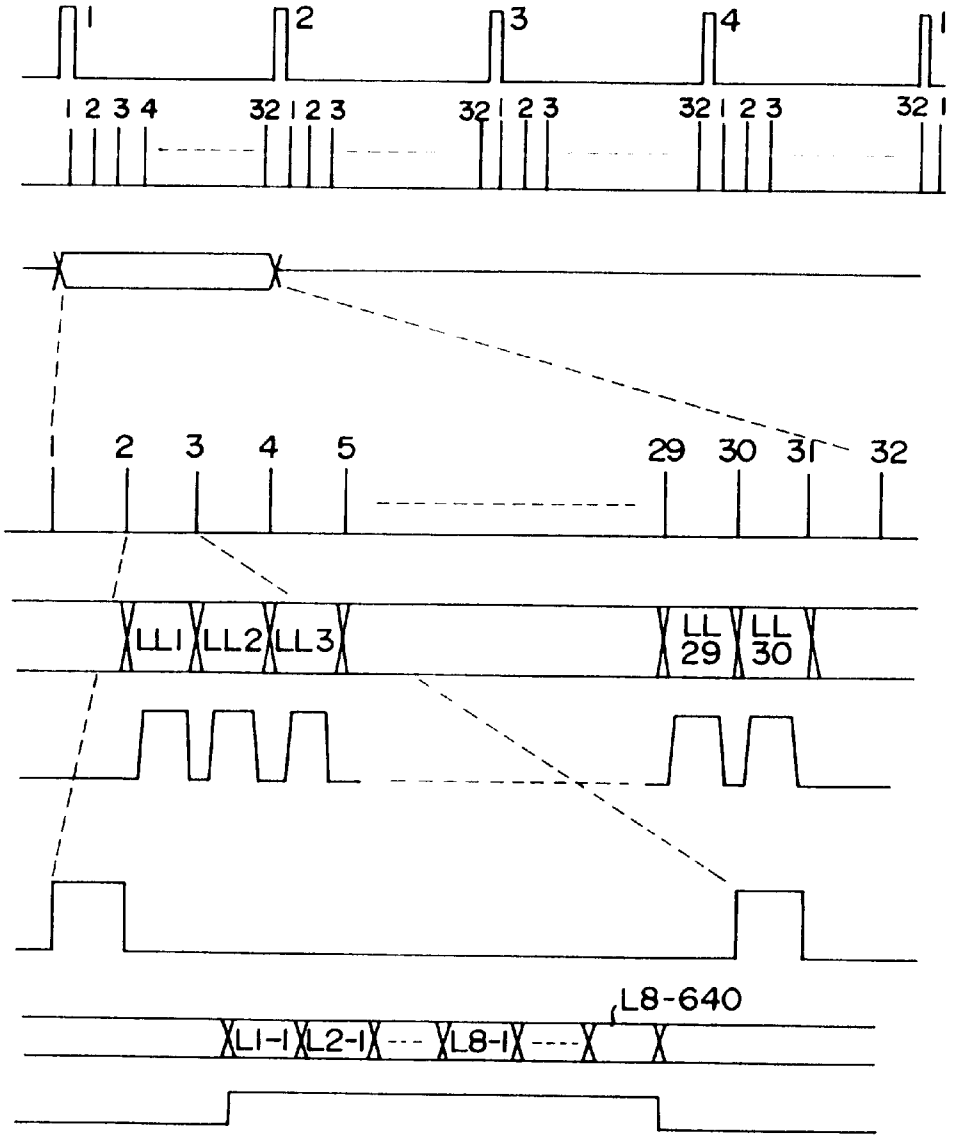
FIG. 45A READ V SIGNAL 81
FIG. 45B READ H SIGNAL 82
FIG. 45C PALETTE DATA 153
FIG. 45D READ H SIGNAL 82
FIG. 45E PALETTE DATA 153
FIG. 45F READ DISPLAY SIGNAL 83
FIG. 45G READ H SIGNAL 82
FIG. 45H PALETTE DATA 153
FIG. 45I READ DISPLAY SIGNAL 83

METHOD OF DRIVING STN LIQUID CRYSTAL PANEL AND APPARATUS THEREFOR

CROSS-REFERENCES TO RELATED APPLICATIONS

This is a division of application Ser. No. 08/340,485 filed on Nov. 14, 1994, now U.S. Pat. No. 5,638,088 which is a continuation of application Ser. No. 08/077,774 filed on Jun. 18, 1993, now abandoned.

BACKGROUND OF THE INVENTION

1. Field of the Invention

The present invention relates to a method of driving liquid crystals and a display apparatus therefor, and in particular to a driving method of displaying STN (Super Twisted Nematic) liquid crystals with high contrast and a display apparatus therefor.

2. Description of the Related Art

As a conventional driving method of liquid crystal display apparatus having a matrix structure, there is known a technique described in "Ultimate Limits for Matrix Addressing of RMS-Responding Liquid-Crystal Displays," IEEE Transactions on Electron Devices, Vol. ED-26, No. 5, May 1979 (pp. 795–802) and "Active Addressing Method for High-Contrast Video-Rate STN Displays," SID 92 DIGEST, pp. 228–231. According to this technique, each row electrode is provided with voltage depending upon an orthogonal function, whereas each column electrode is provided with voltage depending upon a function obtained as sum of products of every display information of that column and a function of the scanning side. The driving method will hereafter be described in detail by referring to FIGS. 1 to 4.

FIG. 1 shows the structure of a liquid crystal display panel having a matrix structure consisting of N rows by M columns. An intersection of a row electrode and a column electrode forms a dot D(i,j). A voltage represented by a function f(i) (i=1, 2, . . . N) is supplied to each of N row electrodes. A voltage represented by a function g(i) (i=1, 2, . . . M) is supplied to each of M column electrodes. U(i,j) denotes voltage supplied to the dot D(i,j). The voltage U(i,j) is a difference between values of the voltage functions f(i) and g(i). In the ensuing description, voltage is normalized. FIG. 2 is a diagram showing an example of orthogonal function voltage supplied to row electrodes to drive STN liquid crystal displays. This example is generally used at the present time. Assuming now that the function f(i) is represented by FIG. 2, the functions f(i) and g(i) can be represented by equations (1) and (2), respectively.

$$f(i)=FP\cdot\delta(i,t) \tag{1}$$

$$g(j)=\frac{1}{\sqrt{N}}\sum_{i=1}^{N}P(i,j)f(i) \tag{2}$$

In the equations (1) and (2), δ(i,t) is 1 for i=t and 0 for i≠j. FP is a constant given by the following equation (3).

$$FP=\sqrt{\frac{N\sqrt{N}}{2(\sqrt{N}-1)}} \tag{3}$$

P(i,j) denotes display information of the dot D(i,j). P(i,j) is −1 for display-on state and 1 for display-off state. By using equations (1), (2) and (3), the effective voltage $U_{rms}(i,j)$ applied to the dot D(i,j) at this time can be represented by the following equation (4).

$$\begin{aligned}U_{\mathrm{rms}}(i,j)&=[(f(i)-g(i)^2]^{1/2}\\&=\left[\frac{1}{T}\int_0^T f(i)^2dt+\frac{1}{T}\int_0^T g(j)^2-\frac{1}{T}\int_0^T f(i)g(j)dt\right]^{1/2}\end{aligned} \tag{4}$$

Letting T=N and rewriting (4) gives $$\frac{1}{T}\int_0^T f(i)^2\,dt=\frac{1}{N}\sum_{t=1}^{N}(FP\cdot\delta(i,t))^2=\frac{\sqrt{N}}{2(\sqrt{N}-1)} \tag{5}$$

$$\begin{aligned}\frac{1}{T}\int_0^T g(i)^2&=\frac{1}{N}\sum_{t=1}^{N}\left(\frac{1}{\sqrt{N}}\sum_{i=1}^{N}P(i,j)f(i)\right)^2\\&=\frac{1}{N}\sum_{t=1}^{N}\left[\frac{1}{\sqrt{N}}\sum_{i=1}^{N}P(i,j)\sqrt{\frac{N\sqrt{N}}{2(\sqrt{N}-1)}}\cdot\delta(i,t)\right]^2\\&=\frac{1}{N}\cdot\frac{1}{N}\cdot\frac{N\sqrt{N}}{2(\sqrt{N}-1)}\sum_{t=1}^{N}\left[\sum_{i=1}^{N}P(i,j)\delta(i,t)\right]^2\\&=\frac{1}{N}\frac{\sqrt{N}}{2(\sqrt{N}-1)}\cdot N=\frac{\sqrt{N}}{2(\sqrt{N}-1)}\end{aligned} \tag{6}$$

$$\begin{aligned}\frac{2}{T}\int_0^T f(i)g(i)dt&=\frac{2}{N}\sum_{t=1}^{N}f(i)\sum_{i=1}^{N}\frac{1}{\sqrt{N}}P(i,j)f(i)\\&=\frac{2}{N}\sum_{t=1}^{N}\sqrt{\frac{N\sqrt{N}}{2(\sqrt{N}-1)}}\cdot\\&\qquad\delta(i,t)\sum_{i=1}^{N}\frac{1}{\sqrt{N}}P(i,j)\sqrt{\frac{N\sqrt{N}}{2(\sqrt{N}-1)}}\cdot\delta(i,t)\\&=\frac{2}{N\sqrt{N}}\cdot\frac{N\sqrt{N}}{2(\sqrt{N}-1)}\cdot\sum_{t=1}^{N}\delta(i,t)\sum_{i=1}^{N}P(i,j)\delta(i,t)\\&=\frac{2}{2(\sqrt{N}-1)}\cdot P(i,j)\end{aligned} \tag{7}$$

From equations (5), (6) and (7), therefore, the effective voltage $U_{rms}(i,j)$ can be written as $$\begin{aligned}U_{\mathrm{rms}}(i,j)&=\left[\frac{\sqrt{N}}{2(\sqrt{N}-1)}+\frac{\sqrt{N}}{2(\sqrt{N}-1)}-\frac{2}{2(\sqrt{N}-1)}P(i,j)\right]^{1/2}\\&=\left[\frac{2\sqrt{N}}{2(\sqrt{N}-1)}-\frac{2P(i,j)}{2(\sqrt{N}-1)}\right]^{1/2}\end{aligned} \tag{8}$$

Assuming that the dot D(i,j) is in the display-on state, P(i,j)=−1 and the effective voltage $U_{rms}(i,j)$ is represented by equation (9). Assuming that the dot D(i,j) is in the display-off state, P(i,j)=1 and the effective voltage $U_{rms}(i,j)$ is represented by equation (10).

$$U_{\mathrm{rms}}(i,j)=\left[\frac{2\sqrt{N}}{2(\sqrt{N}-1)}-\frac{-2}{2(\sqrt{N}-1)}\right]^{1/2}=\left[\frac{\sqrt{N}+1}{\sqrt{N}-1}\right]^{1/2} \tag{9}$$

-continued $$U_{rms}(i,j)=\left[\frac{2\sqrt{N}}{2(\sqrt{N}-1)}-\frac{2}{2(\sqrt{N}-1)}\right]^{1/2}=1 \tag{10}$$

Voltage applied to the dot D(i,j) is (f(i)–g(j)) and has a waveform as shown in FIG. 3 on the basis of equations (1) and (2). In FIG. 3, S1, S2 and S3 are represented by the following equations.

$$S1=\begin{cases}\sqrt{\frac{N\sqrt{N}}{2(\sqrt{N}-1)}}+\sqrt{\frac{\sqrt{N}}{2(\sqrt{N}-1)}} & \text{(When } D(i,j)=\text{display on)} \quad (11)\\ \sqrt{\frac{N\sqrt{N}}{2(\sqrt{N}-1)}}-\sqrt{\frac{\sqrt{N}}{2(\sqrt{N}-1)}} & \text{(When } D(i,j)=\text{display off)} \quad (12)\end{cases}$$

$$S2=\sqrt{\frac{\sqrt{N}}{2(\sqrt{N}-1)}} \tag{13}$$

$$S3=-\sqrt{\frac{\sqrt{N}}{2(\sqrt{N}-1)}} \tag{14}$$

Assuming now that N=240, we get S1=12.1 (when D(i,j)= display on), S1=10.6 (when D(i,j)=display off), S2=0.73, and S3=–0.73. As a result, a large voltage is applied once (i=t) during one frame (i.e., a period of t=1 to N) and low voltage is applied during the remaining intervals. In fast responding STN liquid crystal displays, the display luminance lowers while this low voltage is being applied.

As a driving method avoiding this, a method described below has been proposed. FIG. 4 shows an orthogonal function called Walsh function. In the example shown in FIG. 4, the number of divisions is 8. Assuming now that a Walsh function with the number of divisions being equivalent to T is used as the function f(i) of voltage applied to row electrodes of the liquid crystal display panel of FIG. 1 and N Walsh functions are selected out of T Walsh functions (T≧N) and used as the function f(i), the effective voltage value $U_{rms}$(i,j) of the dot (i,j) is derived.

It is assumed that the functions f(i) and g(j) are represented by the following equations (15) and (16).

$$f(i)=FP\cdot W(i,t) \tag{15}$$

$$g(j)=\frac{1}{\sqrt{N}}\sum_{i=1}^{N}P(i,j)f(i) \tag{16}$$

In these equations, W(i,t) is a Walsh function and has a value of 1 or −1. FP is a constant indicated by equation (17).

$$FP=\sqrt{\frac{\sqrt{N}}{2(\sqrt{N}-1)}} \tag{17}$$

In equation (4), $$\begin{aligned}\frac{1}{T}\int_0^T f(i)^2\,dt &= \frac{1}{T}\sum_{t=1}^{T}(FP\cdot W(i,t))^2 \\ &= \frac{1}{T}\{FP^2W(i,1)^2+FP^2W(i,2)^2+\ldots+FP^2W(i,T)^2\} \\ &= \frac{1}{T}\cdot FP^2\cdot T(\pm 1)^2 = FP^2 = \frac{\sqrt{N}\cdot}{2(\sqrt{N}-1)}\end{aligned} \tag{18}$$

$$\begin{aligned}\frac{1}{T}\int_0^T g(j)^2\,dt &= \frac{1}{T}\sum_{t=1}^{T}\left(\frac{1}{\sqrt{N}}\sum_{i=1}^{N}P(i,j)\cdot\sqrt{\frac{\sqrt{N}}{2(\sqrt{N}-1)}}\,W(i,t)\right)^2 \\ &= \frac{1}{T}\cdot\frac{1}{N}\cdot\frac{\sqrt{N}}{2(\sqrt{N}-1)}\sum_{t=1}^{T}\sum_{i=1}^{N}(P(i,j)\cdot W(i,t))^2 \\ &= \frac{1}{T}\cdot\frac{1}{N}\cdot\frac{\sqrt{N}}{2(\sqrt{N}-1)}\sum_{t=1}^{T}\{P(1,j)^2W(1,t)^2+ \\ &\qquad \ldots+N,j)^2W(N,t)^2\} \\ &= \frac{1}{T}\cdot\frac{1}{N}\frac{\sqrt{N}}{2(\sqrt{N}-1)}\cdot T\cdot N=\frac{\sqrt{N}}{2(\sqrt{N}-1)}\end{aligned} \tag{19}$$

$$\begin{aligned}\frac{2}{T}\int_0^T f(i)g(j)dt &= \frac{2}{T}\sum_{t=1}^{T}FP\cdot W(i,t)\sum_{i=1}^{N}\frac{1}{\sqrt{N}}P(i,j)FP\cdot W(i,t) \\ &= \frac{2}{T}\cdot\frac{1}{\sqrt{N}}\cdot\frac{\sqrt{N}}{2(\sqrt{N}-1)}\sum_{t=1}^{T}W(i,t)\sum_{i=1}^{N}P(i,j)W(i,t) \\ &= \frac{2}{T}\cdot\frac{1}{2(\sqrt{N}-1)}\sum_{t=1}^{N}P(i,j)W(i,t)^2 \\ &= \frac{2P(i,j)}{2(\sqrt{N}-1)}\end{aligned} \tag{20}$$

The effective voltage $U_{rms}$(i,j) of the dot D(i,j) becomes $$\begin{aligned}U_{rms}(i,j) &= \left[\frac{\sqrt{N}}{2(\sqrt{N}-1)}+\frac{\sqrt{N}}{2(\sqrt{N}-1)}-\frac{2P(i,j)}{2(\sqrt{N}-1)}\right]^{1/2} \\ &= \left[\frac{2\sqrt{N}}{2(\sqrt{N}-1)}-\frac{2P(i,j)}{2(\sqrt{N}-1)}\right]^{1/2}\end{aligned} \tag{21}$$

As evident from the results heretofore described, the effective voltage $U_{rms}$(i,j) obtained when the Walsh function is used becomes identical with equation (8). $U_{rms}$(i,j) has a value of equation (9) for display-on state, whereas $U_{rms}$(i,j) has a value of equation (10) for display-off state.

In this case, g(j) of equation (16) is rewritten as $$\begin{aligned}g(j) &= \frac{1}{\sqrt{N}}\sum_{i=j}^{N}P(i,j)f(i) \\ &= \frac{FP}{\sqrt{N}}(2D-N)\end{aligned} \tag{22}$$

where D is the number of coincident values of P(i,j) with respect to W(i,j) with i=1 to N in the j-th column (P(i,j) assumes a value of ±1, and W(i,j) assumes a value of ±1). At this time, the value of D has normal distribution represented by the following equation.

$$P(D) \simeq \sqrt{\frac{2}{\pi N}} \exp\left[\frac{-(2D-N)^2}{2N}\right] \tag{23}$$

As indicated by equation (23), D follows normal distribution around N/2. Therefore, equation (22) also follows normal distribution in the same way. As compared with FIG. 3, therefore, average voltage over the period of t=1 to T is applied to the dot D(i,j) as the voltage waveform (f(i)−g(j)).

D can assume a value ranging from 0 (complete noncoincidence) to N (entire coincidence). From equation (22), the peak value of g(j) becomes $$g(j)_{P-P} = \frac{F}{\sqrt{N}}(\pm N) = \pm\sqrt{N}\,F \tag{23'}$$

Furthermore, g(j) can assume a value out of N+1 levels. Regarding this liquid crystal display device as a display device for a personal computer, N=240 rows are needed. As the column voltage g(j), therefore, a liquid crystal driver generating 241 levels and generating a peak voltage of approximately 22.65 volts (in case the nonselection voltage of the liquid crystal display is 1 volt) on the basis of equation (23) is needed. Since it is difficult to realize such a liquid crystal driver, it is said that the liquid crystal driver having 64 levels (where the peak voltage is 5.95 volts) is sufficient on the basis of the property of D following the normal distribution. In this case, however, overflow, i.e., voltage exceeding 64 levels might be needed with a probability of once every 115 frames. However, it is said that overflow occurs very rarely in actual display and hence there is no problem in the above described conventional technique.

If a Walsh function is used as the voltage function supplied to the row electrodes in the above described driving method, however, the voltage function g(j) supplied to the column electrodes becomes as represented by the following equation (24) on the basis of equations (15) and (16). For determining the voltage applied to one dot at certain time t, it is necessary to calculate the sum of products of display information P(i,j) with i=1 to N and the Walsh function (i,t). Its realization is difficult, and a concrete driving circuit is not shown clearly.

$$g(j) = \frac{1}{\sqrt{N}}\sum_{i=1}^{N} P(i,j)FP\cdot W(i,t) = \frac{FP}{\sqrt{N}}\sum_{i=1}^{N} P(i,j)W(i,t) \tag{24}$$

Assuming that the voltage function supplied to the row electrodes is the function shown in FIG. 2, the voltage function g(j) applied to the column electrodes is represented by the following equation (25).

$$g(j) = \frac{1}{\sqrt{N}}\sum_{i=1}^{N} P(i,j)PF\cdot\delta(i,t) = \frac{FP}{\sqrt{N}}\sum_{i=1}^{N} P(i,j)\delta(i,t) \tag{25}$$

-continued $$= \frac{FP}{\sqrt{N}}P(t,j)$$

The product summation thus becomes unnecessary and the circuit configuration becomes simple. In this case, however, the voltage waveform applied to the dot D(i,j) assumes high voltage during only one interval in N intervals, and assumes low voltage during remaining N−1 intervals. In case of fast responding STN liquid crystal displays, therefore, the contrast drops.

Furthermore, in the conventional technique, a liquid crystal driver generating the column voltage is requested to have N+1 levels and the peak voltage expressed by equation (23). However, it is said that a liquid crystal driver having 64 levels and approximately 5.95 volts suffices for the personal computer display of N=240, considering the property of the value assumed by D. Therefore, overflow occurs with a probability of once every 115 frames. In this case, it is considered that overflow occurs with a probability defined by the normal distribution following the above described theory when the contents of display change momentarily as in moving picture display. In displays used for information processing devices such as personal computers or work statios, however, contents of displays are not moving pictures but still pictures in many cases. If overflow occurs once in a still picture, therefore, overflow occurs in every frame and D loses its property following the normal distribution. Therefore, the effective value of the pertinent column electrode voltage decreases and the quality of display is degraded.

SUMMARY OF THE INVENTION

An object of the present invention is to provide a circuit, which has a simple circuit configuration and which does not degrade contrast for fast responding STN liquid crystal displays either.

Another object of the present invention is to provide a new liquid crystal driving method which can also be applied to displays of still pictures in personal computers or the like using fast responding STN liquid crystal displays.

In order to achieve the above described objects, a display apparatus includes a row function generation circuit, a function generation circuit, a line memory for storing display data of X rows, a computation circuit for performing computation on the output of the function generation circuit, and a voltage conversion circuit for converting the output of the computation circuit to voltage.

The row function generation circuit generates a function so that only x rows out of N rows may become the Walsh function at certain time t and remaining rows may become 0. The row function generation circuit supplies the function thus generated to a row electrode driver of the liquid crystal display. The function generation circuit generates values identical with values of the above described Walsh function of X rows. The outputs are subjected to computation together with the output of the line memory. The result of computation is converted into voltage, which is supplied to the column electrode driver.

BRIEF DESCRIPTION OF THE DRAWINGS

FIG. 9 is a diagram showing values of X-row function data 13 of a function generation circuit 12 in respective t values;

FIGS. 10A and 10B are diagrams showing the timing relation between X-row display data 10 and X-row function data 13;

FIG. 11 is a block diagram of an embodiment of a computation circuit 11;

FIG. 12 is a diagram showing the operation of a decoder circuit 33;

FIG. 13 is a diagram showing values of function data 23 outputted by a row function generation circuit 22 in respective t values;

FIGS. 19A to 19F are diagrams showing timing of frame memory read data 45 read out from a frame memory 44 and a data control bus 43;

FIGS. 21A to 21E are timing diagrams illustrating the operation of the frame memory 44;

FIGS. 23A to 23D are diagrams illustrating the writing operation of a line memory-A 92;

FIG. 24 is a block diagram of the line memory-A 92 depicted from a viewpoint of the writing operation;

FIGS. 25A to 25E are diagrams illustrating the writing operation of the line memory-A 92;

FIGS. 31A to 31C are timing diagrams illustrating the operation of a line block counter 123;

FIGS. 36A to 36F are timing diagrams illustrating the operation of a data converter 140;

FIGS. 38A to 38F are timing diagrams of an example of an interface signal 142;

FIGS. 39A to 39F are timing diagrams showing the interface signal 142 in case a frame memory controller and a frame memory are provided in a display controller 141 of the system apparatus;

FIGS. 40A to 40F are timing diagrams showing another example of the interface signal 142 in case a frame memory controller and a frame memory are provided in a display controller 141 of the system apparatus;

FIGS. 44A to 44I are timing diagrams illustrating palette data 150;

FIGS. 45A to 45I are timing diagrams illustrating readout from a display memory 149 of a display controller 141 using the interface signal shown in FIGS. 40A to 40F;

DESCRIPTION OF THE PREFERRED EMBODIMENTS

By referring to attached drawings, a display apparatus of the present invention will hereafter be described in detail.

Figure 5:
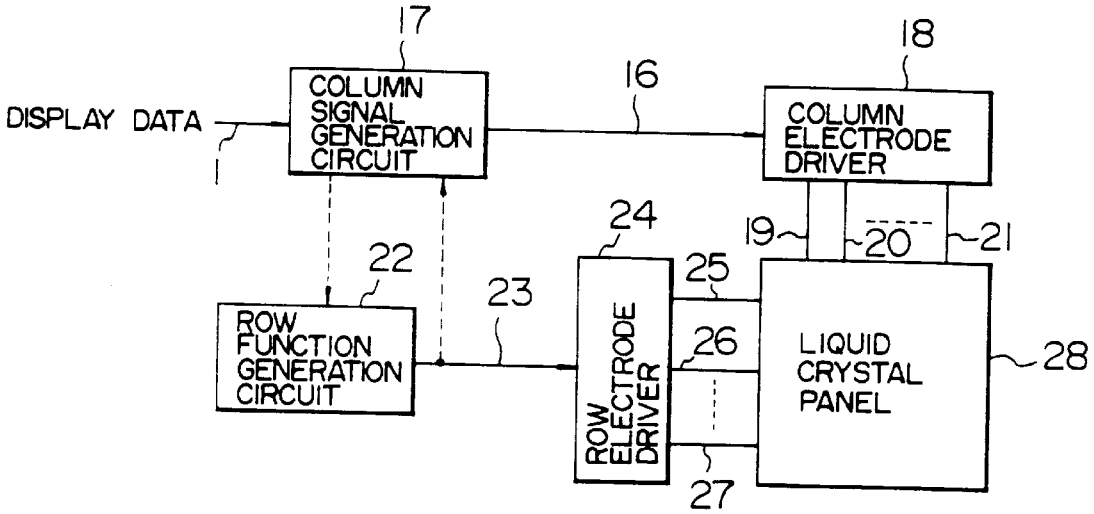
FIG. 5 is a block diagram of a first embodiment of a liquid crystal display apparatus according to the present invention.

FIG. 5 shows a liquid crystal display apparatus. A circuit 17 generates column display data from display data 1. A column electrode driver 18 takes in analog display data for one row, and thereafter outputs data for one row at a time. Taking in data for one row is performed in one division interval. Numerals 19 to 21 denote column electrodes. Numerals 19, 20 and 21 denote a first column electrode, a second column electrode, and an Mth column electrode, respectively. A circuit 22 generates a row function. The circuit 22 writes row function data 23 of rows associated with one division interval into a row electrode driver 24. After writing has been completed, the row electrode driver 24 outputs voltage depending upon data to row electrodes. Writing this row function data 23 is also conducted in one division interval, and it is in synchronism with the period equivalent to one division interval of operation of writing analog display data 16 into the column electrode driver 18. Numerals 25 to 27 denote row electrodes. Numeral 25, 26 and 27 denote a first row electrode, a second row electrode, and an Nth electrode, respectively. Numeral 28 denotes an STN liquid crystal panel for making a display of N rows by M columns. The active matrix driving technique is disclosed in U.S. patent application Ser. No. 08/003,448 filed on Jan. 12, 1993, contents of which are hereby incorporated by reference.

Figure 6:
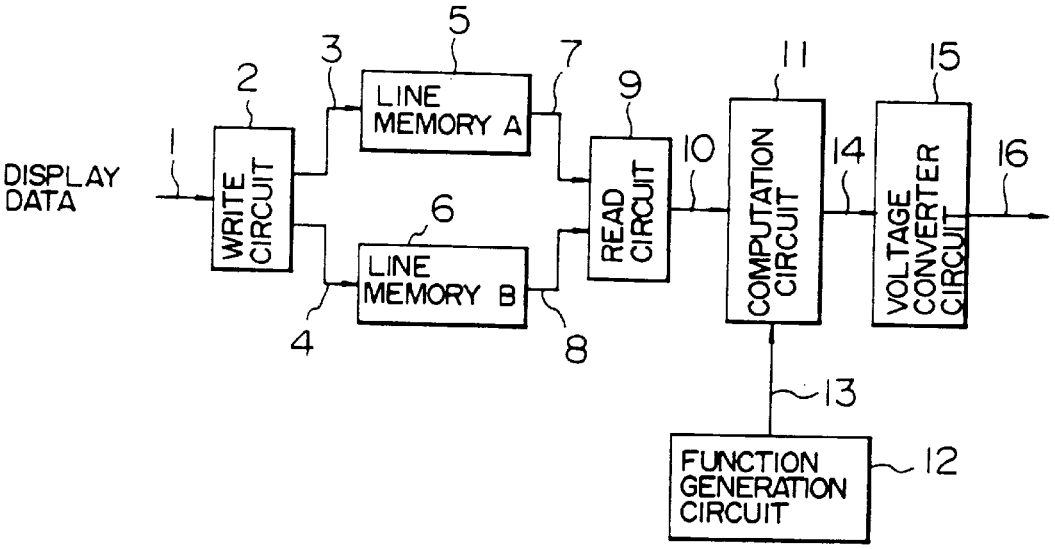
FIG. 6 is a block diagram of a column signal generation circuit.

FIG. 6 is a block diagram of an embodiment of a column signal generation circuit 17 implementing a partial orthogonal function driving method of the present invention. Display data 1 represents the display-on state as "1" and represents the display-off state as "0". Each of numerals 5 and 6 denotes a line memory for storing data corresponding to X rows. A write circuit 2 writes data A and data B into a line memory-A 5 and a line memory-B 6 via lines 3 and 4, respectively. At this time, the write circuit 2 writes data alternately into the memory-A 5 and memory-B 6 every X rows. A read circuit 9 reads out data A and B via lines 7 and 8 from either of the line memories A5 and B6 which is not being subjected to writing operation. In this reading operation, data for X rows are read out simultaneously. Display data for X rows read out from one line memory by the read circuit 9 are supplied to a computation circuit 11 via a line 10. The computation circuit 11 computes the sum of products of the X-row display data 10 and X-row function data 13 supplied from a function generation circuit 12. The computation circuit 11 supplies computation data 14 obtained as a result of computation to a voltage converter circuit 15, which in turn converts the computation data 14 into analog voltage. A technique for using line memories for the purpose of multi-level tone display is described in U.S. patent application Ser. No. 08/015,896, contents of which are hereby incorporated by reference. Furthermore, a technique of driving a bi-sected display panel by using line memories is disclosed in U.S. Pat. No. 4,985,698, contents of which are hereby incorporated by reference.

Figures 7, 8:
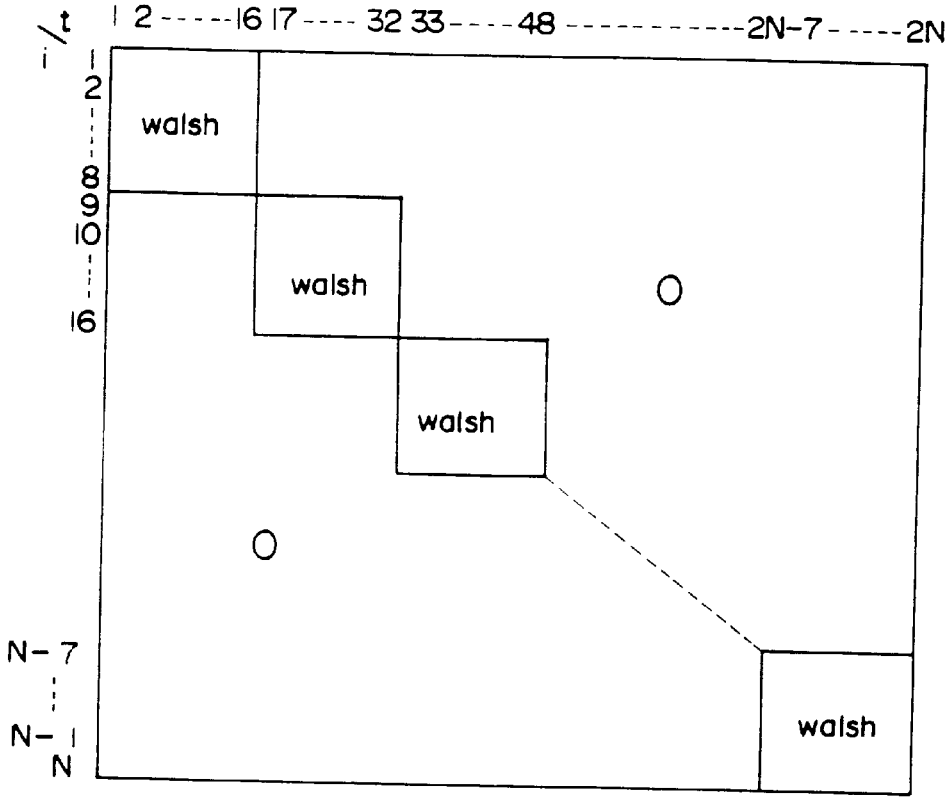
FIG. 7 is a diagram showing an example of distribution of Walsh function, which is used when the Walsh function is applied to only 8 rows among N row electrodes, one frame period T is 2N (where N is the number of display rows), and the Walsh function of 8 rows is driven with the number of divisions equivalent to 16.
FIG. 8 is a diagram representing dot information of a liquid crystal display panel 28 when the liquid crystal display panel is formed by 4 rows by 4 columns in the present embodiment.
Figures 14A, 14B, 14C, 14D:
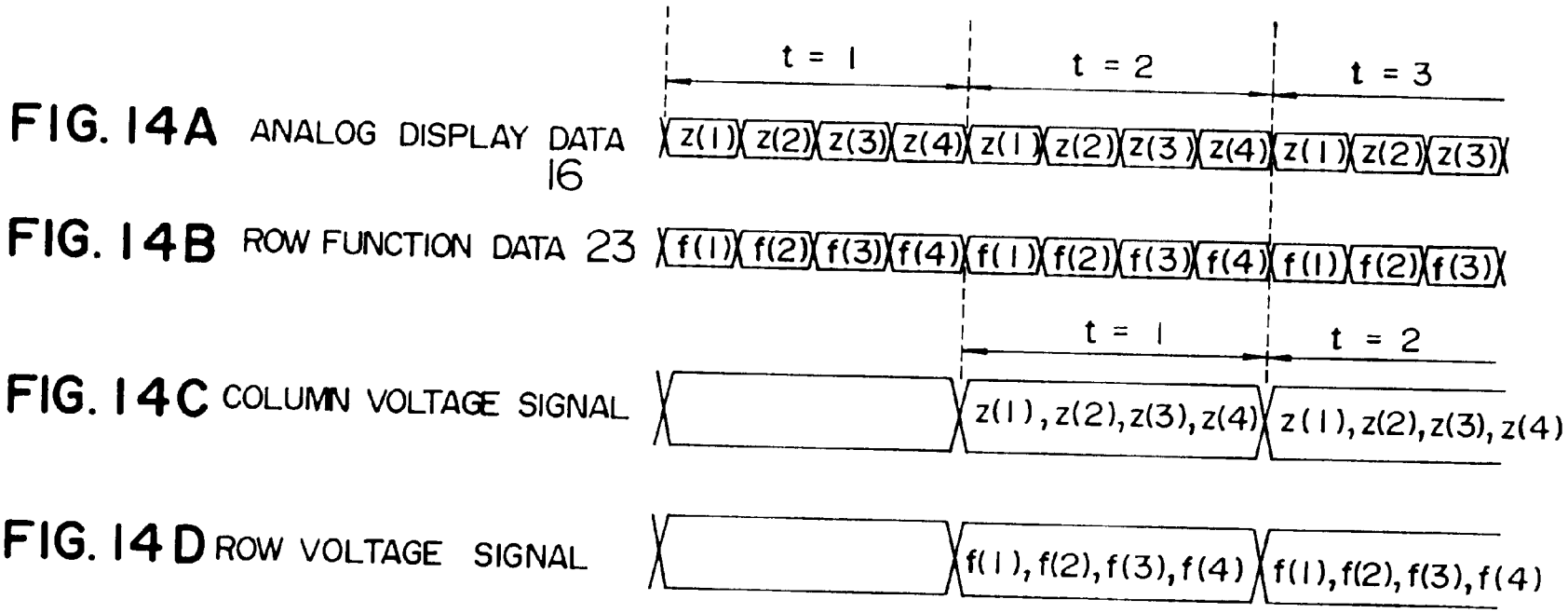
FIGS. 14A to 14D are timing diagrams for illustrating the operation of a column electrode driver 18 and a row electrode driver.

Prior to description of the operation of the liquid crystal display apparatus shown in FIG. 5, voltage waveform applied to the panel 28 will now be described. FIG. 7 is a diagram showing a partial orthogonal function driving method, which is used when the voltage function applied to N row electrodes is determined to be the Walsh function for only 8 rows, one frame period T is 2N, and the Walsh function of the 8 rows are driven with the number of divisions equivalent to 16. In the same way as the above described example of the conventional technique, the liquid crystal display panel makes a display of N rows by M columns. In this case, a voltage function applied to the row electrodes and a voltage function applied to the column electrodes are represented by the following equations (26) and (27), respectively. In the following description, however, the voltage function is normalized by the applied voltage.

$$f(i)=FP\cdot W(i,t) \tag{26}$$

$$g(j)=\frac{1}{\sqrt{N}}\sum_{i=1}^{N}P(i,j)f(t) \tag{27}$$

Figure 1:
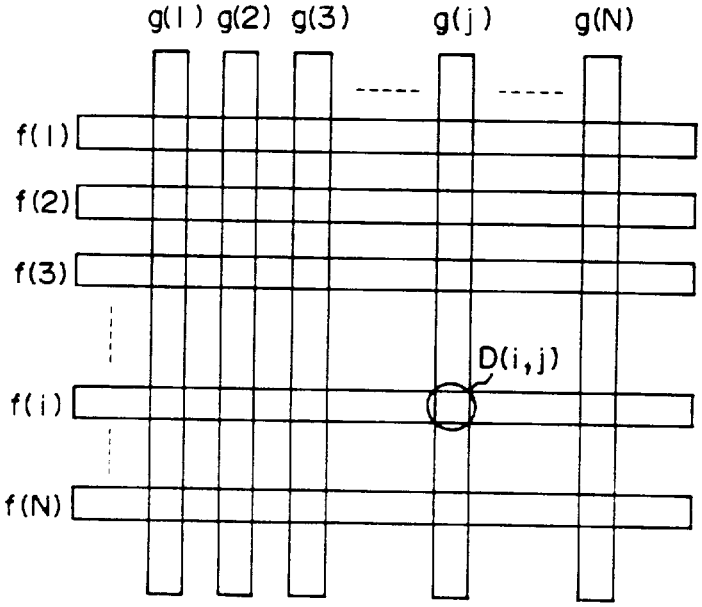
FIG. 1 is a diagram showing a liquid crystal display panel having an N-column M-row matrix structure.
Figure 2:
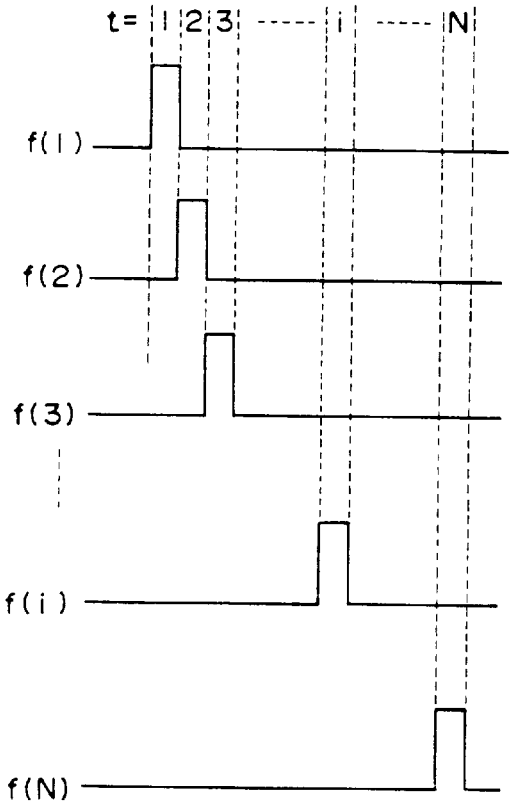
FIG. 2 is a diagram showing an example of orthogonal function voltage applied to row electrodes, which is generally used as driving waveforms of STN liquid crystal displays at the present time.
Figure 3:
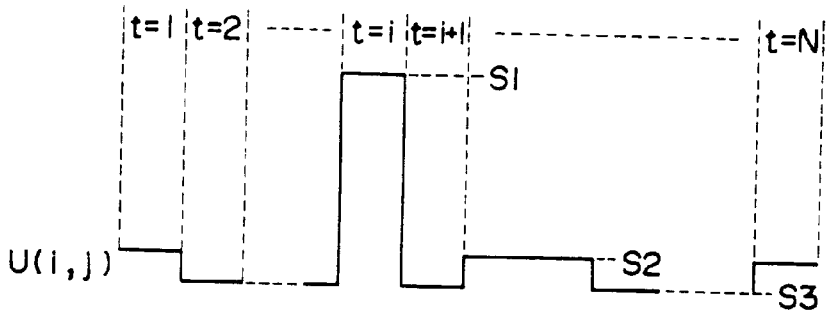
FIG. 3 is a diagram showing a liquid crystal display driving voltage waveform applied to a dot D(i,j)
Figure 4:
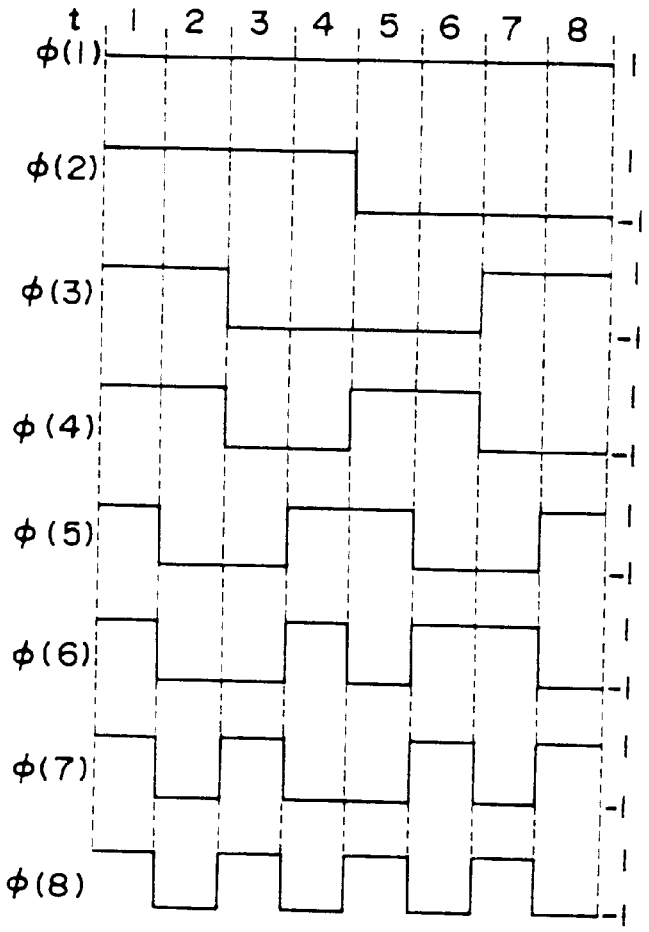
FIG. 4 is a diagram showing an example of an orthogonal function called Walsh function, having a value of 8 as the number of divisions.

In these equations, FP is a constant indicated by the following equation (28) and W(i,t) is a function shown in FIG. 4.

$$FP=\sqrt{\frac{N}{8}\cdot\frac{\sqrt{N}}{2(\sqrt{N}-1)}} \tag{28}$$

In the same way as the above described example of the conventional technique, P(i,j) becomes "−1" when dot D(i,j) of the ith row in the jth column is in the display-on state whereas P(i,j) becomes "1" when the dot D(i,j) is in the display-off state. By using equations (26) and (27), effective voltage value $U_{rms}$(i,j) of dot D(i,j) is calculated as indicated by the following equation.

$$\begin{aligned}U_{\mathrm{rms}}(i,j)&=[(f(i)-g(i))^2]^{1/2}\\&=\left[\frac{1}{T}\int_0^T f(i)^2dt+\frac{1}{T}\int_0^T g(j)^2dt-\frac{2}{T}\int_0^T f(i)g(j)dt\right]^{1/2}\end{aligned} \tag{29}$$

Letting T=2N, gives respective terms.

$$\begin{aligned}\frac{1}{T}\int_0^T f(i)^2dt&=\frac{1}{2N}\sum_{t=1}^{2N}\frac{N}{8}\cdot\frac{\sqrt{N}}{2(\sqrt{N}-1)}\cdot W(i,t)^2\\&=\frac{1}{16}\cdot\frac{\sqrt{N}}{2(\sqrt{N}-1)}\sum_{t=1}^{2N}W(i,t)^2\\&=\frac{1}{16}\cdot\frac{\sqrt{N}}{2(\sqrt{N}-1)}(W(i,1)^2+W(i,2)^2+\ldots+W(i,2N)^2)\end{aligned}$$

As for W(i,j) of the ith row shown in FIG. 7, only 16 W(i,j)s are the Walsh function each having a value of "±1", and remaining W(i,j)s are "0". Therefore, $$\text{The first term}=\frac{1}{16}\cdot\frac{\sqrt{N}}{2(\sqrt{N}-1)}\cdot 16=\frac{\sqrt{N}}{2(\sqrt{N}-1)}$$

$$\begin{aligned}\frac{1}{T}\int_0^T g(j)^2dt&=\frac{1}{2N}\sum_{t=1}^{2N}\frac{1}{N}\left(\sum_{i=1}^{N}P(i,j)\cdot\sqrt{\frac{N}{8}\frac{\sqrt{N}}{2(\sqrt{N}-1)}}\cdot B(i,t)\right)^2\\&=\frac{1}{2N}\cdot\frac{1}{8}\cdot\frac{\sqrt{N}}{2(\sqrt{N}-1)}\sum_{t=1}^{2N}\left(\sum_{i=i}^{N}P(i,j)W(i,t)\right)^2\\&=\frac{1}{2N}\cdot\frac{1}{8}\cdot\frac{\sqrt{N}}{2(\sqrt{N}-1)}\sum_{t=1}^{2N}(P(1,j)^2W(1,t)^2+\\&\qquad(P(2,j)^2W(2,t)^2+\ldots+P(N,j)^2W(N,t)^2)\end{aligned}$$

As for W(i,j) shown in FIG. 7 at certain time t, the Walsh function having a value of "±1" is applied to only 8 rows, and remaining rows are provided with "0". Therefore, $$\text{The second term} = \frac{1}{2N}\cdot\frac{1}{8}\frac{\sqrt{N}}{2(\sqrt{N}-1)}\sum_{t=1}^{2N} = \frac{1}{2N}\frac{1}{8}\cdot\frac{\sqrt{N}}{2(\sqrt{N}-1)}\cdot 8\cdot 2N = \frac{\sqrt{N}}{2(\sqrt{N}-1)} \tag{31}$$

$$\begin{aligned}\frac{2}{T}\int_0^T f(i)g(j)dt &= \frac{2}{2N}\sum_{t=1}^{2N} FP\cdot W(i,t)\frac{1}{N}\sum_{i=1}^{N} P(i,j)FP\cdot W(i,t)\\ &= \frac{2}{2N}\cdot\frac{1}{\sqrt{N}}\cdot\frac{N}{8}\cdot\frac{\sqrt{N}}{2(\sqrt{N}-1)}\sum_{t=1}^{2N} W(i,t)\sum_{i=1}^{N} P(i,j)W(i,t)\\ &= \frac{1}{8}\cdot\frac{1}{2(\sqrt{N}-1)}\sum_{t=1}^{2N} W(i,t)\{P(1,j)W(1,t)+\\ &\qquad P(2,j)W(2,t)+\ldots P(N,j)W(N,t)\}\\ &= \frac{1}{8}\cdot\frac{1}{2(\sqrt{N}-1)}\sum_{t=1}^{2N} P(i,j)W(i,t)^2\end{aligned}$$

As W(i,t) of the ith row shown in FIG. 7, the Walsh function having a value of "±1" is applied to only 16 W(i,t)s, and remaining W(i,t)s are provided with "0". Therefore, $$\text{The thrid term} = \frac{1}{8}\cdot\frac{1}{2(\sqrt{N}-1)}\cdot 16P(i,j) = \frac{2P(i,j)}{2(\sqrt{N}-1)} \tag{32}$$

From the above equations, we get $$\begin{aligned}U_{\text{rms}}(i,j) &= \left[\frac{\sqrt{N}}{2(\sqrt{N}-1)}+\frac{\sqrt{N}}{2(\sqrt{N}-1)}-\frac{2P(i,j)}{2(\sqrt{N}-1)}\right]^{1/2}\\ &= \left[\frac{2\sqrt{N}}{2(\sqrt{N}-1)}-\frac{2P(i,j)}{2(\sqrt{N}-1)}\right]^{1/2}\end{aligned} \tag{33}$$

When D(i,j) is in the display-on state, therefore, P(i,j) becomes "−1" and hence the effective voltage value is represented by the following equation (34). When D(i,j) is in the display-off state, P(i,j) becomes "1" and hence the effective voltage value is represented by the following equation (35).

$$\begin{aligned}U_{\text{rms}}(i,j) &= \left[\frac{2\sqrt{N}}{2(\sqrt{N}-1)}-\frac{-2}{2(\sqrt{N}-1)}\right]^{1/2}\\ &= \sqrt{\frac{\sqrt{N}+1}{\sqrt{N}-1}}\end{aligned} \tag{34}$$

$$\begin{aligned}U_{\text{rms}}(i,j) &= \left[\frac{2\sqrt{N}}{2(\sqrt{N}-1)}-\frac{2}{2(\sqrt{N}-1)}\right]^{1/2}\\ &= 1\end{aligned} \tag{35}$$

By comparing equations (34) and (35) with equations (9) and (10), it would be understood that the effective voltage values Urms in the display-on state and in the display-off state do not change from those of the above described example of the conventional technique even if the voltage function as shown in FIG. 7 is applied to row electrodes. In this way, the orthogonality does not change even if the Walsh function is used for only 8 lines and respective portions are moved on the basis of the number of divisions.

In the foregoing description, the Walsh function is used for 8 lines among N lines and the Walsh function of the 8 lines is driven with "16" divisions. However, the present invention is not limited to this. In general, it is also possible to use the Walsh function for R rows among N rows and drive the Walsh function with K divisions. It is assumed at this time that relations R<N and K≧R are satisfied.

Equations (36) and (37) express f(i) and g(j) of the generalized case, respectively. FP in this case is indicated by equation (38).

$$f(i)=FP\cdot W(i,t) \tag{36}$$

$$g(j) = \frac{1}{N}\sum_{i=1}^{N} P(i,j)f(i) \tag{37}$$

$$FP = \sqrt{\frac{N}{R}\cdot\frac{\sqrt{N}}{2(\sqrt{N}-1)}} \tag{38}$$

The effective voltage value $U_{rms}$(i,j) of dot D(i,j) at this time is calculated by the following equation.

$$T = \frac{N}{R}\cdot K,$$

$$\begin{aligned}U_{\text{rms}}(i,j) &= [f(i)-g(j)^2]^{1/2}\\ &= \left[\frac{1}{T}\int_0^T f(i)^2dt+\frac{1}{T}\int_0^T g(j)^2dt-\frac{2}{T}\int_0^T f(i)g(j)dt\right]^{1/2}\end{aligned} \tag{39}$$

$$\text{The first term} = \frac{1}{T}\int_0^T f(i)^2dt+\frac{1}{T}\sum_{t=1}^{T}\frac{N}{R}\cdot\frac{\sqrt{N}}{2(\sqrt{N}-1)}\cdot W(i,t)^2$$

As for W(i,t) of the ith row, the Walsh function is applied to only KW(i,t)s and remaining W(i,t)s are provided with "0". Therefore, $$\text{The first term} = \frac{1}{T}\cdot\frac{N}{R}\cdot\frac{\sqrt{N}}{2(\sqrt{N}-1)}\cdot K = \frac{1}{T}\cdot T\frac{\sqrt{N}}{2(\sqrt{N}-1)} = \frac{\sqrt{N}}{2(\sqrt{N}-1)} \tag{40}$$

$$\begin{aligned}\frac{1}{T}\int_0^T g(j)^2dt &= \frac{1}{T}\sum_{t=1}^{T}\left(\frac{1}{\sqrt{N}}\sum_{i=1}^{N} P(i,j)\cdot FP\cdot W(i,t)\right)^2\\ &= \frac{1}{T}\cdot\frac{1}{R}\frac{\sqrt{N}}{2(\sqrt{N}-1)}\cdot\sum_{t=1}^{T}\left(\sum_{i=1}^{N} P(i,j)W(i,t)\right)^2\\ &= \frac{1}{T}\cdot\frac{1}{R}\frac{\sqrt{N}}{2(\sqrt{N}-1)}\sum_{t=1}^{T}(P(1,j)^2W(1,t)^2+\\ &\qquad P(2,j)^2W(2,t)^2\ldots+P(N,j)^2W(N,t)^2)\end{aligned}$$

As for W(i,j) at certain time t, the Walsh function having a value of "±1" is applied to only R W(i,j)s, and remaining W(i,j)s are provided with "0". Therefore, $$\text{The second term} = \frac{1}{T}\cdot\frac{1}{R}\cdot\frac{\sqrt{N}}{2(\sqrt{N}-1)}\sum_{t=1}^{T} Rt = \frac{\sqrt{N}}{2(\sqrt{N}-1)} \tag{41}$$

$$\begin{aligned}\frac{2}{T}\int_0^T f(i)g(j)dt &= \frac{2}{T}\sum_{t=1}^{T} FP\cdot W(i,t)\cdot\frac{1}{\sqrt{N}}\sum_{i=1}^{N} P(i,j)FP\cdot W(i,t)\\ &= \frac{2}{T}\frac{1}{\sqrt{N}}\cdot\frac{N}{R}\cdot\frac{\sqrt{N}}{2(\sqrt{N}-1)}\sum_{t=1}^{T} B(i,t)\sum_{i=1}^{N} P(i,j)W(i,t)\\ &= \frac{2}{T}\cdot\frac{1}{\sqrt{N}}\cdot\frac{N}{R}\cdot\frac{\sqrt{N}}{2(\sqrt{N}-1)}\sum_{t=1}^{T} P(i,j)W(i,t)^2\end{aligned}$$

As for W(i,t) of the ith row, the Walsh function is applied to only KW(i,t)s and remaining W(i,t)s are provided with "0". Therefore, $$\begin{aligned}\text{The third term} &= \frac{2}{T}\cdot\frac{1}{\sqrt{N}}\cdot\frac{N}{R}\cdot\frac{\sqrt{N}}{2(\sqrt{N}-1)}\cdot P(i,j)K\\ &= \frac{2P(i,j)}{2(\sqrt{N}-1)}\end{aligned} \tag{42}$$

From these equations, we get $$U_{\text{rms}}(i,j) = \left[\frac{2\sqrt{N}}{2(\sqrt{N}-1)} - \frac{2P(i,j)}{2(\sqrt{N}-1)}\right]^{1/2} \tag{43}$$

This coincides with equation (33). Even under supposition as described above, the effective voltage value $U_{rms}$(i,j) at the dot D(i,j) becomes in general identical with the example of the conventional technique provided that the following equation (44) is satisfied.

$$T = \frac{N}{R}K \tag{44}$$

In the present embodiment, description has been given by using the Walsh function. However, the present embodiment is not limited to this, but an orthogonal function having values "1" and "−1" may be used as evident from the process of calculation of the effective value. This driving method is hereafter referred to as "partial orthogonal function driving method" and it will now be described.

Display data are serially transmitted in the order of dots D(1,1), D(1,2), . . . , D(2,1), D(2,2), . . . , D(4,1), D(4,2), . . . , D(4,4) of the liquid crystal panel 28 shown in FIG. 8. The display data are written alternately every two rows into the line memory-A 5 and line memory-B6 by the write circuit 2. That is to say, data of the first and second rows are written into the line memory-A 5, and data of the third and fourth rows are written into the line memory-B 6. When data of the third and fourth rows are being written into the line memory-B 6 after data of the first and second rows have been written, the read circuit 9 reads out display data from the line memory-A 5. At this time, display data A in the row direction are simultaneously read out. For example, D(1,1) and D(2,1) are read out simultaneously, and D(1,2) and D(2,2) are read out simultaneously. Data thus read out are outputted to the computation circuit 11 as the X-row display data 10. In accordance with time t, the function generation circuit 12 generates X-row function data h(1) and h(2) shown in FIG. 9. As for time t, a cycle of t=1 to 4 is repeated because two rows are driven with four divisions. The function data h(1) and h(2) are 1-bit data and represent "−1" as "0" and "+1" as "1". Timing of the operation of the generation circuit 12 and the operation of the read circuit 9 will now be described by referring to FIGS. 10A and 10B. When the X-row function data 13 are h(1) and h(2) at t=1 as shown in FIG. 10B, the read circuit 9 reads out two-row data of the first column to the fourth column serially as shown in FIG. 10A. This is repeated up to t=4. Thereafter, the generation circuit 12 generates X-row function data 13 from t=1 again. On the other hand, the read circuit 9 reads out display data from the line memory-B 6 in the same way. Operation of the computation circuit 11 will now be described by referring to FIGS. 11 and 12. As for display data, the display-on state is represented by "1", whereas the display-off state is represented by "0". Assuming that the X-row display data are D(1,1) and D(2,1) and X-row function data are h(1) and h(2), therefore, D(1,l) and D(2,1) are inverted by inverter circuits 29 and 30 in order to conform to the expression of P(i,j) in equation (27). The inverted data are exclusive-ORed with h(1) and h(2) respectively by circuits 31 and 32. Resultant outputs are decoded by a decoder 33 in accordance with FIG. 12. This means that computation of the following equation is conducted and the sum of products expressed by equation (27) is calculated.

$$\begin{aligned}g(j) &= \frac{1}{\sqrt{N}}\sum_{i=1}^{N} P(i,j)f(i)\\ &= \frac{1}{\sqrt{N}}\cdot FP\sum_{i=1}^{N} P(i,j)W(i,t)\\ &= \frac{1}{\sqrt{N}}\cdot FP(2Y(t)-N)\end{aligned} \tag{45}$$

Y(t) is the sum of values over i=1 to N, each value being "1" when P(i,j)=W(i,t).

Therefore, the computation data 14 assumes one of values shown in FIG. 12. As evident from equations (30), (31), (32) and (33), the computation data are converted to a voltage value of the following equation by the voltage converter circuit 15 and outputted as analog display data 16.

$$\text{(Analog display data 16)} = \frac{1}{\sqrt{N}}\sqrt{\frac{N}{R}\cdot\frac{\sqrt{N}}{2(\sqrt{N}-1)}}\times\text{(computation data 14)}\times V_{off} \tag{46}$$

In the present embodiment, N=4 and R=2. $V_{off}$ is a coefficient for conducting conversion to actual driving voltage because the display-off voltage is determined to be "1" as expressed by equation (29). As heretofore described, the column signal generation circuit 17 of FIG. 6 has realized the partial orthogonal function driving described before by referring to equations (26) to (35). The analog display data 16 are successively taken in the column electrode driver 18. When one row has been taken in, the data are outputted to column electrodes simultaneously. As shown in FIG. 13, the row function generation circuit 22 successively outputs data 23 of functions f(1), f(2), f(3) and f(4). The driver 24 receives the row function data 23. After all data for one column have been received, the driver 24 outputs them as the row electrode signal. The operation timing of the drivers 18 and 24 heretofore described is shown in FIGS. 14A to 14D.

In the above described example of the conventional technique, computation of the column signal expressed by equation (27) needs calculation of N rows. In the STN liquid crystal driving method according to the present invention heretofore described, however, calculation of R rows (where R<N) suffices and the circuit can be formed more easily. One computation time unit of 240 rows by 640 columns ($t_a$ of FIG. 10A) will now be derived. It is now assumed that the frame frequency is 60 Hz, R=8, and K=16.

$$t_a = \frac{1}{60\ \text{Hz} \times 240 \times 630 \times \frac{16}{8}} \approx 54\ \text{ns}$$

That is to say, reading and executing computation on data of 8 rows (R=8) during approximately 54 ns suffices. On the other hand, $t_a$ of the conventional driving method becomes $$t_a = \frac{1}{60\ \text{Hz} \times 256 \times 640} \approx 101\ \text{ns}$$

As compared with the partial orthogonal function driving, $t_a$ itself becomes longer. In the logic circuit aspect, however, it is difficult to read and execute computation on data of 240 rows during approximately 100 ns. That is to say, data processing speed is 0.4 ns per row. Even if the speed is lowered to a value attainable by a logic circuit by using parallel driving, the number of parallel paths becomes large, resulting in an excessively large logic scale. As compared with this, the partial orthogonal function driving needs fewer rows for computation and can be realized with a smaller logic scale.

A modification of the present invention will now be described. If in general the voltage function applied to N row electrodes is the Walsh function for only m rows, the period of one frame is T, and the number of divisions of the Walsh function for the m rows is s, then voltage function $F_h$ applied to each row electrode, voltage function $G_j$ applied to each column electrode, and effective value $U_{rms}$ of voltage applied to a picture element of the ith row in the jth column are represented by the following equations.

N lines are divided into n parts each having m lines: mn=N m lines are driven with the number s of divisions: sn=T Furthermore, representing line h as h=pm+i (p=0 to n−1, i=1 to m) and time k as k=qs+t (q=0 to n−1, t=1 to s), orthogonal function $S_{hk}$ is represented by the following equation.

$$S_{hk} = S_{pm+i,qs+t} = \begin{cases} Wi & (p = q) \\ Wo & (p \neq q) \end{cases} \tag{47}$$

Therefore, row electrode voltage function $F_h(k)$ is represented as $$F_h(k) = \overline{F} S_{hk} \tag{48}$$

Assuming that display information of the ith row in the jth column is $l_{ij}$, column electrode voltage function $G_j(t)$ is represented by the following equation.

$$G_j(t) = c \sum_{i=1} l_{ij} F_i(t) \tag{49}$$

-continued $$\text{where } l_{ij} = \begin{cases} -1 & \text{display on} \\ +1 & \text{display off} \end{cases}$$

By representing equation (49) by h and k, we get $$G_j(k) = \sum_{p=0}^{n-1} \left\{ c \sum_{i=1}^{m} l_{pm+i,j} F_{pm+i}(k) \right\} \delta_{p,q} \tag{50}$$

$$\text{where } \delta_{p,q} = \begin{cases} 1 & (p = q) \\ 0 & (p \neq q) \end{cases}$$

$$\begin{aligned} U_{\text{rms}} &= \sqrt{\frac{1}{T} \int_0^T \{F_r(t) - G_j(t)\}^2 dt} \\ &= \sqrt{\frac{1}{T} \sum_{k=1}^{T} \{F_r(t) - G_j(t)\}^2} \\ &= \sqrt{\frac{1}{T} \sum_{k=1}^{T} \{F_r(k)^2 + G_j(k)^2 - 2F_r(k)G_j(k)\}} \end{aligned} \tag{51}$$

The first term of equation (51) becomes $$\frac{1}{T} \sum_{k=1}^{T} F_r(k)^2 = \frac{1}{T} \sum_{k=1}^{T} \overline{F}^2 S_{rk}^2 = \overline{F}^2 \tag{52}$$

The second term of equation (51) becomes $$\begin{aligned} \frac{1}{T} \sum_{k=1}^{T} G_j(k) &= \frac{1}{T} \sum_{k=1}^{T} \left( \left[ \sum_{p=0}^{n-1} \left\{ c \sum_{i=1}^{m} l_{pm+1,j} F_{pm+1}(k) \right\} \delta_{p,q} \right] \right)^2 \\ &= \frac{1}{T} \sum_{q=0}^{n-1} \sum_{t=1}^{s} \left( \left[ \sum_{p=0}^{n-1} \left\{ c \sum_{i=1}^{m} l_{pm+1,j} F_{pm+i}(k) \right\} \delta_{p,q} \right] \right)^2 \\ &= \frac{1}{T} \left[ \sum_{t=1}^{s} \left\{ c \sum_{i=1}^{m} l_{i,j} F_i(t) \right\}^2 + \right. \\ &\quad \sum_{t=1}^{s} \left\{ c \sum_{i=1}^{m} l_{p+i,j} F_{m+i}(t) \right\}^2 + \ldots + \\ &\quad \left. \sum_{t=1}^{s} \left\{ c \sum_{i=1}^{m} l_{(n-1)m+i,j} F_{(n-1)m+i}(t) \right\}^2 \right] \end{aligned} \tag{53}$$

where $$\begin{aligned} \sum_{t=1}^{s} \left\{ c \sum_{i=1}^{m} l_{i,j} F_i(t) \right\} 2 &= c2 \sum_{t=1}^{2} \sum_{i=1}^{m} l_{i,j}^2 F_i(t)^2 \\ &= c^2 \overline{F}^2 \sum_{t=1}^{s} \sum_{i=1}^{m} l_{i,j}^2 W_i^2 \\ &= smc^2 \overline{F}^2 \end{aligned}$$

Therefore, the second term of equation (51) can be expressed as $$\begin{aligned} \frac{1}{T} \sum_{k=1}^{T} G_j(k)^2 &= \frac{1}{T} \{smc^2 \overline{F}^2 + smc^2 \overline{F}^2 + \ldots + smc^2 \overline{F}^2 \\ &= \frac{1}{T} nsmc^2 \overline{F}^2 \\ &= mc^2 \overline{F}^2 \end{aligned} \tag{54}$$

The third term of equation (51) becomes $$\frac{1}{T}\sum_{k=1}^{T}2F_r(k)G_j(k)=\frac{2}{T}\sum_{q=0}^{n=1}\sum_{t=1}^{s}\overline{F}S_r(k)\sum_{p=0}^{n-1}\left\{c\sum_{i=1}^{m}l_{pm+i,j}FW_i(t)\right\}\delta_{p,q} \tag{55}$$

$$=\frac{2c\overline{F}^2}{T}\left[\left\{\sum_{t=1}^{s}S_r(k)\sum_{i=1}^{m}l_{i,j}W_i(t)\right\}+\left\{\sum_{t=1}^{s}S_r(k)\sum_{i=1}^{m}l_{m+i,j}W_i(t)\right\}+\ldots+\left\{\sum_{t=1}^{s}S_r(k)\sum_{i=1}^{m}l_{(n-1)m+i}W_i(t)\right\}\right]$$

where $S_r$ is indicated by r=pm+i, and $S_r$ becomes $W_0$ in portions with p=q and is orthogonal to $W_i(t)$.

Therefore, the third term of equation (51) becomes $$\frac{1}{T}\sum_{k=1}^{T}2F_r(k)G_j(k)=\frac{2c\overline{F}^2}{T}\sum_{t=1}^{s}W_i(t)\sum_{i=1}^{m}l_{pm+i,j}W_i(t)=\frac{2c\overline{F}^2}{T}l_{rj}\sum_{t=1}^{s}W_i(t)2=\frac{2sc\overline{F}^2}{T}l_{rj}=\frac{2c\overline{F}^2}{n}l_{rj} \tag{56}$$

Therefore, $$U_{\text{rms}}=\sqrt{\overline{F}^2+mc\overline{F}^2-\frac{2c\overline{F}^2}{n}l_{rj}}=\overline{F}\sqrt{1+mc^2-\frac{2c}{n}l_{rj}} \tag{57}$$

$$l_{rj}=\begin{cases}+1 & \text{display on}\\ -1 & \text{display off}\end{cases}$$

From the description given heretofore, the effective value $U_{rms}$ of voltage applied to the picture element of the ith row in the jth column is expressed by equation (57). Furthermore, since $I_{ij}$ becomes "−1" when display is on whereas $I_{ij}$ becomes "+1" when display is off, respective effective voltage values are represented by equations (58) and (59).

$$U_{\text{rms}}(\text{on})=\overline{F}\sqrt{1+mc^2+\frac{2c}{n}} \tag{58}$$

$$U_{\text{rms}}(\text{off})=\overline{F}\sqrt{1+mc^2-\frac{2c}{n}} \tag{59}$$

Operation margin R is defined by the following equation (60).

$$R=\frac{U_{\text{rms}}(\text{on})}{U_{\text{rms}}(\text{off})}=\frac{\overline{F}\sqrt{1+mc^2+\frac{2c}{n}}}{\overline{F}\sqrt{1+mc^2-\frac{2c}{n}}}=\sqrt{1+\frac{2ac}{1+mc^2-ac}} \tag{60}$$

-continued where $a=\frac{2}{n}$

Deriving c maximizing the operation margin R in equation (60), we get equation (61).

$$\frac{d}{dc}R=0\ \text{ Therefore }\ c=\frac{1}{\sqrt{m}} \tag{61}$$

Substituting equation (61) in equations (58) and (59), $U_{rms}$(on) and $U_{rms}$(off) can be expressed by equations (62) and (63).

$$U_{\text{rms}}(\text{on})=\overline{F}\sqrt{2\left(1+\frac{1}{\sqrt{nN}}\right)} \tag{62}$$

$$U_{\text{rms}}(\text{off})=\overline{F}\sqrt{2\left(1-\frac{1}{\sqrt{nN}}\right)} \tag{63}$$

Substituting equation (61) in equation (60), the operation margin R can be expressed by equation (64).

$$R=\sqrt{\frac{\sqrt{nN}+1}{\sqrt{nN}-1}} \tag{64}$$

Letting $U_{rms}$(off) be 1, F is given by equation (65) from equation (63).

$$F=\sqrt{\frac{\sqrt{nN}}{2(\sqrt{nN}-1)}} \tag{65}$$

Substituting equation (65) in equations (62) and (63), $U_{rms}$(on) and $U_{rms}$(off) can be expressed by equations (66) and (67).

$$U_{\text{rms}}(\text{on})=\sqrt{\frac{\sqrt{nN}+1}{\sqrt{nN}-1}} \tag{66}$$

$$\text{Urms(off)}=1 \tag{67}$$

Figure 15:
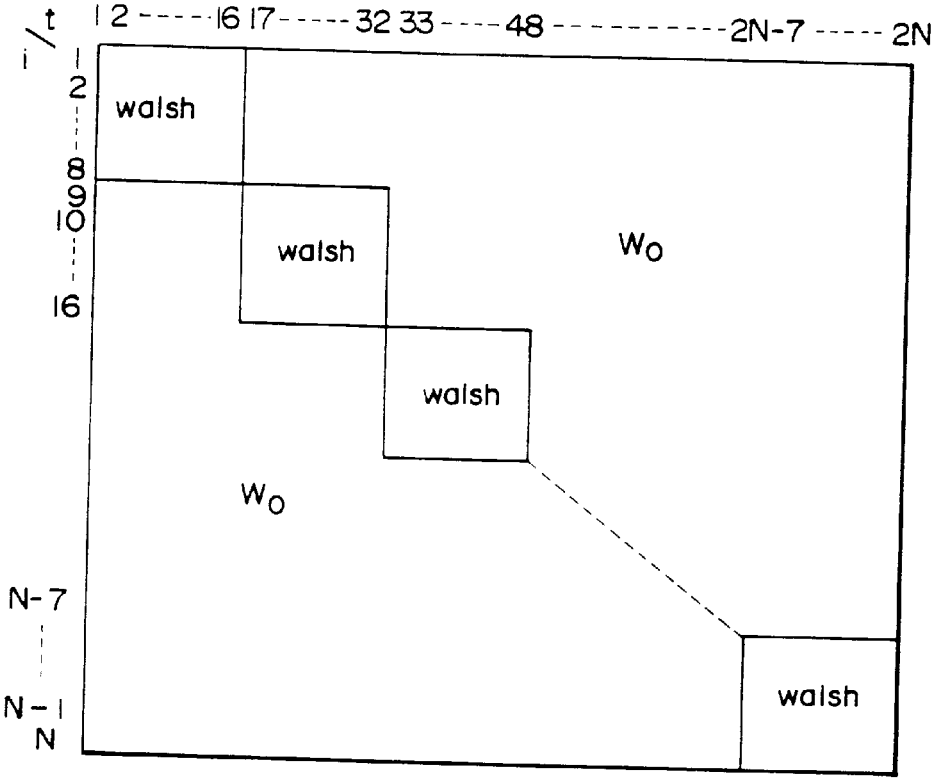
FIG. 15 is a diagram showing a voltage function of row electrodes, which are used in a version when the Walsh function is applied to only 8 rows among N row electrodes, one frame period T is 2N (where N is the number of display rows), and the Walsh function of 8 rows is driven with the number of divisions equivalent to 16.

In case the voltage function applied to row electrodes has distribution shown in FIG. 15 as heretofore described, it would be understood by comparing equations (66) and (67) with equations (9) and (10) that the effective voltage value of the display-on state and display-off state are identical with those obtained by replacing N in the above described example of the conventional technique by nN. Furthermore, in the present embodiment, description has been given by using the Walsh function. However, the present embodiment is not limited to this, but an orthogonal function having values of "1" and "−1" suffices as evident from the progress of effective value calculation. In the same way as the embodiment described before, this driving method will hereafter be referred to as partial orthogonal driving method.

The above described modification will now be described in further detail. Blocks of a column signal generation circuit implementing the partial orthogonal function driving method have the same configurations as the blocks of embodiment described before have and will not be described. Since the operation is also similar to that of the embodiment described before, description of respective portions will be omitted. Parts differing in operation will now be described. The column electrode driver 18 takes in analog display data corresponding to one row during one division interval and thereafter outputs data of one row simultaneously. The row function generation circuit 22 generates the row function shown in FIG. 15. After the row function data 23 have been completely written, the row electrode driver 24 outputs voltages depending upon the values to row electrodes. The operation of writing the row function data 23 is also conducted in one division interval and is in synchronism with the period of one division interval for writing analog display data 16 by using the driver 18. For convenience of description, the present embodiment will now be described assuming that the liquid crystal panel 28 has 4 rows by 4 columns, X=2, and the two rows are driven with 4 divisions. That is to say, one frame is driven with 8 divisions (See equations (34) and (35)). As heretofore described, the column signal generation circuit of FIG. 7 implements partial orthogonal function driving.

Figure 16:
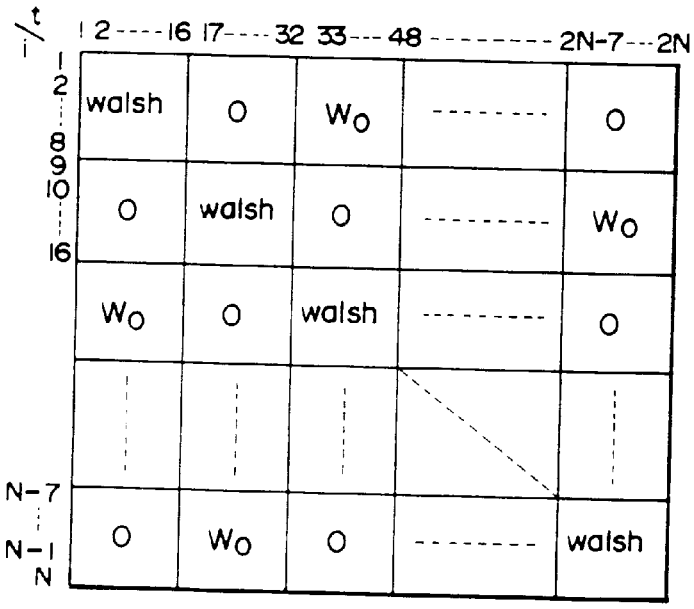
FIG. 16 is a diagram showing distribution of the voltage function of row electrodes in which $W_0$ is changed to $W_0$ and 0 in the version of FIG. 15.

In case a display apparatus having N rows is to be driven by using an orthogonal function, which is divided into K parts while taking R rows as the unit, as the voltage function in the embodiment and modification heretofore described, division into K parts has been conducted consecutively as shown in FIGS. 7 and 15. The embodiment and modification can also be implemented by using an orthogonal function shown in FIG. 16. The orthogonal function of FIG. 16 provides "0" in the embodiment described before, and provides an alternate combination of "0" and "$W_0$" during intervals yielding $W_0$ in the modification. Detailed description of the embodiment of this case will not be given, but it would be evident from the description of the embodiment described before and the above described modification that this can be implemented in the same way. Furthermore, in FIG. 16, "0" and "$W_0$" are alternated. However, this is not restrictive, but the number of them and how to give them may also be changed.

A second embodiment of the present invention will now be described. Assuming now that a display apparatus having N rows is driven by 8 rows with 16 divisions, for example, the second embodiment shows a concrete circuit of a driving method whereby 16 divisions are distributed among $W_1$ to $W_4$ each having 4 divisions (i.e., k1 to k4 included in 16 divisions k1 to k16 are distributed to $W_1$, and k5 to k8 are distributed to $W_2$, whereas k9 to k12 are distributed to $W_3$, and k13 to k16 are distributed to $W_4$). In this case, 16 divisions are simply distributed. Therefore, it is evident that the display apparatus can be driven by display-on voltage and display-off voltage identical with those of the first embodiment by conducting computation on the 8 rows and calculating voltages to be applied to column electrodes during the distributed time. As a known example, Japan Display '92 Digest, pp. 503 to 505 can be mentioned. However, its operation and concrete circuit are not described therein.

Figure 17:
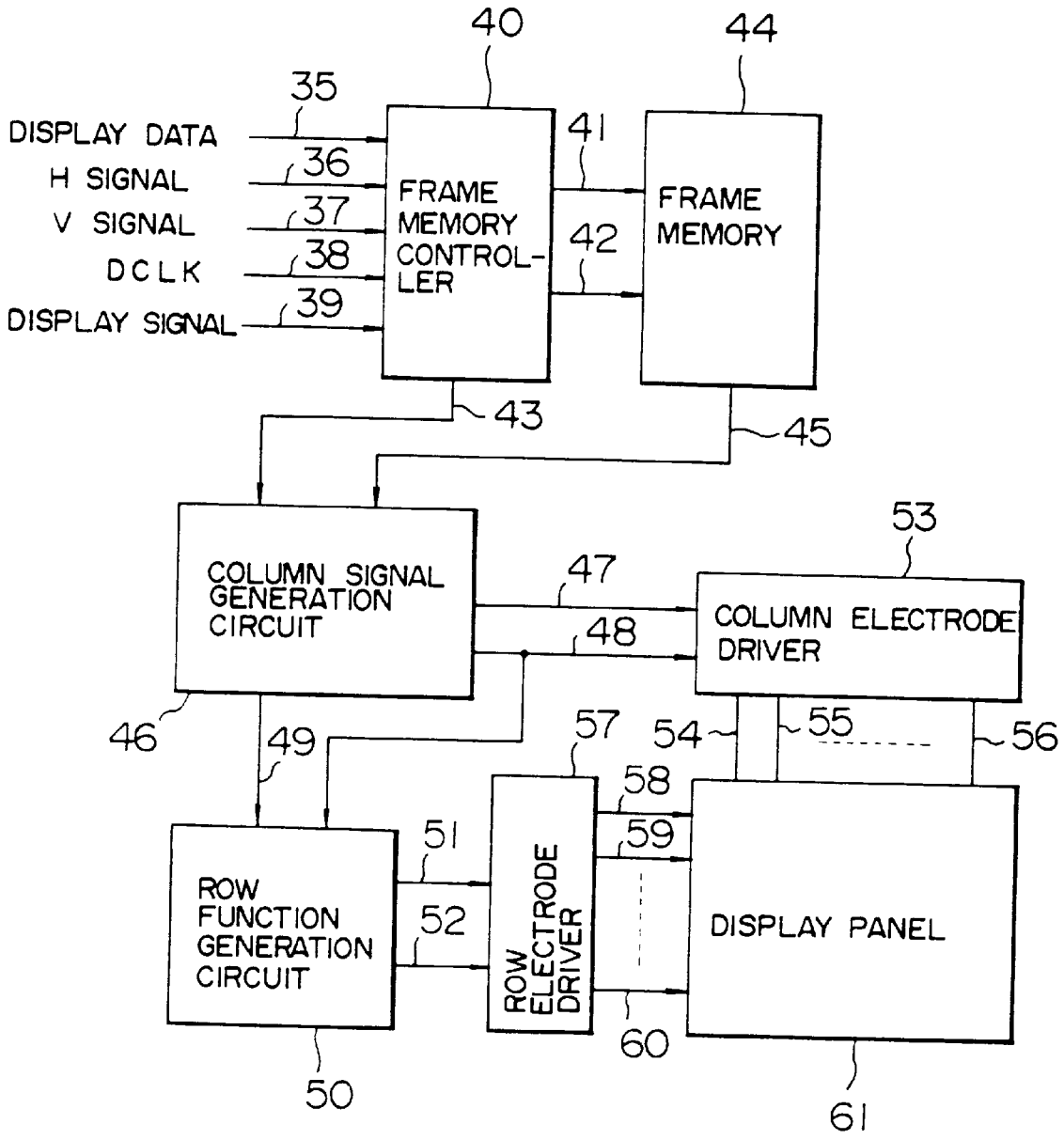
FIG. 17 is a block diagram of a second embodiment of a liquid crystal display apparatus.
Figures 18A, 18B, 18C, 18D, 18E, 18F:
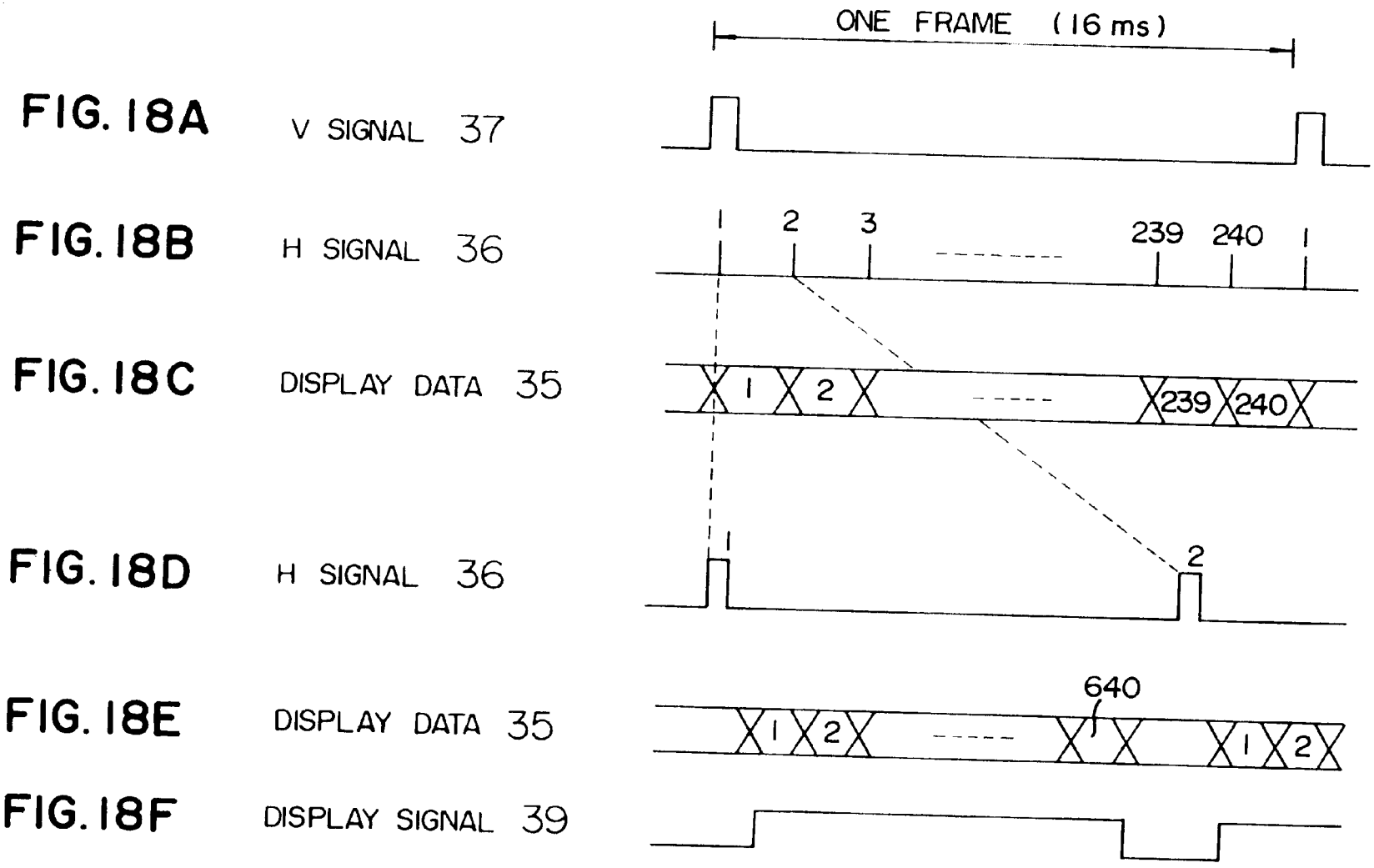
FIGS. 18A to 18F are timing diagrams of display data 35 inputted to the liquid crystal display apparatus.

The second embodiment will hereafter be described in detail by referring to drawings. FIG. 17 is a block diagram of a liquid crystal display apparatus of the second embodiment. Numeral 35 denotes display data, 36 an H signal which is a horizontal synchronizing signal, and 37 a V signal which is a vertical synchronizing signal. Numeral 38 denotes DCLK synchronized with the display data 35. Numeral 39 denotes a display signal representing a duration for the display data 35 to be displayed on the display apparatus, by "high" levels. As for the display data 35, it is assumed that 640 dots for one line are transmitted during one horizontal interval equivalent to one period of the H signal 36 and data for 240 lines are transmitted during one frame time equivalent to one period of the V signal 37. Numeral 40 denotes a frame memory controller, 41 frame memory write data, 42 a frame memory control signal for controlling writing and reading data inputted to the frame memory, and 43 a data control signal. The controller 40 performs serial-parallel conversion on the display data 35 and generates the frame memory write data 41 as 4-dot parallel data. Furthermore, the controller 40 generates signals of the control signal 42 and 43 on the basis of the H signal 36, V signal 37, DCLK 38, and display signal 39. Details of these generated signals will be described later. Numeral 44 denotes a frame memory, and numeral 45 denotes frame memory read data. Numeral 46 denotes a column signal generation circuit. In the same way as the first embodiment, the column signal generation circuit 46 conducts computation on the frame memory read data 45 for 8 lines and generates liquid crystal data 47. Numeral 48 denotes a column signal control signal, and numeral 49 denotes a function signal. The column signal control 48 and the function signal 49 are generated by the generation circuit 46. Numeral 50 denotes a row function generation circuit, 51 row data, and 52 a row data control signal. By using the function signal 49, the generation circuit 50 generates the row data 51 and the row data control signal 52. Numeral 53 denotes a column electrode driver. Numerals 54 to 56 denote column electrode signals of the first column, the second column, and the 640th column, respectively. The liquid crystal data 47 are written into the driver 53 by the column signal control signal 48. On the basis of the liquid crystal data 47, the driver 53 selects one out of 9 kinds of voltage and outputs it to the corresponding column electrode. In FIG. 17, the 9 kinds of voltage are not illustrated. As one example, however, the 9 kinds of voltage can be realized by generating the 9 kinds of voltage in an external voltage divider circuit using resistors and giving them to the column electrode driver. Numeral 57 denotes a row electrode driver. Numerals 58 to 60 denote row electrode signals of the first row, the second row, and the 240th row. The row data 51 are written into the driver 57 by the signal on the row data control signal 52. On the basis of the written row data 51, the driver 57 selects one out of three kinds of voltage and outputs it to the corresponding column electrode. In FIG. 17, the three kinds of voltage are not illustrated. However, the circuit therefor can be formed in the same way as the case of the driver 53. Furthermore, operation of the drivers 53 and 57 is identical with that of a TFT liquid crystal driver "HD66310" produced by Hitachi Ltd. with the exception of the number of selected voltages. It would be thus self-evident that the drivers 53 and 57 can be easily formed. Numeral 61 denotes a liquid crystal display panel having 640 dots in the lateral direction and 240 lines in the longitudinal direction. The intersection of a column electrode and a row electrode forms one dot. By the effective value of the potential difference at the intersection, display-on and display-off are represented.

FIGS. 18A to 18F are timing diagrams of display data 35 inputted to the present liquid crystal display apparatus. FIGS. 19A to 19F are timing diagrams showing timing of the frame memory read data 45 read from the frame memory 44 and the data control signal 43. In FIGS. 19A to 19F, a read V signal 81, a read H signal 82 and a read display signal 83 are of the data control signal 43.

Figure 20:
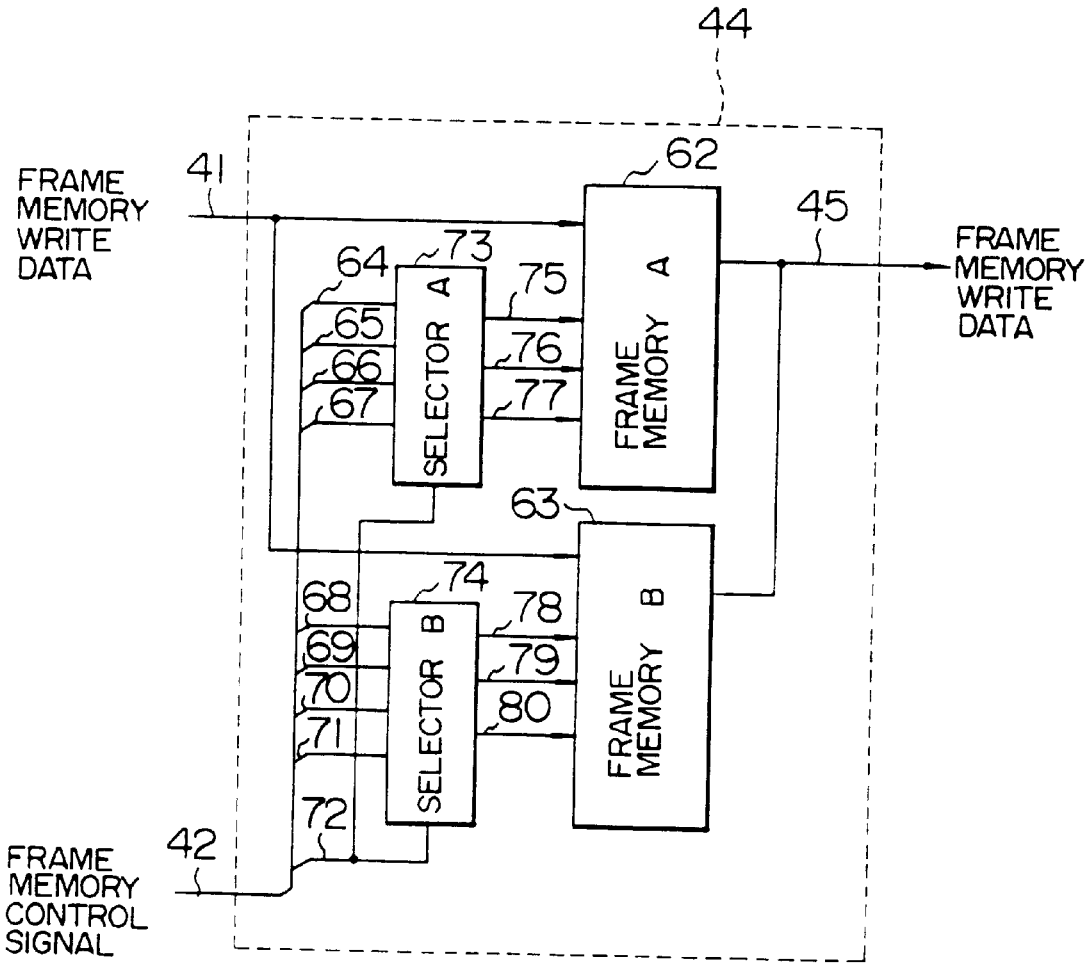
FIG. 20 is a block diagram showing the frame memory 44.

FIG. 20 is a block diagram of the frame memory 44. Numeral 62 denotes a frame memory-A for storing display information of 640 dots×240 lines for one frame. Numeral 63 denotes a frame memory-B for storing display information for one frame in the same way. Numeral 64 denotes AW reset for ordering the memory-A 62 to reset the write address, 65 AW clock for writing data into the memory-A 62, 66 AR reset for ordering the memory-A 62 to reset the read address, and 67 AR clock for reading data into the memory-A 62. Numeral 68 denotes BW reset for ordering the frame memory-B 63 to reset the write address, 69 BW clock for writing data into the memory-B 63, 70 BR reset for ordering the memory-B 63 to reset the read address, and 71 BR clock for reading data into the memory-B 63. Numeral 72 denotes a frame memory R/W signal. The R/W signal 72 indicates writing data into the memory-A 62 and reading data from the memory-B 63 when it is at a "high" level. The R/W signal 72 indicates reading data from the memory-A 62 and writing data into the memory-B 63 when it is at a "low" level. Numerals 73 and 74 denote selectors A and B, respectively. The selector-A 73 and the selector-B 74 conduct selection operation respectively in accordance with the R/W signal 72. Numeral 75 denotes memory-A reset, 76 memory-A clock, 77 a memory-A R/W signal, 78 memory-B reset, 79 memory-B clock, and 80 a memory-B R/W signal.

The memory-A 62 and memory-B 63 conduct read/write operation in accordance with respective R/W signals 77 and 80. (Write operation is conducted when the R/W signal is "high", whereas read operation is conducted when the R/W signal is "low".) Read and write addresses of the memory-A 62 and memory-B 63 are reset to "0" by respective reset signals 75 and 78, and thereafter increased after write/read operation has been conducted by respective clocks 76 and 79.

Figures 21C, 21E:
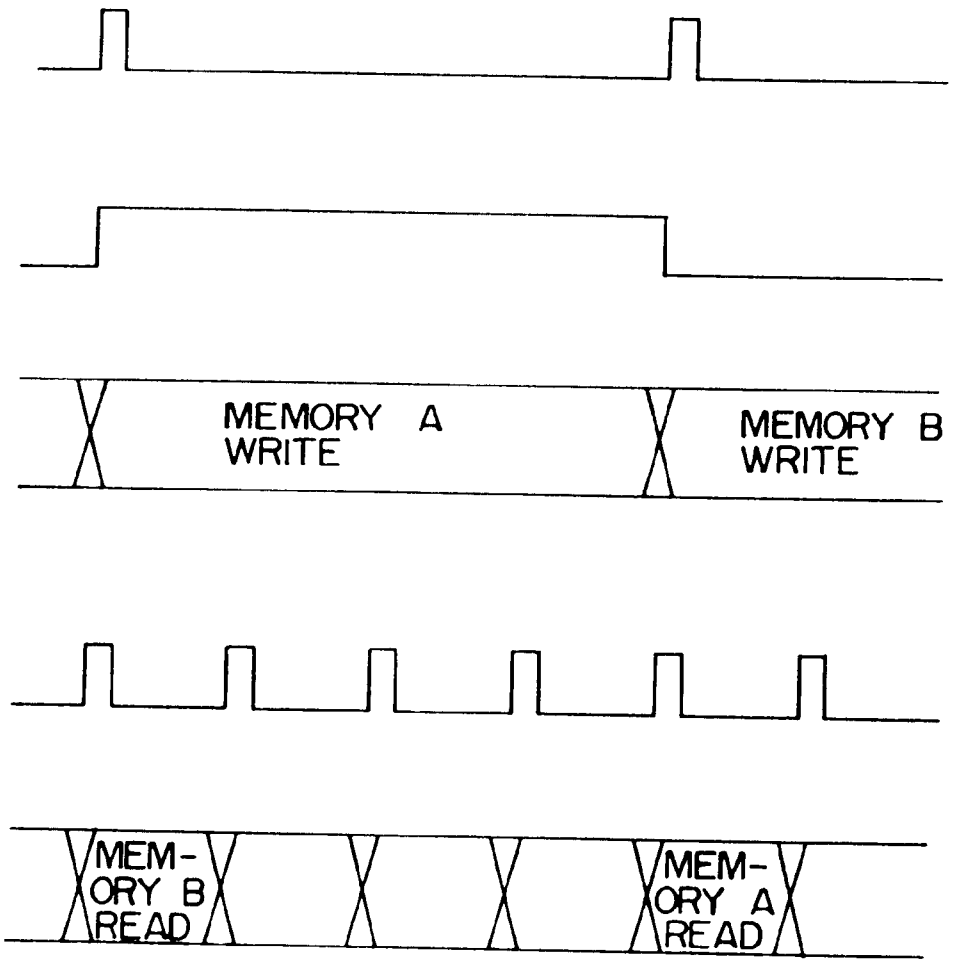
Figure 22:
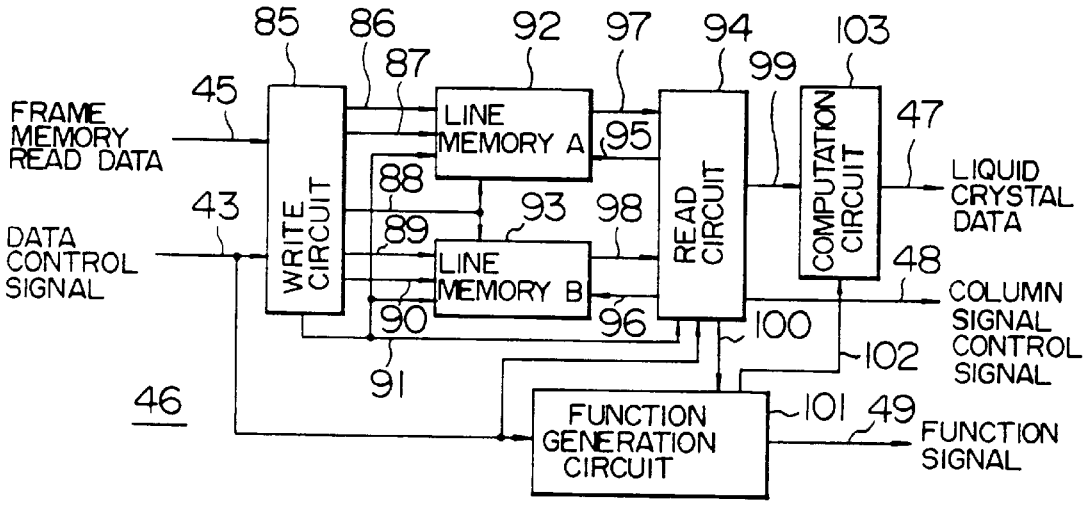
FIG. 22 is a block diagram of a column signal generation circuit 46.

FIGS. 21A to 21E are timing diagrams illustrating operation of the frame memory 44. FIG. 22 is a block diagram of the column signal generation circuit 46 shown in FIG. 17. In FIG. 22, numeral 85 denotes a write circuit, 86 A data, 87 A control signal, 88 a line address, 89 B control signal, 90 B data, 91 an AW signal, 92 a line memory A, and 93 a line memory B. The write circuit 85 outputs the frame memory read data 45 having 4 parallel bits as the A data 86 and B data 90. In addition, the write circuit generates signals for the A control signal 87, line address 88, B control signal 89, and AW signal 91 on the basis of the signal on the data control signal 43. Write operation is conducted alternately to the line memory-A 92 and line memory-B 93 every 8 lines of the read data 45. A "high" level of the AW signal 91 indicates writing data into the line memory-A 92, whereas a "low" level of the AW signal 91 indicates writing data into the line memory-B 93. Numeral 95 denotes an A read control signal, 96 a B read control signal, 94 a read circuit, 97 A read data, and 98 B read data. By using the data control signal 43, the read circuit 94 generates the A read control signal 95 and B read control signal 96 and reads data from the line memory-A 92 and line memory-B 93 respectively as the A read data 97 and B read data 98. As for this read operation, data are read from a line memory, which is not being subjected to write operation, by using the AW signal 91. Numeral 99 denotes 8-line data which are read data. Numeral 100 denotes a read count. The 8-line data 99 and the read count 100 are generated by the read circuit 94. Numeral 101 denotes a function generation circuit. Numeral 102 denotes orthogonal function data. The generation circuit 101 generates eight orthogonal functions with 16 divisions by using the data control signal 43 and outputs them as the orthogonal function data 102. Numeral 103 denotes a computation circuit, which calculates the sum of products of the 8-line data 99 and the orthogonal function data 102 and outputs liquid crystal data 47. Its concrete computation method and circuits will be described later.

FIG. 24 is a block diagram depicted from a viewpoint of write operation of the line memory-A 92 shown in FIG. 22. Numeral 104 denotes AW reset and numeral 105 denotes AW clock. The AW reset 104 and AW clock 105 are signals on the A control bus 87. Numerals 106 to 108 denote line memories each storing display information corresponding to one line. Numerals 106, 107 and 108 denote a line-1 memory, a line-2 memory, and a line-8 memory, respectively. In FIG. 24, line-3 to line-7 memories are not illustrated for clarity. Numeral 109 is a write address decoder. The write address decoder 109 decodes the line address 88 and indicates which line memory data should be written into. Numeral 110 denotes a line memory-l write signal, 111 a line memory-2 write signal, and 112 a line memory-8 write signal. Write operation is conducted for a memory having a "high" write signal. In each line memory, the write address is reset to "0" by the AW reset 104, and thereafter write operation and address increment are successively conducted by the AW clock 105. FIGS. 23A to 23D and FIGS. 25A to 25E are diagrams illustrating the write operation of data into the line memory-A 92.

Figure 26:
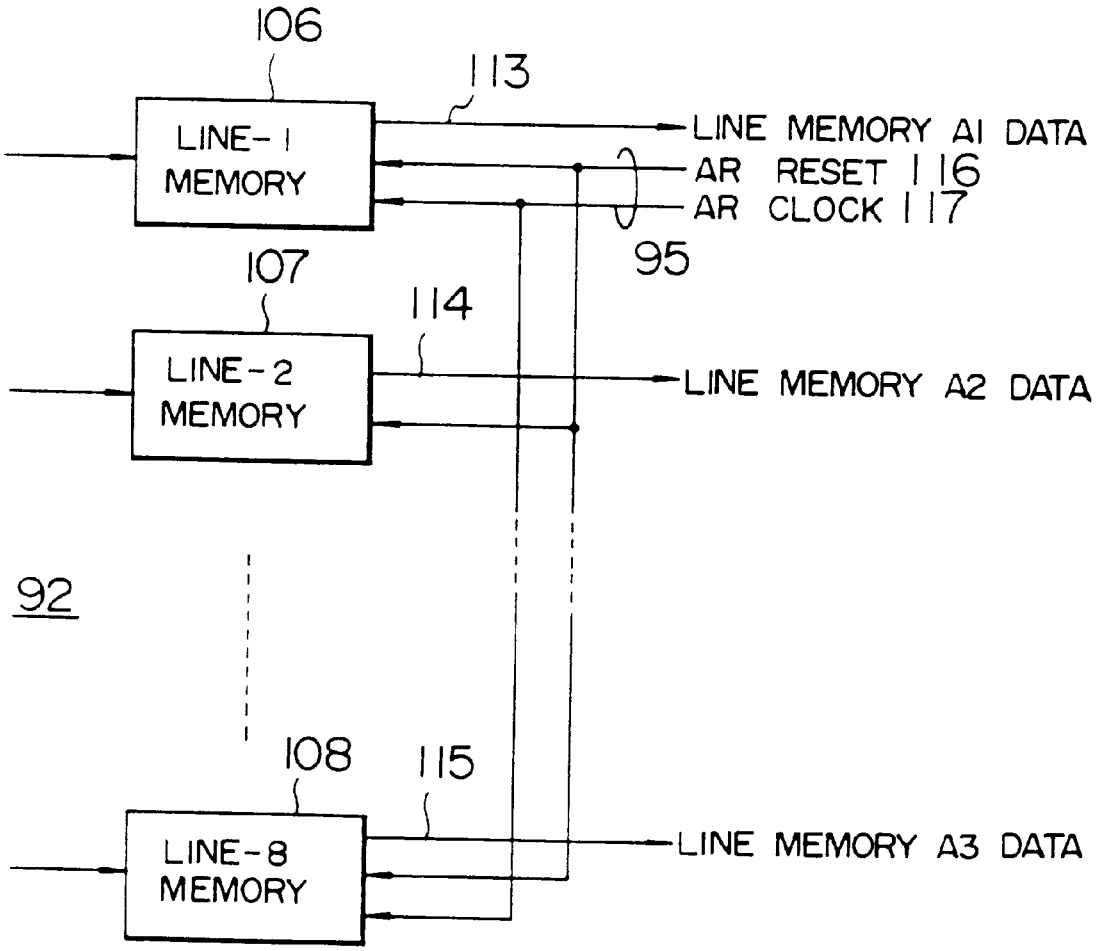
FIG. 26 is a block diagram of the line memory-A 92 dericted from a viewpoint of the reading operation.
Figure 27:
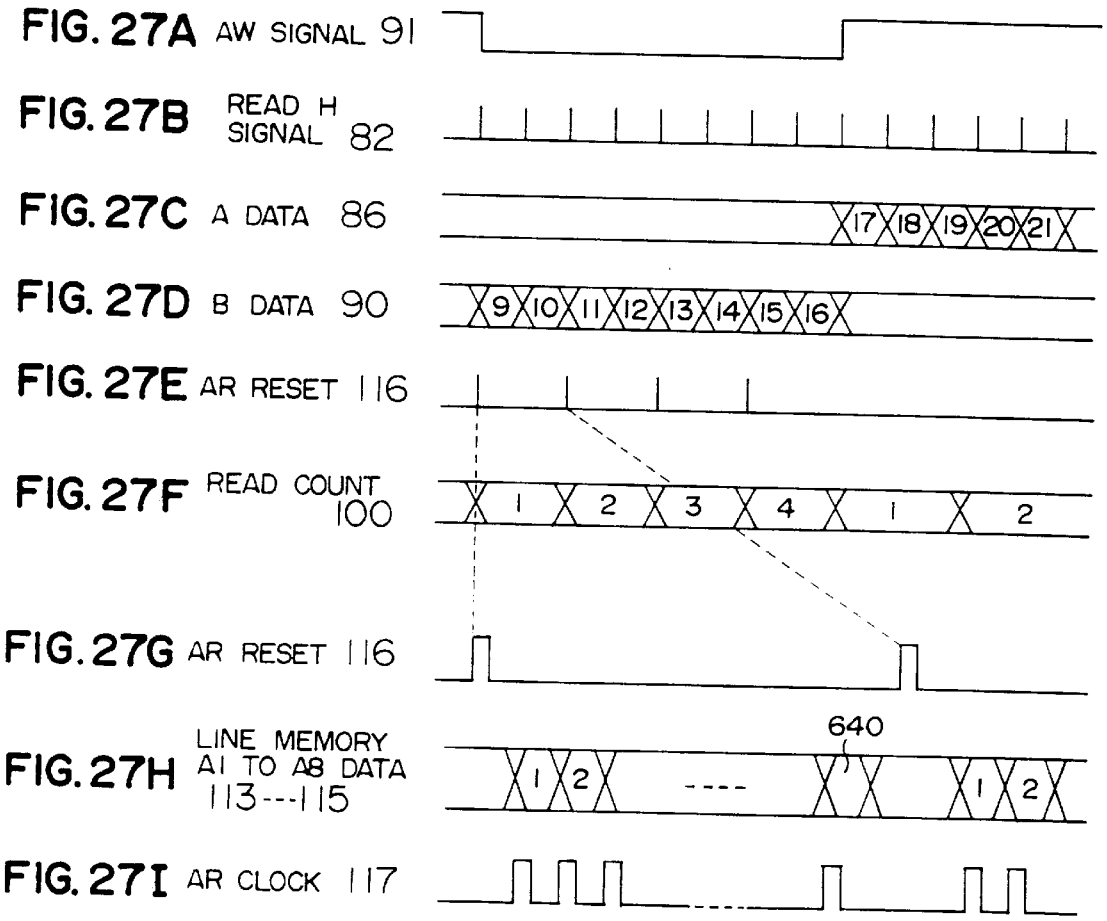
FIGS. 27A to 27I are diagrams illustrating the reading operation of the line memory-A 92.

FIG. 26 is a block diagram depicted from a viewpoint of read operation of the line memory-A 92. An AR reset 116 and an AR clock 117 are signals of the A read control bus 95. Numerals 113 to 115 denote read data of the line-i memory 106, line-2 memory 107 and line-8 memory 108, respectively. Numerals 113, 114 and 115 denote line memory Al data, line memory A2 data and line memory A8 data, respectively. As for read operation, the read address is set to "0" by the AR reset 116, and thereafter one dot is read simultaneously from every 8-line memories including the line-1 memory 106 to line-8 memory 108. Thus 640 dots are successively read out. FIGS. 27A to 27I are timing diagrams illustrating the operation of reading data from the line memory-A 92.

Figure 28:
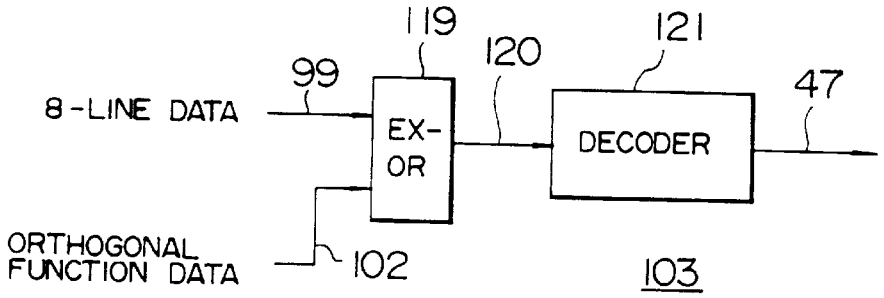
FIG. 28 is a block diagram of a computation circuit 103.

FIG. 28 is a block diagram of the computation circuit 103 shown in FIG. 22. Numeral 119 denotes an EX-OR circuit, which conducts exclusive OR operation on each data of the 8-line data 99 containing 1-bit data information corresponding to 8 lines and each data of orthogonal function data 102 containing 8 orthogonal functions. Numeral 120 denotes computation data outputted from the EX-OR 119. Numeral 121 denotes a decoder for decoding the number of "high" levels contained in the computation data 120. The result of decoding is outputted as the liquid crystal data 47.

Figure 29:
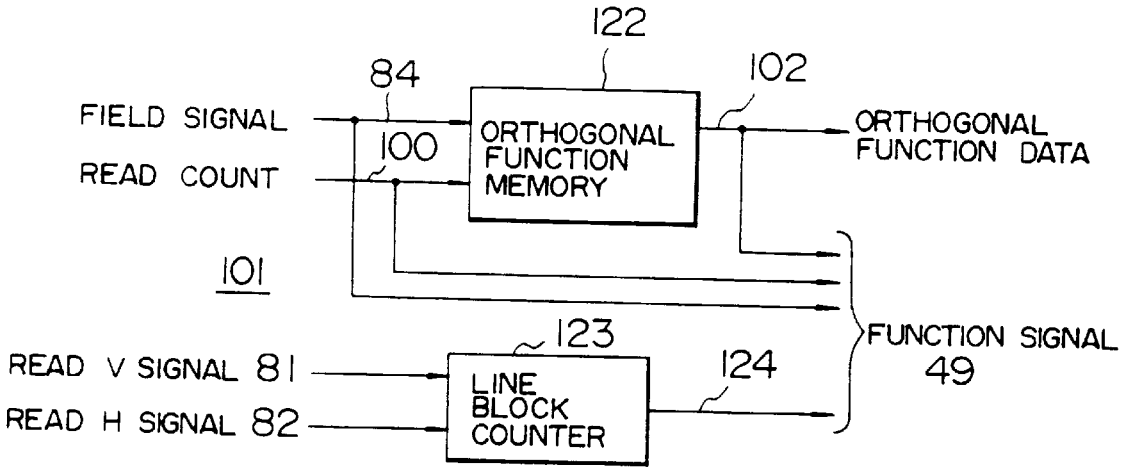
FIG. 29 is a block diagram of a function generation circuit 101.
Figure 30:
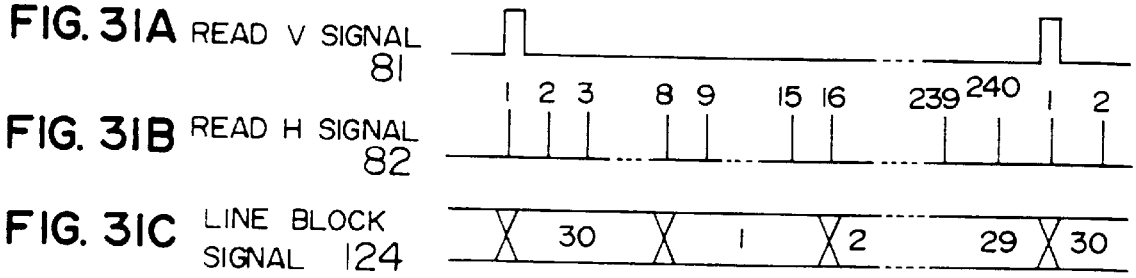
FIG. 30 is a diagram illustrating the operation of an orthogonal function memory 122.
Figures 32A, 32B, 32C, 32D, 32E, 32F:
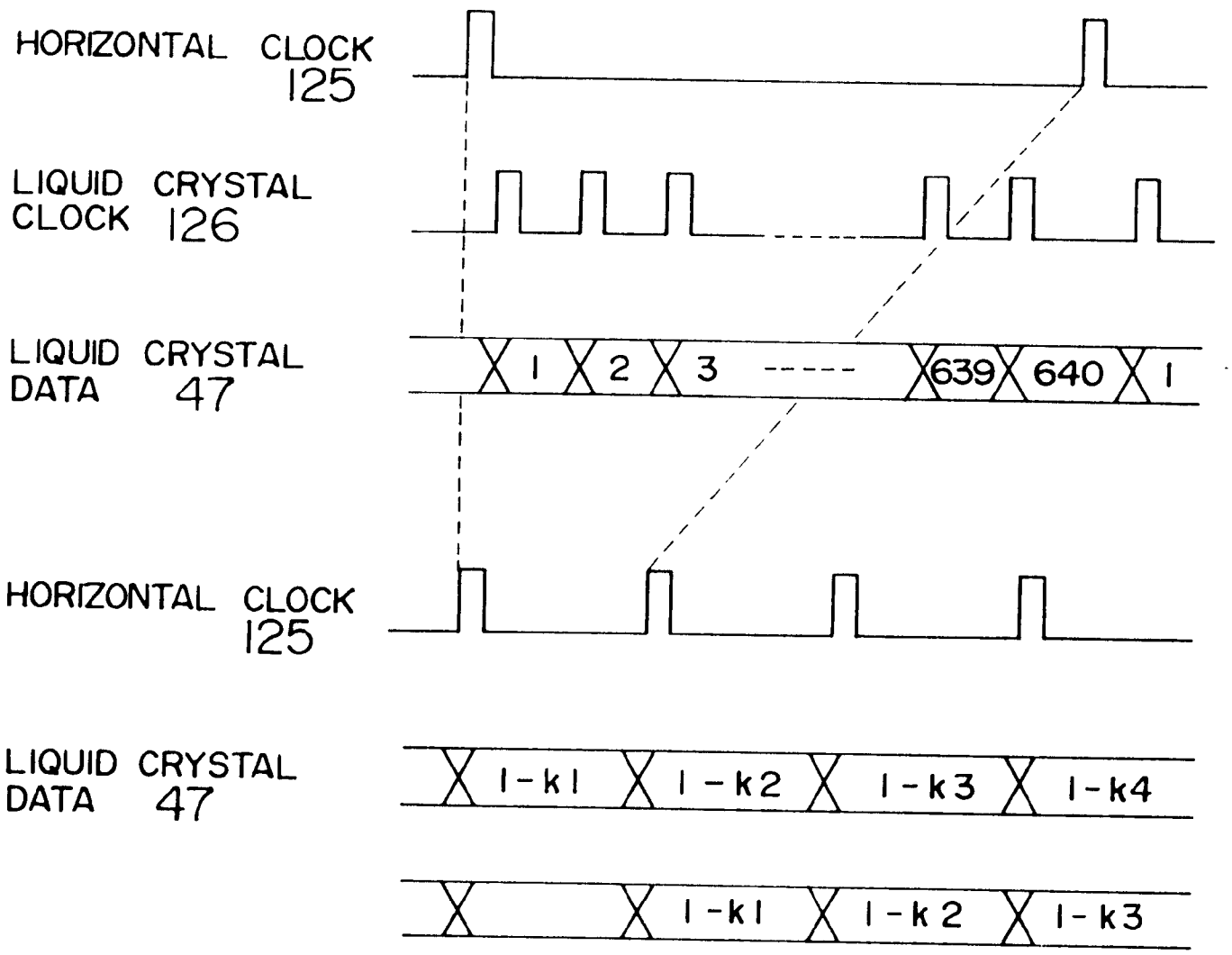
FIGS. 32A to 32F are timing diagrams illustrating the operation of a column electrode driver 53.

FIG. 29 is a block diagram of the function generation circuit 101. Numeral 122 denotes an orthogonal function memory for storing 8 kinds of orthogonal function data corresponding to 16 divisions. In accordance with a field signal 84 and the read count 100, the orthogonal function memory 122 outputs orthogonal function data 102 containing values of 8 kinds of orthogonal functions. Numeral 123 denotes a line block counter, and numeral 124 denotes a line block signal. By taking the read V signal 81 as a reference, the line block counter 123 conducts count operation with respect to the read H signal 82 while taking 8 lines as the unit and outputs the counted value as the line block signal 124. FIG. 30 is a diagram illustrating operation of the orthogonal function memory 122. FIGS. 31A to 31C are timing diagrams illustrating operation of the line block counter 123. FIGS. 32A to 32F are timing diagrams illustrating operation of the column electrode driver 53.

Figure 33:
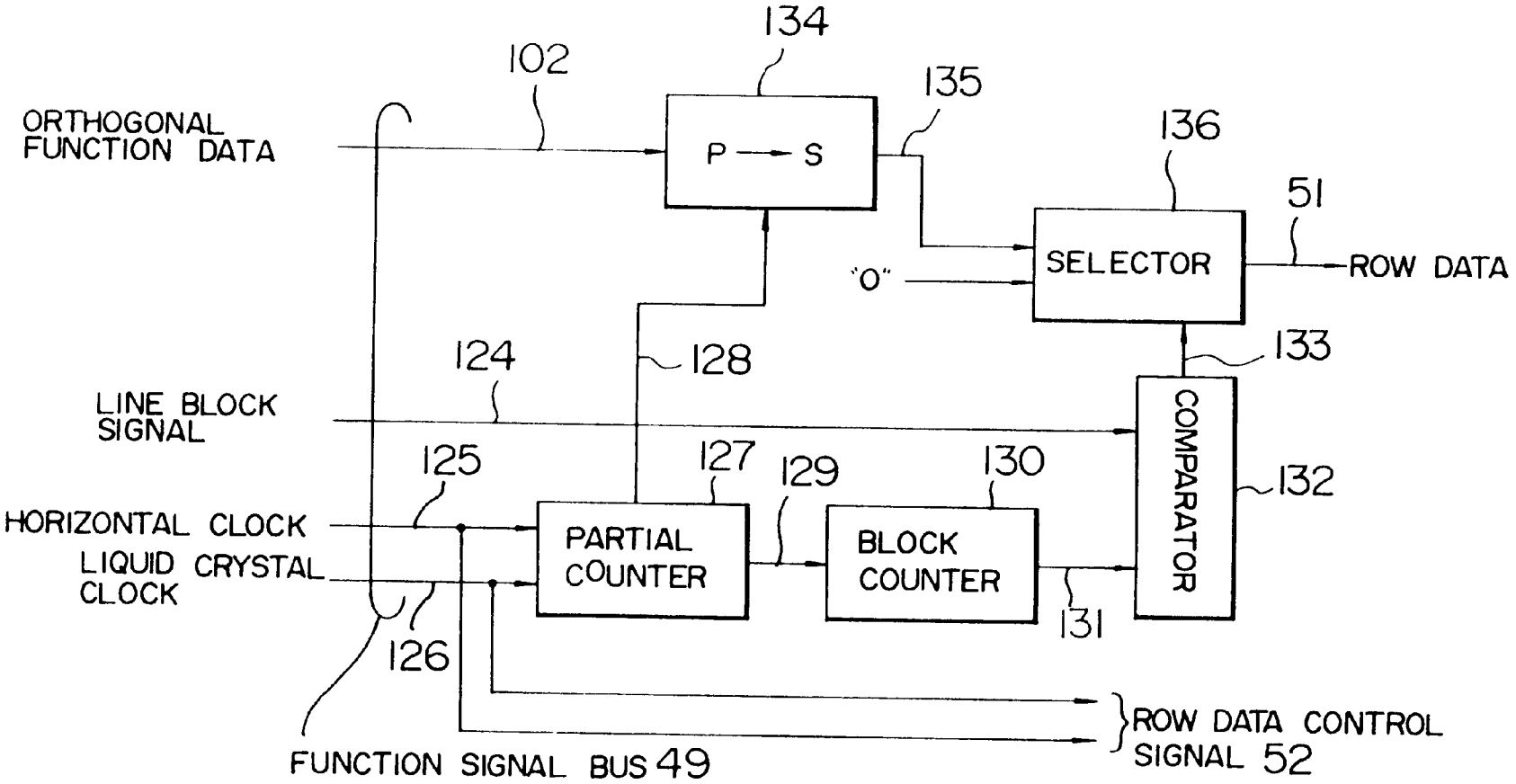
FIG. 33 is a block diagram of a row function generation circuit 50.
Figure 34:
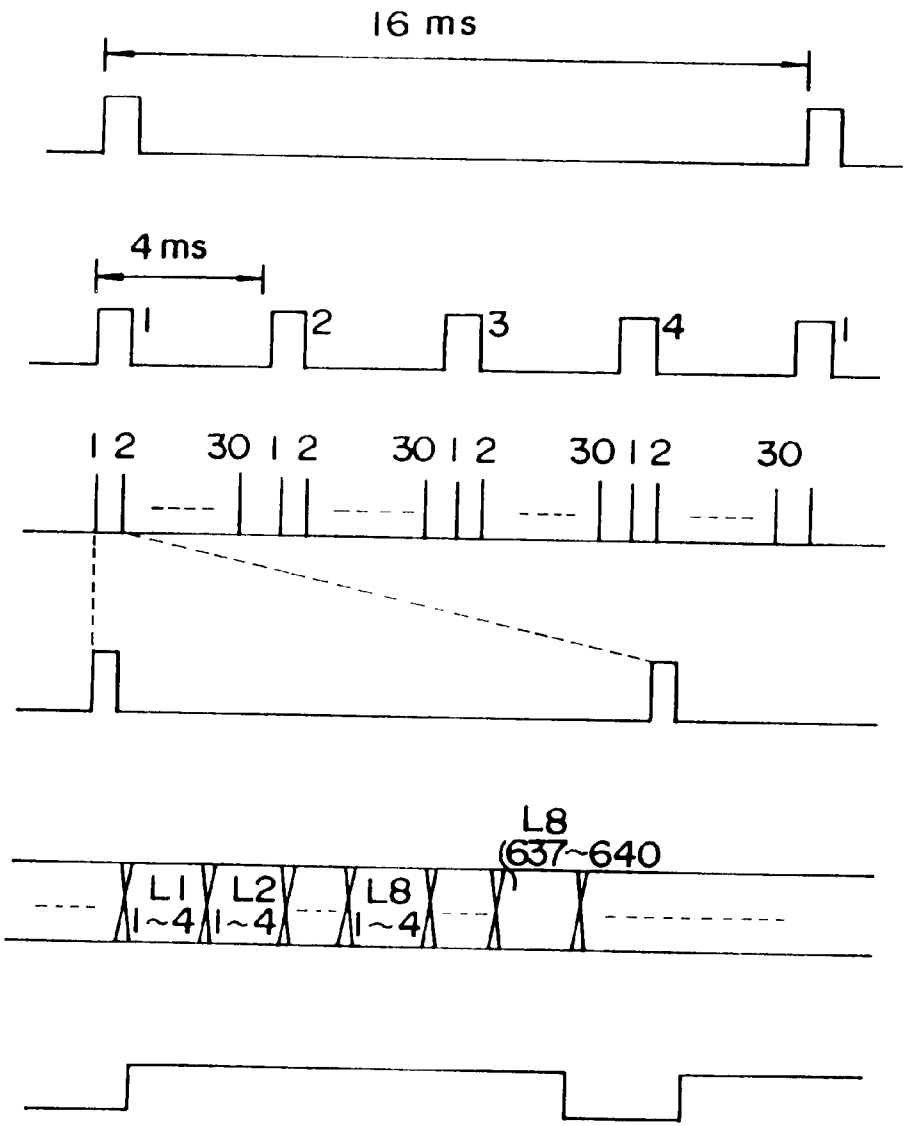
FIGS. 34A to 34F are timing diagrams illustrating the reading operation from the frame memory 44.

FIG. 33 is a block diagram of the row function generation circuit 50. Numeral 125 denotes a horizontal clock, 126 a liquid crystal clock, 128 a partial count value, and 129 a partial clock. They are generated by the column signal generation circuit 46. Numeral 127 denotes a partial counter. The partial counter 127 is reset by the horizontal clock 125 and repetitively counts up to eight by using the liquid crystal clock 126. The partial counter 127 outputs the counted value as the partial count value 128 and generates the partial clock 129 having a period of counting up to eight. Numeral 130 denotes a block counter, and 131 denotes a block value. The block counter 130 is reset by the horizontal clock 125. The block counter counts by using the partial clock 129 and outputs the counted value as the block value 131. Numeral 132 denotes a comparator, and 133 denotes a comparator output. The comparator 132 compares the line block output 124 with the block value 131. When they coincide with each other, the comparator 132 makes the comparator output 133 "high". Numeral 134 denotes a P-S circuit. The orthogonal function data 102 containing 8 kinds of orthogonal functions are inputted to the P-S circuit 134. In accordance with the partial count value 128, the P-S circuit outputs one kind at a time. Numeral 135 denotes serial orthogonal data outputted from the P-S circuit 134. Numeral 136 denotes a selector. When the comparator output 133 is "high", the selector 136 outputs serial orthogonal data. Otherwise, the selector 136 outputs "0".

First of all, outline of operation of the second embodiment will be described by referring to FIG. 17. Thereafter, operation of respective blocks shown in FIG. 17, which is the block diagram of the liquid crystal display apparatus, will be described in detail by referring to FIGS. 18 to 34.

As for the inputted display data 35, data corresponding to one screen to be displayed during one frame interval are transmitted serially. The frame memory controller 40 converts the display data 35 to 4-bit parallel data and writes the 4-bit parallel data successively into the frame memory 44. The controller 40 reads 4-bit parallel display data 35 stored one frame before from the frame memory 44 four times with a period equivalent to one fourth of the frame period of the input. According to the read timing, the controller 40 generates the read V signal 81, read H signal 82, read display signal 83, field signal 84, and reference clock having the same period as that of the DCLK on the basis of the inputted H signal 36, V signal 37, DCLK 38, and display signal 39. The controller 40 outputs the read V signal 81, read H signal 82, read display signal 83, field signal 84, and reference clock to the column signal generation circuit 46 via the data control signal 43. The field signal 84 indicates the number of times of reading up to four, and has a value of "1" to "4". They are referred to as the first field to the fourth field, respectively. On the basis of the signal on the data control signal 43 and the frame memory read data 45, the generation circuit 46 generates liquid crystal data 47 and the column signal control signal 48 and outputs them to the column electrode driver 53. The generation circuit 46 takes in the frame memory read data 45 corresponding to 8 lines, reads out one dot data simultaneously from every 8 lines, conducts computation on the 8-line data thus read out and orthogonal function data, and generates the liquid crystal data 47. In this computation, computation of data of the first field with the orthogonal function of W1 is conducted as shown in FIG. 16. Computation of data of the second field with the orthogonal function of W2 is conducted. Computation of data of the third field with the orthogonal function of W3 is conducted. Computation of data of the fourth field with the orthogonal function of W4 is conducted. The row function generation circuit 50 controls the row electrode driver 57 so that the driving voltage of the orthogonal function and "0" shown in FIG. 16 may be supplied to respective row electrode signals. In order to attain synchronization with the orthogonal function of computation in the generation circuit 46, the generation circuit 50 generates row data 51 by using the function signal bus 49.

Details of operation of respective blocks will hereafter be described.

Timing of the inputted display data 35 of FIG. 17 is shown in FIGS. 18A to 18F. The display data 35 have 240 lines in the longitudinal direction. During one frame interval equivalent to one period of the V signal 37 (herein 16 ms), data of 240 lines arrive. One line is represented in one period of the H signal 36. During an effective interval indicated by the "high" level of the display signal 39 in the one period, data of 640 dots successively arrive in series. As for the display data 35, therefore, one screen is formed by 640 dots in the lateral direction and 240 lines in the longitudinal direction. The display data are converted to 4-bit parallel data. The resultant 4-bit parallel data are written into the frame memory 44, and read out with a period equivalent to one fourth of the original period as shown in FIG. 19B.

Read operation and write operation of the frame memory 44 will now be described. The frame memory 44 can be formed by the configuration as shown in FIG. 20. When the frame R/W signal 72 is "high", data should be written into the memory A as shown in FIG. 21C. Therefore, the selector A selects the AW reset 64 and AW clock 65, out-puts them as the memory-A reset 75 and memory-A clock 76, and makes the memory AR/W signal "high". As a result, the memory A resets the address by using the AW reset 64 having the same timing as the V signal 37 has, and thereafter writes the frame memory write data 41 existing during the "high" interval of the display signal 39 by using the AW clock 65. Here, the AW clock 65 is a clock signal synchronized with the frame memory write data 41, i.e., having a period equivalent to one fourth of the period of the DCLK 38. The AW clock 65 becomes the clock output for only data existing during the "high" interval of the display signal 39. When this write operation is being conducted, the selector-B 74 selects the BR reset 70 and BR clock 71 as the memory-B reset 78 and memory-B clock 79 and keeps the memory-B R/W signal at the "low" level. As shown in FIG. 21C, therefore, the memory B conducts read operation in synchronism with the read V signal having a frequency which is four times as high as that of the V signal 37. In order to read data at a speed which is four times as fast as that of writing, the BR clock 71 has a period equivalent to one fourth of the period of the write clock, i.e., equivalent to the period of the DLCK 38. When the frame memory R/W signal 72 is "low", the selector-A 73 and selector-B 74 select the AR reset 66, AR clock 67, BW reset 68 and BW clock 69, make the memory-A R/W signal 77 and memory-B R/W signal 80 respectively "low" and "high", and cause read operation and write operation to be conducted respectively with respect to the memory-A 62 and memory-B 63. As heretofore described, the operation of the controller 40 and frame memory 44 causes the display data 35 shown in FIG. 18C to be written into the frame memory 44. With a delay of one frame interval, the data are read out four times with a period equivalent to one fourth of the original period as shown in FIG. 19B. Although not illustrated in FIGS. 19A to 19F, the frame memory read data 45 is in synchronism with the read clock having the same period as the inputted DCLK 38 has, and this read clock is included in the data signal control bus 43.

Detailed operation of the column signal generation circuit 46 will now be described. The frame memory read data 45 are 4-bit parallel data and are written into the line memory-A 92 or line memory-B 93 by the write circuit 85. As shown in FIG. 23A, the write circuit 85 generates a line address 88. The line address 88 is obtained by counting the read H signal 82 while taking the read V signal 81 as the reference and repetitively assumes the value of 1 to 8. In addition, the write circuit 85 causes the AW signal 91 to repetitively become "high" and "low" every 8 lines. The AW signal 91 is a signal indicating the line memory into which the frame memory read data 45 should be written. When the AW signal 91 is "high", writing data into the line memory-A 92 is indicated. When the AW signal 91 is "low", writing data into the line memory-B 93 is indicated.

Assuming now that the AW signal 91 is "high", operation of writing data into the line memory-A 92 will now be described by referring to FIG. 24 and FIGS. 25A to 25F. When the AW signal 91 is "high", the write address decoder 109 shown in FIG. 24 enables write operation successively with respect to eight line memories, i.e., the line-1 memory 106 to line-8 memory 108 on the basis of the value of the line address 88. That is to say, for each line memory, the write address is reset by the AW reset 113 which is identical with the read H signal 82 as shown in FIG. 25A. By the AW clock 114 which is the clock synchronized with data existing during the "high" interval of the read display signal 83, the A data 86 are successively written into the line memory line by line. The line memory-B 93 can be realized by the same configuration as that of FIG. 24. However, the write address decoder included in the line memory-B 93 enables each write signal in accordance with the line address 88 when the AW signal 91 is "low". When the AW signal 91 is "low" (i.e., when data are written into the line memory-B 93), read operation of the line memory-A 92 is conducted by using the read circuit 94.

This read operation will now be described by referring to FIG. 26 and FIGS. 27A to 27I. In the line-1 memory 106 to line-8 memory 108, the read address is reset by the AR reset 116 and thereafter data are read successively by the AR clock 117 at the rate of one bit from every line memory. At this time, the read circuit 94 generates the AR reset 116 four times while the AW signal 91 is "low" as shown in FIG. 27E, i.e., every two periods of the read H signal 82. Furthermore, the read count 118 is increased from 1 to 4 at this time. In one period of the AR reset 116, data of 640 dots are successively read out by the AR clock 117 and outputted as the A read data 97 of 8-line data. This operation is true of the frame memory B as well. When the AW signal is "high", the read circuit 94 outputs the BR clock and BR reset onto the B read control bus to conduct read operation. As understood from FIGS. 25A to 25E, the AW reset 113 and AW clock 114 are outputted only when the line memory-A 92 is conducting write operation. In the same way, the BW reset and BW clock are also outputted only when the line memory-B 93 is conducting write operation. It is the same with the read reset and read clock. The 8-line data 99 of the data read out are inputted to the computation circuit 103 and subjected to computation together with the orthogonal function data 102 in the EX-OR 119 as shown in FIG. 28. The number of "1"s in the resultant output is decoded and outputted as the liquid crystal data 47. At this time, the orthogonal function data 102 for computation is generated by the function generation circuit 101 shown in FIG. 29.

In accordance with the field signal 84 and read count 100, the orthogonal function memory 122 generates orthogonal function data 102 on the basis of relations shown in FIG. 30. That is to say, orthogonal function data of division time K1 to K4 corresponding to W1 of FIG. 16 are generated when the field signal 84 is "1". When the field signal is "2", orthogonal function data of division time K5 to K8 corresponding to W2 are generated. When the field signal is "3", orthogonal function data of division time K9 to K12 corresponding to W3 are generated. When the field signal is "4", orthogonal function data of division time K13 to K16 corresponding to W4 are generated.

As for the line block counter 123, the frame memory read data 45 are once written into the line memory and thereafter read out as shown in FIGS. 31A to 31C, and hence the frame memory read data 45 are delayed by time corresponding to 8 lines. Therefore, the line block counter 123 counts from one up to 30 at timing delayed by 8 lines with respect to the read V signal 81. (240 lines are divided into 30 parts each having 8 lines.) That is to say, the line block signal 124 outputted from this line block counter 123 indicates the block (block 1 to 30 each containing 8 lines) of the line read out from the line memory and presently computed in the computation circuit 103. The column signal control signal 48 contains the horizontal clock 125 and liquid crystal clock 126. Respective signals are generated by the read circuit 94. The horizontal clock 125 has a period, which is equal to the period of the AR reset 116 and which is twice the period of the read H signal 82. The liquid crystal clock 126 has a period equivalent to that of the read clock. The horizontal clock 125 and liquid crystal clock 126 can be represented by OR operation of the AR reset 116 and BR reset and OR operation of the AR clock 117 and BR clock, respectively.

The column electrode driver 53 latches successively the liquid crystal data 47 by the liquid crystal clock 126. In response to the horizontal clock 125 after latch of data corresponding to 640 dots, the driver 53 selects one kind out of 9 kinds of voltage as the columnn electrode signal on the basis of information of liquid crystal data 47 of respective dots and outputs it. That is to say, the liquid crystal data 47 is converted into voltage with a delay of one period of the horizontal clock 125 as shown in FIGS. 32A to 32F, and the resultant voltage is supplied to the liquid crystal display panel 61. Characters 1-k1, 1-k2, . . . denote results of computation of the orthogonal function with division time k1, k2, . . . on display data of the first block (the first row to the eighth row).

Operation of the row function generation circuit 50 will now be described. The generation circuit 50 controls the row electrode driver 57 so that the orthogonal function may be outputted with respect to the line which is being subjected to computation in the column signal generation circuit 46. The generation circuit 50 can be realized by the configuration shown in FIG. 33. As shown in FIG. 33, the partial counter 127 is reset by the horizontal clock 125. The partial counter 127 repetively counts from one up to 8 and outputs the count as the partial count value 128. In addition, the partial counter 127 causes the block counter 130 to count the liquid crystal clocks 129 having a period of counting up to 8. That is to say, the row data control signals for controlling the driver 57 contains the horizontal clock 135 and liquid crystal clock 126. Therefore, the row data 51 other than those having the same block value 131 as the line block signal 124 has are set to "0". The comparator 132 and the selector 136 function for this purpose. When the line block signal 124 has coincided with the block value 131, the orthogonal function data 102 which have been used for the computation in the generation circuit 46 are outputted as row data 51 bit by bit via the P-S circuit 174. As a result, it becomes possible to provide only rows of the computed blocks with the orthogonal function data and provide other rows with "0".

Owing to the operation heretofore described, it becomes possible to control the computation for column electrodes and application of voltage to row electrodes and it becomes possible to drive liquid crystal display panel with distributed division time. In the present embodiment, frame memory read operation is conducted four times during the period of the write operation. However, this is not restrictive, but read operation may be conducted× times. Furthermore, the number of lines per block is 8. However, the number of lines per block may be y in the same way as the first embodiment.

Figure 35:
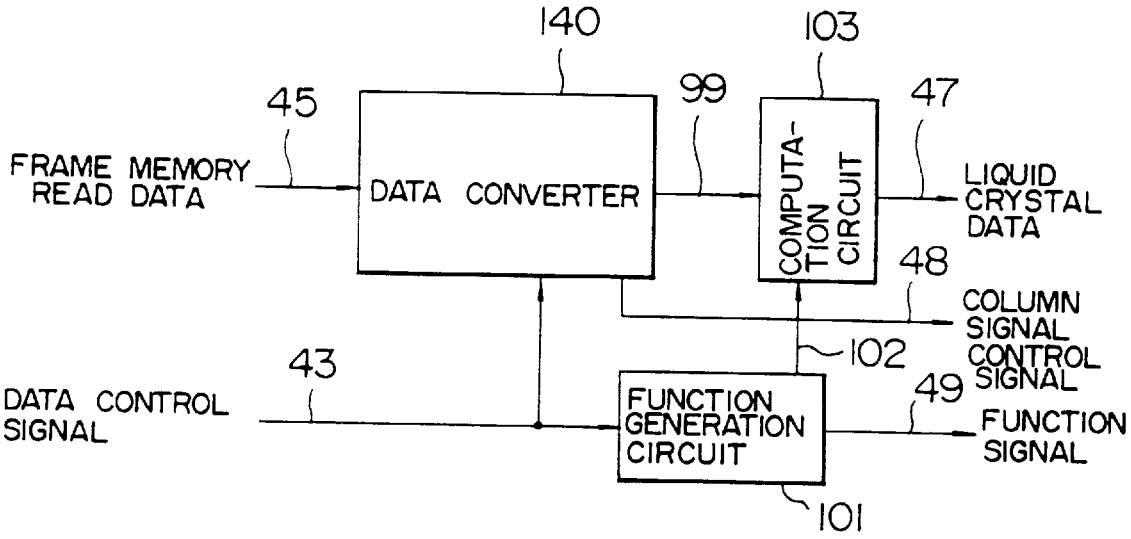
FIG. 35 is a block diagram of a variant of the column signal generation circuit 46.

In the circuit configuration of the second embodiment, line memories are used in the generation circuit 46 as shown in FIG. 22. However, this is not restrictive, but the second embodiment may also be inplemented in a configuration which does not use line memories. This modification will now be described. In the modification of the liquid crystal display apparatus, writing the display data into the frame memory 44 and reading the frame memory read data 45 therefrom are controlled by the frame memory controller 40. FIGS. 34A to 34F are timing diagrams illustrating the operation of reading data from the frame memory 44. FIG. 35 is a block diagram of the column signal generation circuit 46. In FIG. 35, numeral 140 denotes a data converter for making data rearrangement of the frame memory read data 45. Other blocks are identical with those of the second embodiment and they conduct the same operation. FIGS. 36A to 36F are timing diagrams illustrating the operation of the data converter 140. The operation of this modification will hereafter be described by referring to drawings. Inputted display data 35 and timing signal are inputted at timing shown in FIGS. 18A to 18F. The inputted display data 35 are written into the frame memory 44 by the frame memory controller 40. By using the inputted timing signals, i.e., the H signal 36, V signal 37, DCLK 38, and display signal 39, the controller 40 generates signals of the frame memory control signal 42. These operations are identical with those of the second embodiment. The display data 35 written into the frame memory 44 are read out by the controller 40 and supplied to the column signal generation circuit 46 as the frame memory read data 45. In accordance with the timing of this read operation, the controller 40 generates reference clocks having the same periods as those of the read V signal 81, read H signal 82, read display signal 83, field signal 84 and DLCK 38 on the data control signal 43. This read operation will hereafter be described. In the same way as the second embodiment, data are read from the memory-A 62 or memory-B 63, which is included in the frame memory of FIG. 20 and which is not being subjected to write operation, four times during the period of the V signal 37 equivalent to the frame period of input as shown in FIGS. 34A to 34F. Therefore, the read V signal 81 has four periods during one frame interval of the input and forms the first to fourth fields indicated by the field signal 84. During one field interval, the read H signal 82 has 30 periods. During one period, display data for 8 lines are read out from the frame memory 44. In the first period of the read H signal 82, therefore, data of the first to eighth lines are read by 4 bits in the horizontal direction as shown in FIG. 34E to form the frame memory read data 45. In FIG. 34E, L1, L2, . . . , L8 denote data of the first line, second line, . . . , eighth line, respectively.

In this modification, the order of reading the frame memory read data 45 is changed from that of the second embodiment. With the exception of difference in period of the read H signal 82 caused therefrom, the operation of the modification is identical with that of the second embodiment.

The frame memory read data 45 are supplied to the generation circuit 46 together with the signal on the data control signal 43. The circuit 46 can be realized by the configuration shown in FIG. 35. As shown in FIGS. 36A to 36F, the data converter 140 converts the frame memory read data 45 containing data for 8 lines each having 4 bits in the horizontal direction to 8-line data 99 containing 8 bits having one bit in the horizontal direction for each of 8 lines. As shown in FIG. 35, the 8-line data 99 are supplied to the computation circuit 103 and converted to the liquid crystal data 47. Operation of the computation circuit 103 is similar to that of the second embodiment. Even if line memories are not used, the same operation as that of the second embodiment can be implemented.

Figure 37:
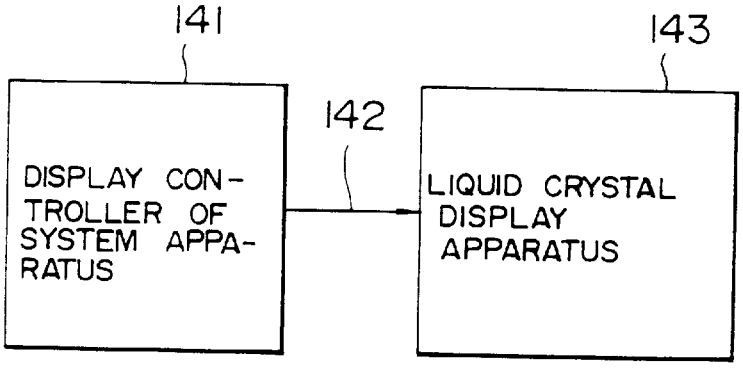
FIG. 37 is a block diagram illustrating the interface between a display controller of a system apparatus and a display apparatus.

As represented by a liquid crystal display apparatus 143 shown in FIG. 37, the liquid crystal display apparatus of the embodiments heretofore described is often connected in use with a display controller 141 of system apparatus, which is a display control circuit of an information processing apparatus such as a personal computer, work station, or word processor generating display data, via an interface signal 142. The interface signal used at this time is shown in FIGS. 38A to 38F. This is the input signal used in the above described embodiments, and includes the V signal 37, H signal 36, display data 35, display signal 39 and DCLK 38. The V signal 37 is a signal indicating the interval for sending display data of one screen to the liquid crystal display apparatus 143. One period thereof is referred to as one frame. The H signal 36 indicates the interval for sending data of display data for one line. One period thereof is referred to as one horizontal interval. As for the display data 35, data of one screen are serially sent to the liquid crystal display apparatus 143 bit by bit in accordance with the above described timing. Although not illustrated, the DCLK 38 is a clock synchronized with the display data. The display signal 39 is a signal indicating data which are included in the display data 35 and which should be displayed on the liquid crystal display apparatus. In FIGS. 38A to 38F, data which are not displayed and referred to as retrace data are present only in the horizontal direction (as represented by data preceding data "1" of the illustrated display data 35 and data succeeding data "640"). However, this is not restrictive, but retrace line data of several lines may also be used.

The interface of the information processing apparatus is not restricted to this. For example, by providing the frame memory controller, frame memory, column signal generation circuit, row function generation circuit and the like used in each embodiment in the display controller 141 of system apparatus, the interface signal 142 as shown in FIGS. 39A to 39F or FIGS. 40A to 40F can also be used.

FIGS. 39A to 39F are timing diagrams showing an example of the interface signal 142 in case where the frame memory controller and frame memory of the second embodiment are provided in the display controller 141 of system apparatus. This signal includes the frame memory read data 45 and data control signal 43 shown in FIGS. 19A to 19F. Although not illustrated, a clock synchronized with the read data 45 is also needed. Although the read data 45 are 4-bit parallel data, this is not restrictive. As for the number of parallel bits, one bit serial stream or an arbitrary plurality of bits may be used. In case of parallel transmission, it is also conceivable to add a clock having a data period of one lo dot as the interface signal for the purpose of simplifying timing design of the processing circuit of the liquid crystal display apparatus side.

Figure 42:
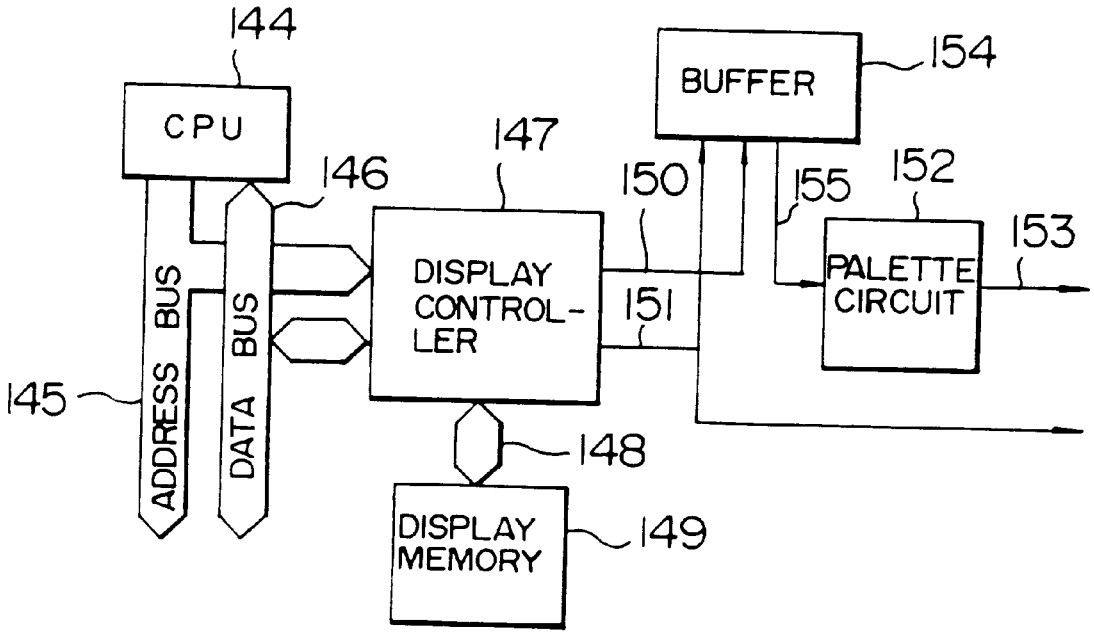
FIG. 42 is a block diagram of a display controller of a system apparatus using the interface signal shown in FIGS. 39A to 39F.

FIG. 42 is a timing diagram showing an example of the interface signal 142 in case where the frame memory controller and frame memory of the second embodiment are provided in the display controller 141 of system apparatus. This signal includes the frame memory read data 45 and data control signal 43 shown in FIGS. 34A to 34F. Although not illustrated, a clock synchronized with the read data 45 is also needed. Although the read data 45 are 4-bit parallel data in FIGS. 39A to 39F, this is not restrictive. As for the number of parallel bits, one bit serial stream or an arbitrary plurality of bits may be used. As for readout in the line direction as well, it is also possible to send 8-bit data in order by sending, for example, 8-bit data of the first line, then 8-bit data of the second line, 8-bit data of the third line, and so on. That is to say, the feature here is that data of one horizontal period are not sent in order, but data of a plurality of lines are sent alternately. In case of parallel transmission, it is also conceivable to add a clock having a data period of one dot as the interface signal for the purpose of simplifying timing design of the processing circuit of the liquid crystal display apparatus side.

The feature of the interface signal in the above described two embodiments is that data of the same screen are sent a plurality of times. Four times and other timing are not restrictive. As compared with the data signal control bus 43 of the second embodiment, there is no field signal. However, this can be easily generated from the v signal and read V signal.

An example of the interface signal 142 in case where the column signal generation circuit and row function generation circuit are provided in the display controller 141 of system apparatus will now be described. Taking FIG. 17 as an example, the interface signal 142 of this case includes the liquid crystal data 47, row data 51 and the column data control signal 48 and row data control signal 52. Features at this time are that the liquid crystal data are the result of computation of display data of a plurality of lines with an orthogonal function applied to the plurality of lines and the interface for the row electrode driver includes not only the timing signal but also the row data 51 for controlling the operation thereof. Furthermore, such configuration that only the row function generation circuit is provided in the liquid crystal apparatus 143 is also conceivable. At this time, the function signal 49 joins in the interface signal 142 instead of the row data 51 and the row data control signal 52. The signal of the function signal is formed by, for example, the orthogonal function data 102 indicating data of the orthogonal function to be computed with display data of a plurality of lines as shown in the second embodiment, the line block signal 124, the horizontal clock 125, and the liquid crystal clock 126. It should be noted in this case that there is orthogonal function data 102 used for the computation of the liquid crystal data 47 as the interface signal 142. Furthermore, the above described timing signal is not restrictive, but a timing signal capable of converting the orthogonal function data 102 to row data 51 for driving the row electrode driver 57 and capable of generating the signal of the row data control signal 52 suffices.

Figure 41:
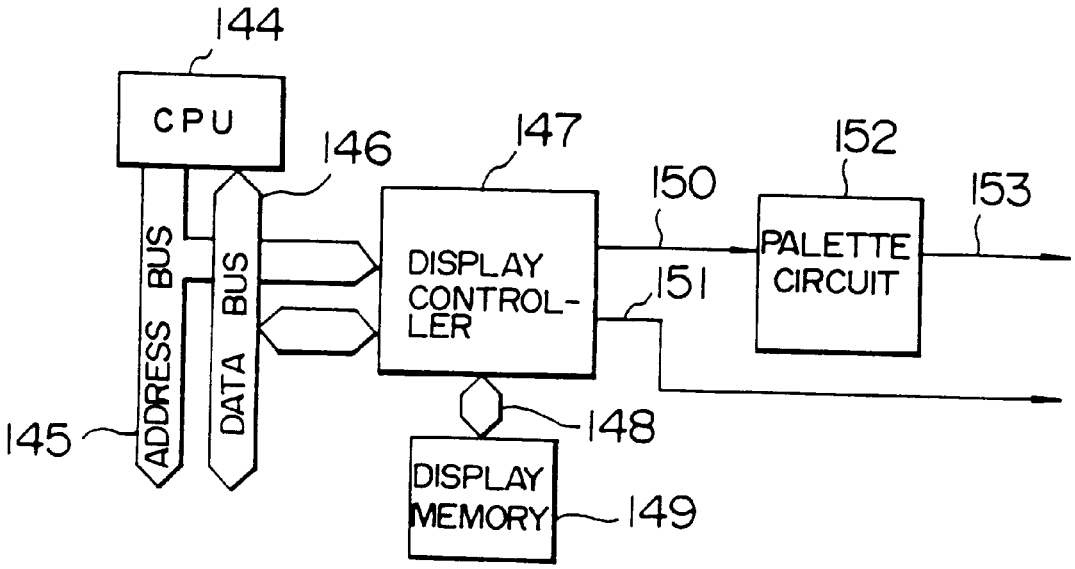
FIG. 41 is a block diagram showing a display controller 141 of a system apparatus.

An embodiment in case where the function described before by referring to the embodiments is provided in the display controller 141 of system apparatus will now be described by referring to drawing. FIG. 41 is a block diagram of an example of the display controller 141 of system apparatus. Numeral 144 denotes a CPU which is a central arithmetic unit, 145 an address bus, 146 a data bus, 147 a display controller, 148 a display memory bus, 149 a display memory for storing display data, 150 display palette data, 151 a display timing control signal bus, 152 a palette circuit, and 153 display data. The interface signal 142 at this time has timing shown in FIGS. 18A to 18F. (DCLK is not illustrated.) By using the display controller 147, the CPU 144 indicates the write or read position of the display memory 149 via the address bus and conducts data write or read position via the data bus. Thereby, the CPU 144 can write a picture to be written in the display memory and read it from the display memory 149. The display controller 147 mediates the write and read operation conducted with respect to the display memory 149 by the CPU 144 and reads data from the display memory 149 to send data to be displayed to the display apparatus. Furthermore, the display controller 147 generates the display timing control signal 151. Data read out from the display memory 149 by the display controller 147 become the display palette data 150, and become the display data 153 via the palette circuit 152. Typically, the palette circuit 152 converts the display palette data 150 to color information. Since it is now supposed that monochrome display is used, the palette data 150 are used as the display data 153 as they are.

Figure 43:
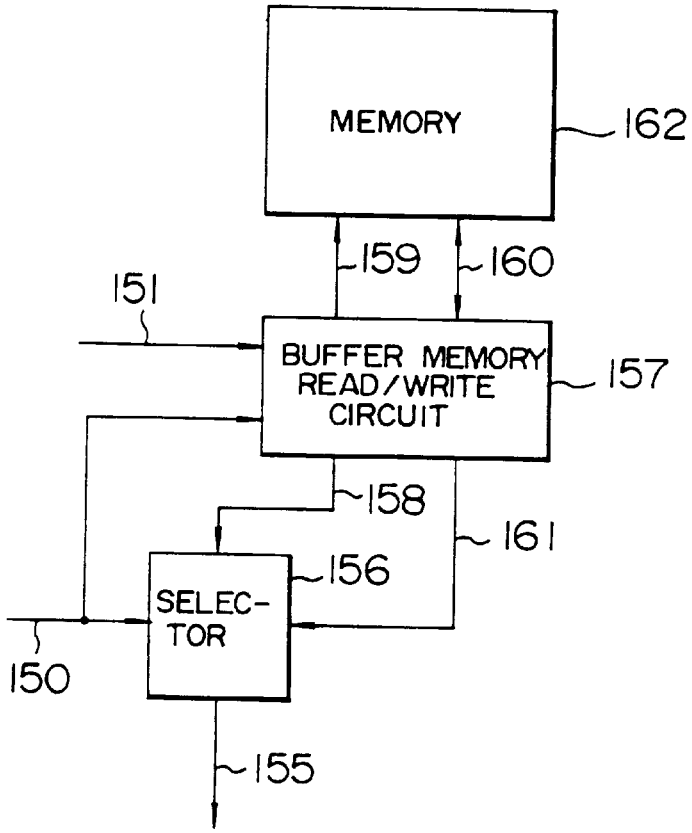
FIG. 43 is a block diagram of a buffer 154.

FIG. 42 shows an embodiment of a display controller of system apparatus in case the interface signal shown in FIGS. 39A to 39F is used. As compared with the above described case where the functions of the frame memory controller and frame memory are provided in the system apparatus as they are, the capacity of the memory for storing the display data can be reduced to ⅔. FIG. 42 is a block diagram of an embodiment of a display controller of system apparatus. As compared with the conventional configuration, how the display controller 147 reads data from the display memory 149 is changed and in addition a buffer memory for storing the data thus read out is provided. As shown in FIG. 20, the frame memory described before uses two memories each storing data for one screen. In the present embodiment, however, a buffer 154 stores data corresponding to one screen. Numeral 155 denotes buffer data. FIG. 43 is a block diagram of the buffer 154. Numeral 156 denotes a selector which switches the palette data 150 or stored data. Numeral 157 denotes a buffer memory read/write circuit, 158 a data changeover signal, 159 a memory control signal, 160 memory data, and 161 memory read data. Numeral 162 denotes a memory for storing display data for one screen. In order to control writing and reading with respect to the memory 162, the read/write circuit 157 generates the memory address and the memory control signal 159, which is used for memory write and read operation, by using the display timing control signal 151. FIGS. 44A to 44I are timing diagrams illustrating the palette data 150. As shown in FIGS. 44A to 44I, the display controller 147 of FIG. 42 reads out data corresponding to one screen from the display memory 149 during the first period (the first field) of the read V signal having a period (one field interval) equivalent to one fourth of one frame interval and sends the data for one screen as the palette data 150. During the subsequent second field to the fourth field, the display controller 147 does not read out data from the display memory. During one field period, the read H signal has 260 periods. In the tenth period to 249th period of the read H signal, the palette data 150 have data of the first line to 240th line. In FIG. 44E, this is represented by L1 to L240. The read display signal is a signal which becomes "high" when the palette data 150 become the displayed data. As for palette data 150, data of 640 dots represented by "1" to "640" in one period of the read H signal become serial data. In the first field, such palette data 150 are selected as the buffer data 155 by the selector 156. In addition, the palette data 150 in the first field are written into the memory 162 by the read/write circuit 157. In the second field and succeeding fields, written data are read out from the memory 162 by the read/write circuit 157 at the same timing as that of the palette data 150 to become the memory read data 161. At this time, data for one screen are read during one field. In the second to fourth fields, the memory read data 161 are selected as the buffer data 155 by the selector 156. Therefore, the buffer data 155 become the display data 153 via the palette circuit 152 and becomes identical with the frame memory read data shown in FIG. 39E. By using the display timing control signal 151, the read/write circuit 157 generates various control signals. However, this will not be described here in detail. It would be evident that they can be easily generated from the timing signals shown in FIGS. 44A to 44I and dot clocks used as the reference signal of palette data.

In the present embodiment, one frame interval during which data for one screen have been read out is divided into a plurality of field intervals. During one field included therein, display data are read from the display memory 149, used as the display data 153 as they are, and in addition stored in the memory 162. In the remaining fields, data stored in the memory 162 are read out at the rate of one screen per field and used as the display data 153. As compared with the embodiments described before, therefore, the capacity of the memory 162 can be equivalent to that for one screen.

In order to illustrate the operation of reading data from the display memory 149 conducted by the display controller 147 in case the interface signal shown in FIGS. 40A to 40F is used in the present embodiment, FIGS. 45A to 45I show timing of the palette data 150. As shown in FIGS. 45A to 45I, data for one screen are read in the first field by the display controller 147 to become the palette data 150. As for the palette data 150, data for one screen are read during 30 periods of the read H signal, and data corresponding to 8 lines are read during one period. In LL1 shown in FIG. 45E, therefore, data of 8 lines ranging from the first line to the eighth line are read. In LL2, data of the ninth line to 16th line are read. In LL30, data of the 233rd line to 240th line are read. During one period of the read H signal, data for 8 lines are read at the rate of one dot per line. This is repeated. (In FIG. 45H, L1, L2, . . . , L8 denote the first line, the second line, . . . , the eighth line, and "1" to "640" denote the first dot to the 640th dot.)

A third embodiment of the liquid crystal display apparatus according to the present invention will now be described. The liquid crystal display apparatus of the present embodiment is basically identical with that shown in FIG. 5. In this example, however, the column signal generation circuit 17 generates the column data 16 by computing the display data 45 with the row function data 23 outputted by the row function generation circuit 22. In addition, the column signal generation circuit 17 outputs an overflow signal 206 to the generation circuit 22. The liquid crystal panel has 240 rows (N=240). The column electrode driver 18 is capable of generating voltages of 64 levels. Data for one row are taken in one division interval. The row electrode driver 24 takes in function values corresponding to the number of rows in one division interval from the row function data 23, and thereafter simultaneously outputs voltages depending upon the function values to the liquid crystal panel 28 via the row electrodes 25, 26, . . . , 27. This operation of taking in the row function data 23 is also conducted during one division interval, and it is in synchronism with the operation of taking in data and outputting data conducted by the driver 18.

Figure 46:
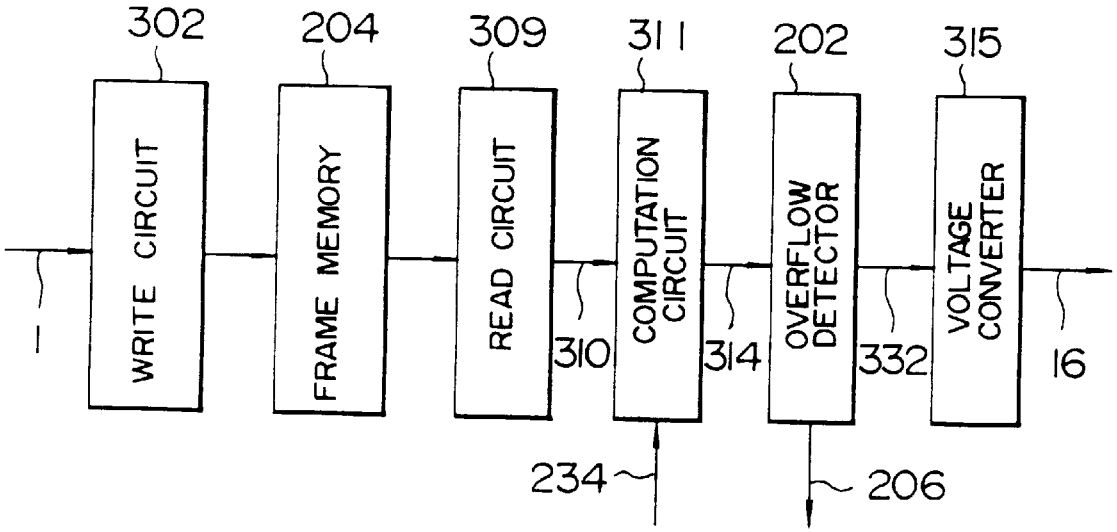
FIG. 46 is a diagram showing details of a column signal generation circuit 17.

FIG. 46 is a diagram showing details of the column signal generation circuit 17. Numeral 302 denotes a write circuit, 204 a frame memory, 309 a read circuit, and 310 data for one column. The write circuit 302 takes in the display data 1 and writes the display data successively into the frame memory 204. The read circuit 309 reads display data for one column from the frame memory 204 and outputs the display data as data 310 for one column. Numeral 311 denotes a computation circuit, 202 an overflow detector, 315 a voltage converter, 314 the number of coincident values, and 332 original column data. The computation circuit 311 computes the data 310 for one column with the row function data 23 and outputs the number 314 of coincident values. If the number 314 of coincident values is between predetermined upper limit value and lower limit value, the detector 202 accepts the number 314 of coincident values as it is, and outputs it as the original column data 332. If the number 314 of coincident values exceeds the predetermined upper limit value or lower limit value, the detector 202 outputs a logic 1 as the overflow signal 206. If the number 314 of coincident values is between the upper limit value and lower limit value, the overflow signal 206 becomes a logic "0". The voltage converter 315 converts the original column data 332 to the column data 16. Details of the computation circuit 311 and detector 202 will be described later.

In the frame memory 204, display data corresponding to one frame are stored. Details of the computation circuit 311 are identical with those of FIG. 11 or 28. The EX-OR circuit derives exclusive OR of the display data for one column and the row function data 23 bit by bit. The decoder counts logic 0s resulting from the computation and outputs the count as the number 314 of coincident values.

Figure 47:
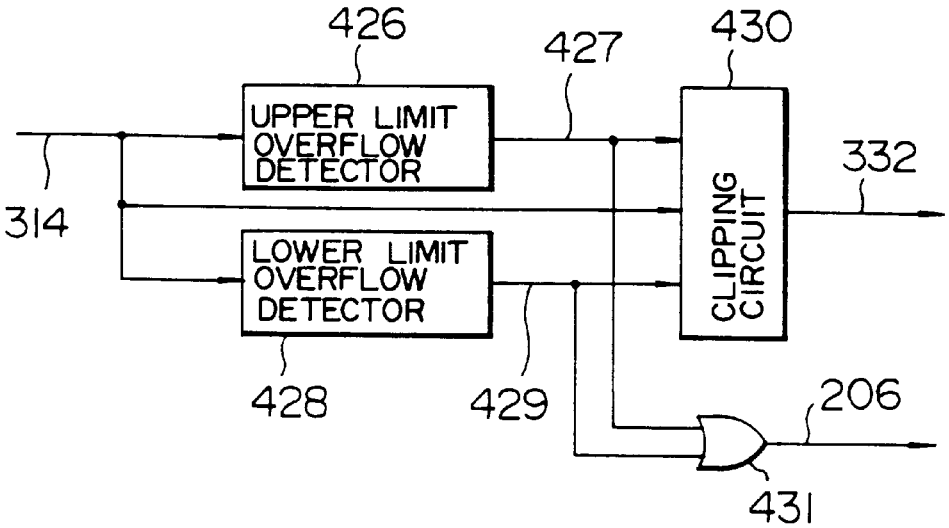
FIG. 47 is a diagram showing details of an overflow detector 20.

FIG. 47 is a diagram showing details of the overflow detector 202. Numeral 426 denotes an upper limit overflow detector, 427 an upper limit overflow signal, 428 a lower limit overflow detector, 429 a lower limit overflow signal, 430 a clipping circuit, and 431 an OR circuit. The detector 426 causes the upper limit overflow signal 427 to become a logic 1 when the number 314 of coincident values has exceeded the predetermined upper limit value and causes the signal 427 to become a logic 0 when the number 314 of coincident values has not exceeded the predetermined upper limit value. The detector 428 causes the lower limit overflow signal 429 to become a logic 1 when the number 314 of coincident values has become smaller than the predetermined lower limit value and causes the signal 429 to become a logic 0 when the number 314 of coincident values has exceeded the predetermined lower limit value. The clipping circuit 430 outputs the upper limit value as the original column data 332 when the upper limit overflow signal 427 has been outputted, whereas the circuit 430 outputs the lower limit value as the original column data 332 when the lower limit overflow signal 429 has been outputted. Otherwise, the number 314 of coincident values is outputted as it is as the original column data 332. The OR circuit 431 derives logical sum of the upper limit overflow signal 427 and lower limit overflow signal 429, and causes the overflow signal 206 to become a logic 1 when either of them is a logic 1.

Figure 48:
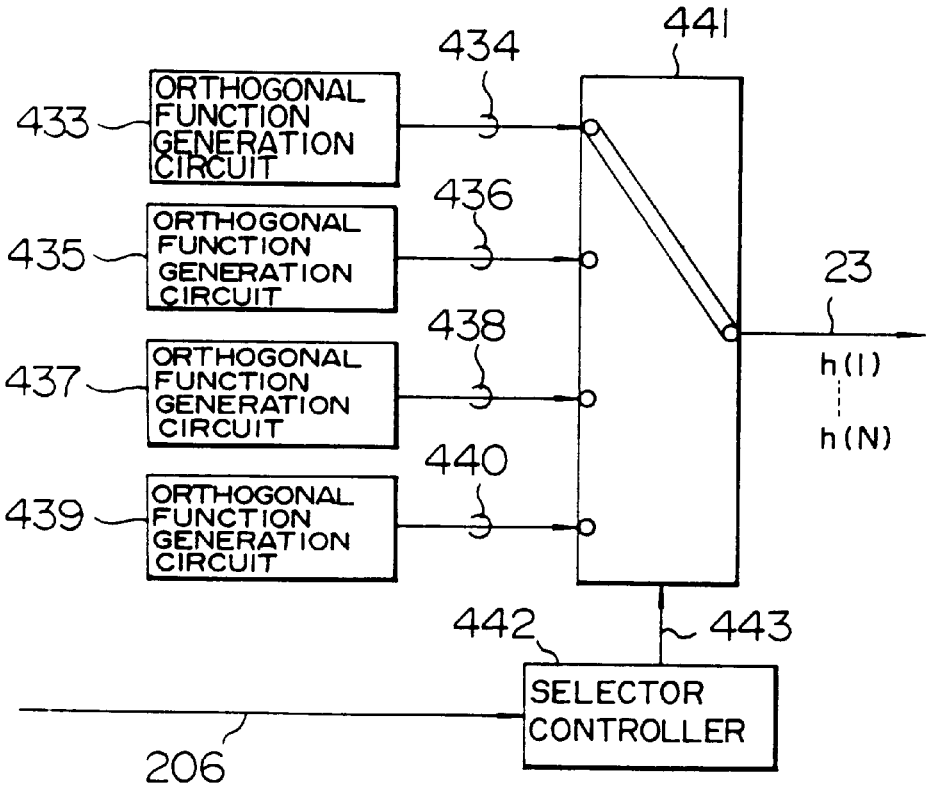
FIG. 48 is a diagram showing details of a row function generation circuit 22.

FIG. 48 is a diagram showing details of the row function generation circuit 22. Numerals 433, 435, 437 and 439 denote orthogonal function generation circuits. Numerals 434, 436, 438 and 440 denote orthogonal function data outputted by respective orthogonal function generation circuits. In the present embodiment, four kinds of orthogonal function are generated. Numeral 441 denotes a selector, 442 a selector controller, and 443 a select signal. Four kinds of orthogonal function data 434, 436, 438 and 440 outputted by respective generation circuits 433, 435, 437 and 439 are shown in FIGS. 49, 50, 51 and 52, respectively. The selector 441 selects one out of the orthogonal function data 434, 436, 438 and 440 and outputs it as the row function data 23. The controller 442 generates the select signal 443 in accordance with the overflow signal 206 and determines the selection operation of the selector 441.

Figure 49:
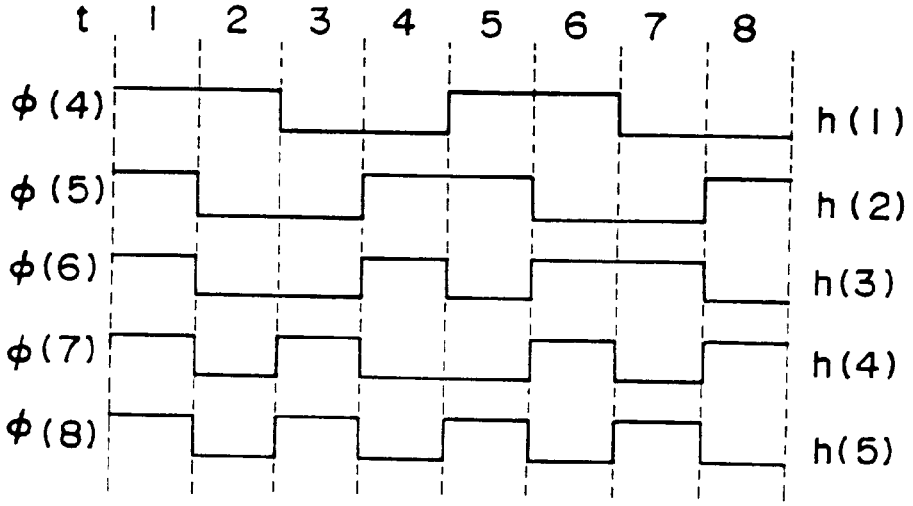
FIGS. 49 to 52 are diagrams showing orthogonal function data 34.
Figure 50:
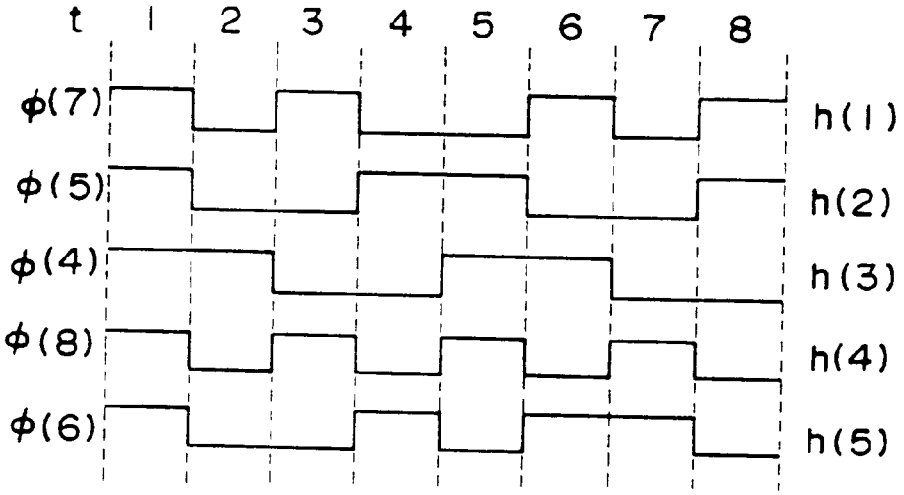
Figure 51:
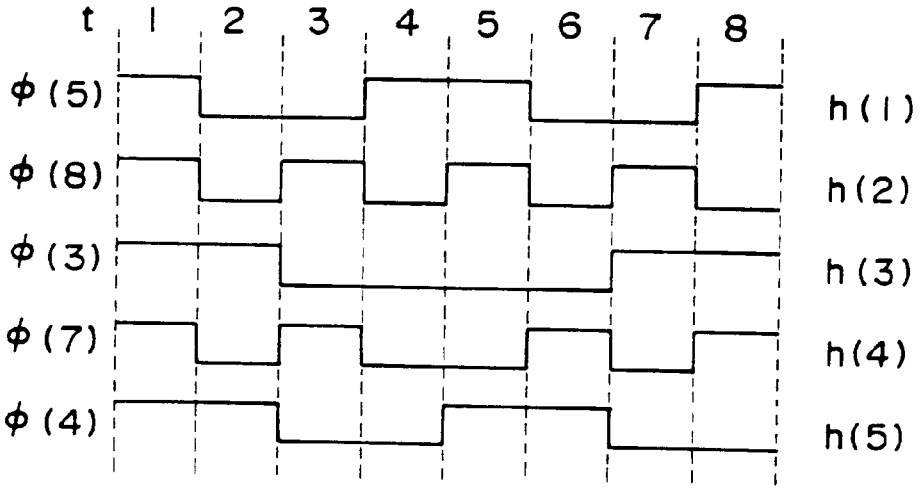
Figure 52:
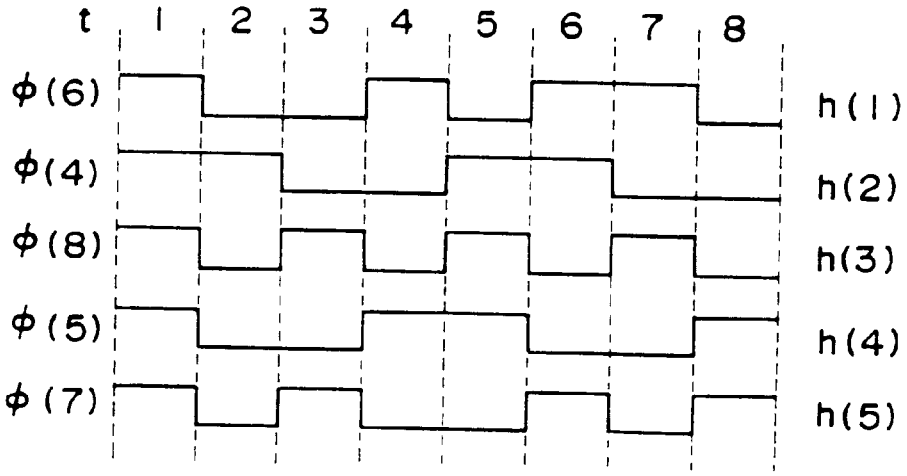

Operation of an embodiment having the configuration heretofore described will now be described. In the column signal generation circuit 17, the write circuit 302 writes the inputted display data 1 into the frame memory 204 successively as P(1,1), P(1,2), P(1,3), . . . , P(1,M), P(2,1), P(2,2), . . . , P(2,M), . . . , P(N,1), P(N,2), . . . , P(N,M). That is to say, the display data 1 are serially transmitted in the so-called dot sequential manner, and hence they are written into the frame memory 204 in order. Then the read circuit 309 reads out in a lump the display data for one column written into the frame memory 204. That is to say, for the jth column, N display data P(i,j), P(2,j), . . . , P(N,j) are simultaneously read out as the display data 310 for one column 310. The display data 310 for one column are inputted to the computation circuit 311. On the other hand, the row function data 23 are generated by the row function generation circuit 22 shown in FIG. 48. In the present embodiment, the generation circuit 22 has four kinds of orthogonal function generation circuit 433, 435, 437 and 439 which are different from each other. The orthogonal function generation circuits need not be limited to four kinds, but the number of kinds may be increased or decreased as occasion demands. One out of the orthogonal function data 434, 436, 438 and 440 outputted by the four kinds of generation circuit 433, 435, 437 and 439 is selected by the selector 441 and inputted to the computation circuit 311 as the row function data 23. Each of the generation circuits 433, 435, 437 and 439 generates N orthogonal functions h(1), h(2), . . . , h(N). For the purpose of explanation, examples of respective orthogonal function data 434, 436, 438 and 440 in case where N=5 are shown in FIGS. 49, 50, 51 and 52, respectively. FIG. 49 shows five orthogonal function data of the othogonal function data 434 outputted by the orthogonal function generation circuit 433. In the same way, FIGS. 50, 51 and 52 show five orthogonal function data of the othogonal function data 436, 438 and 440, respectively. Each of the orthogonal function data 434, 436, 438 and 440 is formed by arbitrarily taking out 5 divisions from the Walsh function having 8 divisions shown in FIG. 4 and assigning them to the orthogonal functions h(1), h(2), . . . ,h(N). Even if N orthogonal functions are formed by arbitrarily taken out divisions from the same function system such as the Walsh function and arranging the divisions, they are referred to as "orthogonal functions which are different from each other" so long as the way of taking out and arranging the divisions is different. Furthermore, the basic orthogonal function system is not limited to the Walsh function, but may be a function system satisfying the orthogonality. The Walsh function has binary values "+1" and "−1". In the following description, therefore, "+1" and "−1" are defined respectively as a logic "0" and a logic "1". The selector 441 for selecting one out of four kinds of orthogonal function which are different from each other operates under instructions from the selector controller 442. If a logic "1" of the overflow signal 206 is inputted, the controller 442 outputs the selector control signal 443 so that orthogonal function data different from that presently selected by the selector 441 may be selected. To be concrete, the controller 442 has a counter for counting logic "1s" of the overflow signal 206. Whenever a logic "1" of the overflow signal 206 is inputted, the counter counts and the orthogonal function data 434, 436, 438 and 440 are successively selected. This is not restrictive. Alternatively, a random number may be generated whenever a logic "1" of the overflow signl 206 is inputted so that orthogonal function data may be switched according to the random number. Details of the occurrence of the overflow signal 206 and the effect of switching the orthogonal function data will be described later.

Operation of the computation circuit 311, which receives the row function data 23 thus generated and the display data 310 corresponding to one column already described and which computes the number 314 of coincident values, will now be described. The computation circuit 311 conducts computation according to equation (22). The computation of equation (22) counts logic coincidences between P(i,j) and W(i,t), and represents the count as the number D of coincident values. Details of the operation of the computation circuit 311 which actually conducts computation according to the equation (22) will now be described. The display data 310 corresponding to one column and the row function data 23 are inputted to the EX-OR circuit respectively bit by bit. The EX-OR circuit conducts exclusive OR operation between P(i,j) and W(i,t). In the exclusive OR operation, the result becomes a logic "0" when the input logics coincide with each other whereas the result becomes a logic "1" when the input logics do not coincide. The subsequent decoder counts logic "0s" each indicating logic coincidence included in the output of the EX-OR circuit and outputs the count as the number 314 of coincident values. Since N=240, the number 314 of coincident values can assume a value ranging from "0" to "240". Then the number "314" of coincident values is inputted to the overflow detector 202 shown in FIG. 46. Details of operation of the detector 202 will now be described by referring to FIG. 47. As described above, the number 314 of coincident values can assume a value ranging from "0" to "240". However, the column electrode driver 18 can generate only 64 levels. Therefore, the detector determines whether the value of the number 314 of coincident values is at least "89" and "152" or less (i.e., whether the value of the number 314 of coincident values is in a range of 64 levels around N/2=120). When this range is exceeded, the detector 202 yields a logic "1" as the output of the overflow signal 206. Otherwise, the detector 202 yields a logic "0". The upper limit overflow detector 426 determines whether the number 314 of coincident values has exceeded "152". When "152" is exceeded, the upper limit overflow signal 427 becomes a logic "1". Otherwise, the upper limit overflow signal 427 becomes a logic "0". The lower limit overflow detector 428 determines whether the number 314 of coincident values has become smaller than 89. When the number 314 of coincident values has become smaller than "89", the lower limit overflow signal 429 becomes a logic "1". Otherwise, the lower limit overflow signal 429 becomes a logic "0". The upper limit overflow signal 427, the lower limit overflow signal 429, and the number 314 of coincident values are inputted to the clipping circuit 430. When both the upper limit overflow signal 427 and the lower limit overflow signal 429 are logic "0s," the number 314 of coincident values is outputted as it is as the original columnn data 332. When the upper limit overflow signal 427 is a logic "1", the value of the original column data 332 is set to "152". When the lower limit overflow signal 429 is a logic "1", the value of the original column data 332 is set to "89". In this way, the original column data 332 can assume a value in 64 levels ranging from "89" to "152". On the other hand, the logical sum of the upper limit overflow signal 427 and the lower limit overflow signal 429 is derived and outputted as the overflow signal 206. When the number 314 of coincident values has exceeded the 64-level range between "89" and "152", therefore, the overflow signal 206 becomes a logic "1". Otherwise, the overflow signal 206 becomes a logic "0". When the number 314 of coincident values is "50", for example, the value of the original column data 332 becomes "89" and the overflow signal 206 becomes a logic "1". Then the original columnn data 332 is converted to the column data 16 by the voltage converter 315. By regarding the original column data 332 as D, the voltage converter 315 converts the original column data 332 to g(j) in accordance with equation (22) and outputs g(j) as the column data 16. The column electrode driver 18 takes in the column data 16 corresponding to one row, and thereafter outputs data of one row simultaneously to the liquid crystal panel 18 via the column electrodes 19, 20 and 21.

Figure 53:
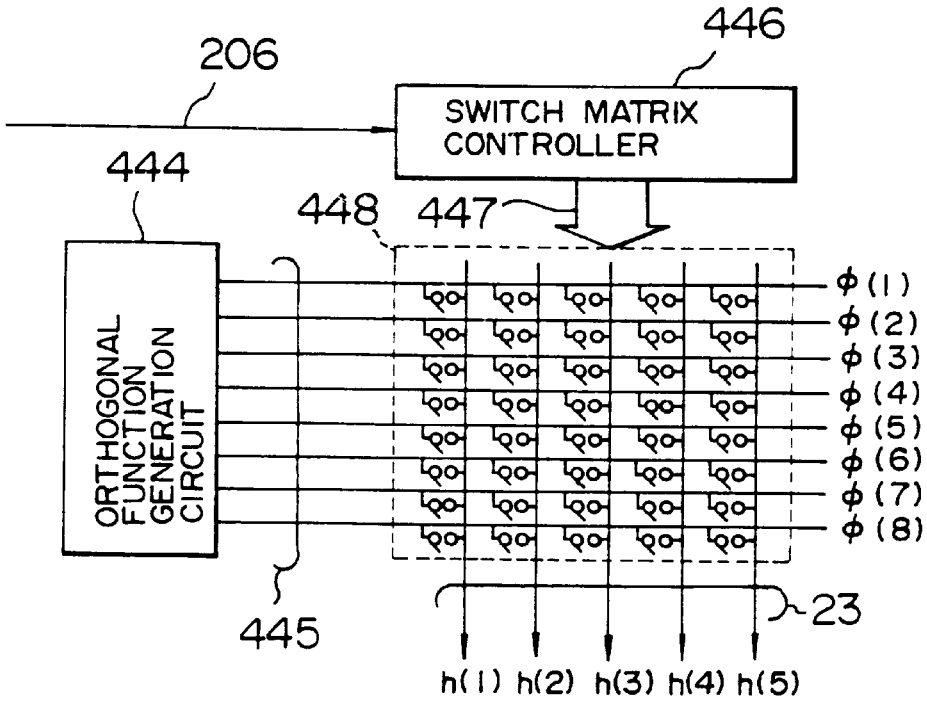
FIG. 53 is a diagram showing another example of a row function generation circuit 22 which generates different row function data by using a switch matrix.

The row function generation circuit 22 shown in FIG. 48 has four kinds of orthogonal function beforehand, one of which is selected. However, an alternative method is also conceivable. This method is shown in FIG. 53. In FIG. 53, five divisions are arbitrarily selected from the Walsh function having 8 divisions and outputted as the row function data. With reference to FIG. 53, numeral 444 denotes an orthogonal function generation circuit, 445 orthogonal function data, 446 a switch matrix controller, 447 a switch matrix control signal, and 448 a switch matrix. The row function generation circuit 22 conducts operation of arbitrarily making selections out of one kind of orthogonal function data and making rearrangement in the switch matrix 448. Turning on or off in each switch is controlled by the switch matrix controller 446. Whenever the overflow signal 206 becomes a logic "1", the controller 446 changes over the switch matrix control signal 447 and successively outputs different row function data 23. The signal patterns of the controller 446 may be stored in ROM beforehand and successively used. Alternatively, the signal patterns of the controller 446 may be generated as random numbers. It is sufficient that the row function generation circuit 22 shown in FIG. 53 has only one orthogonal function generation circuit 444.

When the number 314 of coincident values has exceeded the range of at least "89" and "152" or less (i.e., the range of 64 levels around N/=120), the column signal generation circuit 17 outputs the overflow signal 206 as heretofore described. Thereby, row function data different from the row function data 23 presently outputted by the row function generation circuit 22 are outputted. Even if display contents are constant as in a still picture and overflow occurs, therefore, a different row function is subsequently used. As a result, the number D of coincident values has value distribution conforming to normal distribution, and degradation of display quality due to lowering of column voltage can be avoided.

Figure 54:
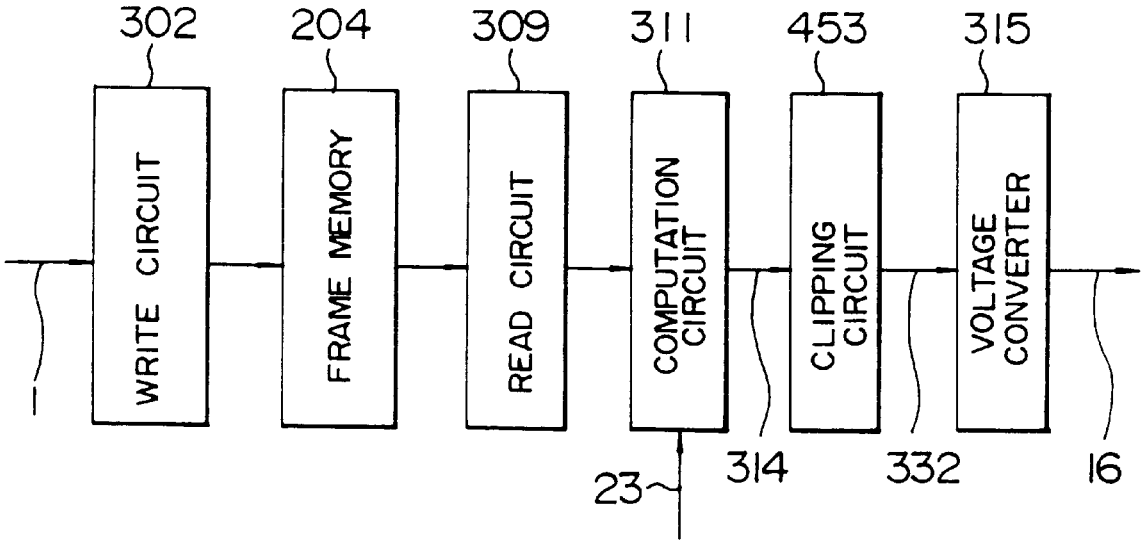
FIG. 54 is a diagram showing details of another example of the column signal generation circuit 17.

A modification of the present invention will now be described. The same components as those of the third embodiment are denoted by like characters. The detailed configuration of the column signal generation circuit 17 is shown in FIG. 54. In FIG. 54, numeral 453 denotes a clipping circuit. When the number 314 of coincident values has exceeded a predetermined upper limit value, the clipping circuit 453 outputs the upper limit value as the original column data 332. When the number 314 of coincident values has become smaller than a predetermined lower limit value, the clipping circuit 453 outputs the lower limit value as the original column data 332. When the number 314 of coincident values is within a predetermined range, the clipping circuit 453 outputs the number 314 of coincident values as it is as the original column data 332. A variant of the row function generation circuit 22 will now be described. Instead of the selector controller 442 of FIG. 48, a counter is used. Whenever a frame signal is inputted, this is counted and the selector 441 is changed over. Thereby orthogonal function data are successively changed over frame by frame. The configuration of the row function generation circuit 22 shown in FIG. 48 is not restrictive, but the switch matrix as shown in FIG. 53 may be used.

In the operation of this variant heretofore described, overflow detection described with reference to the third embodiment is not conducted, but the orthogonal function data are changed over frame by frame no matter whether overflow occurs or not. That is to say, the row function generation circuit 22 generates a different kind of orthogonal function for every frame period. Even if display contents are constant as in a still picture and overflow occurs, therefore, a different row function is used in the next frame. No matter whether overflow occurs or not, the row function is changed over one after another. As a result, the number of coincident values has value distribution conforming to normal distribution, and degradation of display quality due to lowering of column voltage can be avoided.

As heretofore described, the present invention makes it possible to realize a new liquid crystal driving method which can be applied to the case where a still picture is displayed as in a personal computer and which does not degrade the display quality even for fast responding TN liquid crystal displays.

What is claimed is:

1. A liquid crystal (LC) display apparatus comprising:

an LC panel having electrodes of N rows by M columns (where $N \geqq 2$, $M \geqq 2$), intersections of row electrodes and column electrodes forming display dots;

column data generation means for generating, for each column, column data on the basis of display data representing whether each dot should be turned on or not and values of orthogonal functions having values of −1 or 1;

driving means for driving column electrodes of said LC panel on the basis of the generated column data;

row data generation means for generating row data for each row; and driving means for driving row electrodes of said LC panel on the basis of the generated row data;

wherein N rows are divided into u groups each having n rows (where $n \geqq 2$, $n<N$);

wherein said orthogonal functions are n orthogonal functions, the n orthogonal functions being Walsh functions having m divisions (where m is an integer, $2^m \geqq n$);

wherein said row data generation means generates row data for the n rows in each of the u groups one group at a time in sequence on the basis of said n orthogonal functions; and wherein said column data generation means generates the column data on the basis of the display data and the row data for the n rows of each of the u groups.

2. An LC display apparatus according to claim 1, wherein said column data generation means comprises:

first and second line memories each for storing display data corresponding to n rows;

write means for writing display data alternately into said first and second line memories every display data corresponding to n rows;

read means for reading display data alternately from said first and second line memories $2^m$ times on data corresponding to n rows;

means for calculating, under fixed conditions, products of respective bits of n-row display data read out and respective values of said n orthogonal functions; and conversion means for generating column data on the basis of a result of calculation for respective bits.

3. An LC display apparatus according to claim 1, wherein said row data generation means includes means for generating row data, n dots of said row data having orthogonal function values, other dots of said row data having a certain fixed value other than zero, an area of orthogonal function values being changed by taking n-row data as the unit, any bit being provided with orthogonal function values in the course of one n-row data in one frame.

4. An LC display apparatus according to claim 1, wherein said row data generation means includes means for generating row data, n dots of said row data having orthogonal function values, a first number of bits among remaining dots of said row data having a first fixed value, a second number of bits among other dots having a second fixed value, an area of orthogonal function values being changed by taking n-row data as the unit, any bit being provided with orthogonal function values in the course of one n-row data in one frame.

5. An LC display apparatus according to claim 2, wherein said read means for reading display data reads out n-bit data corresponding to n rows sequentially from column 1 to column M $2^m$ times.

6. An LC display apparatus according to claim 2, wherein said write means for writing display data writes data delivered every one row alternately into said first and second line memories, as a group of n row data, and said read means for reading display data reads out n-bit data corresponding to n rows simultaneously and sequentially from column 1 to column M $2^m$ times.

7. A method for driving a display comprising the steps of:

dividing N rows into u row groups each having n rows; and performing an operation between an (n×t) orthogonal function and display data for each of the u row groups one row group at a time in sequence to generate t column data;

wherein values orthogonal to a t-dimensional orthogonal function are supplied to the rows of the row groups other than one of the row groups associated with the t-dimensional orthogonal function.

8. A method according to claim 7, wherein values orthogonal to the t-dimensional orthogonal function and zeros are supplied to the rows of the row groups other than the one row group associated with the t-dimensional orthogonal function.

9. A method according to claim 7, further comprising the step of changing the orthogonal function for every frame of one screen display.

10. A method according to claim 9, wherein the changing step includes changing the orthogonal function when a result of the operation between the orthogonal function and the display data is more or less than a predetermined value.

11. A flat panel display apparatus comprising:

a flat panel having N row electrodes and M column electrodes disposed in a matrix;

screen data storing means for storing display data for one screen, for converting the stored display data into n-line data, and for outputting the n-line data;

operating means for performing an operation between each of the n-line data and an (n×t) orthogonal function;

column driving means for outputting an operation result of the operation performed by the operating means as column electrode voltages to the M column electrodes;

row data generating means for applying values of the orthogonal function to n row electrodes of the N row electrodes associated with the operation performed by the operating means, and for applying values determined in accordance with another function to row electrodes of the N row electrodes other than the n row electrodes; and row driving means for outputting voltages to the N row electrodes in response to the values applied by the row data generating means.

12. An apparatus according to claim 11, wherein the screen data storing means outputs the stored display data for one screen during a frame period during which one screen display is performed.

13. An apparatus according to claim 12, wherein the operation result includes t values, and wherein the t values are divided into q value groups and are outputted in a distributed manner during one frame period.

14. An apparatus according to claim 13, wherein the screen data storing means includes a frame memory unit and an n-line memory unit;

wherein the stored display data is sequentially read out of the frame memory unit one line at time and stored in the n-line memory unit; and wherein the stored display data is sequentially read out of the n-line memory unit n lines at a time.

15. An apparatus according to claim 14, wherein the stored display data for one screen is read out once from the frame memory unit during one frame period; and wherein the operation result includes t values, and the t values are supplied in a distributed manner once for one frame.

16. An apparatus according to claim 12, wherein the screen data storing means includes a frame memory unit and an n-line memory unit;

wherein the stored display data is sequentially read out of the frame memory unit one line at time and stored in the n-line memory unit; and wherein the stored display data is sequentially read out of the n-line memory unit n lines at a time.

17. An apparatus according to claim 16, wherein the stored display data for one screen is read out once from the frame memory unit during one frame period; and wherein the operation result includes t values, and the t values are supplied in a distributed manner once for one frame.

18. An apparatus according to claim 11, wherein the screen data storing means includes a frame memory unit and an n-line memory unit;

wherein the stored display data is sequentially read out of the frame memory unit one line at time and stored in the n-line memory unit; and wherein the stored display data is sequentially read out of the n-line memory unit n lines at a time.

19. An apparatus according to claim 18, wherein the stored display data for one screen is read out once from the frame memory unit during one frame period; and wherein the operation result includes t values, and the t values are supplied in a distributed manner once for one frame.

* * * * *